US011944153B2

(12) United States Patent
Girard et al.

(10) Patent No.: US 11,944,153 B2
(45) Date of Patent: Apr. 2, 2024

(54) ARTICLES OF FOOTWEAR WITH ENGINEERED WOOD

(71) Applicant: PUMA SE, Herzogenaurach (DE)

(72) Inventors: Romain Girard, Lauf an der Pegnitz (DE); Matthias Hartmann, Forchheim (DE)

(73) Assignee: PUMA SE, Herzogenaurach (DE)

( * ) Notice: Subject to any disclaimer, the term of this patent is extended or adjusted under 35 U.S.C. 154(b) by 62 days.

(21) Appl. No.: 17/459,021

(22) Filed: Aug. 27, 2021

(65) Prior Publication Data

US 2022/0061457 A1 Mar. 3, 2022

Related U.S. Application Data

(60) Provisional application No. 63/072,459, filed on Aug. 31, 2020.

(51) Int. Cl.

| | |
|---|---|
| ***A43B 13/12*** | (2006.01) |
| ***A43B 13/08*** | (2006.01) |
| ***A43B 13/14*** | (2006.01) |
| ***A43B 13/18*** | (2006.01) |

(52) U.S. Cl.

CPC ..... *A43B 13/08* (2013.01); *A43B 13/122* (2013.01); *A43B 13/125* (2013.01); *A43B 13/143* (2013.01); *A43B 13/186* (2013.01)

(58) Field of Classification Search

CPC ..... A43B 13/12; A43B 13/122; A43B 13/125; A43B 13/141; A43B 13/146; A43B 13/41; A43B 23/22; A43B 13/08

USPC ..... 36/30 R, 86, 142

See application file for complete search history.

(56) References Cited

U.S. PATENT DOCUMENTS

| | | | | |
|---|---|---|---|---|
| 3,975,839 A * | 8/1976 | Taber | A43B 5/00 | 36/86 |
| 4,291,428 A * | 9/1981 | Anzani | B29D 35/122 | 12/146 B |
| 4,854,057 A * | 8/1989 | Misevich | A43B 13/12 | 36/31 |
| 5,179,791 A * | 1/1993 | Lain | A43B 13/41 | 36/43 |

(Continued)

FOREIGN PATENT DOCUMENTS

| | | |
|---|---|---|
| CH | 321491 A | 5/1957 |
| WO | 2017058419 A1 | 4/2017 |

(Continued)

OTHER PUBLICATIONS

International Search Report and the Written Opinion of the International Searching Authority from corresponding PCT Application No. PCT/IB2021/057880 dated Nov. 12, 2021 (16 pages).

*Primary Examiner* — Marie D Bays

(74) *Attorney, Agent, or Firm* — Quarles & Brady LLP

(57) ABSTRACT

An article of footwear includes an upper and a sole structure that defines a forefoot region, a midfoot region, and a heel region. The sole structure comprises densified wood and includes an upper midsole cushioning member, a lower midsole cushioning member, an outsole coupled with a bottom surface of the lower midsole cushioning member, and a plate positioned between the upper midsole cushioning member and the lower midsole cushioning member.

19 Claims, 45 Drawing Sheets

(56) References Cited

U.S. PATENT DOCUMENTS 5,592,755 A * 1/1997 Ehrlich ..... A43B 13/141 36/86
5,770,319 A * 6/1998 Franich ..... C08L 97/02 527/105
6,033,754 A * 3/2000 Cooke ..... B32B 21/08 428/114
6,254,951 B1 * 7/2001 Marmalich ..... A43B 1/00 144/329
6,401,365 B2 * 6/2002 Kita ..... A43B 13/12 36/31
6,493,965 B1 * 12/2002 Bathum ..... A43B 23/081 36/7.7
6,775,930 B2 * 8/2004 Fuerst ..... A43B 13/026 12/146 B
8,800,171 B1 * 8/2014 Khaitan ..... A43B 7/1435 36/28
9,629,413 B2 * 4/2017 Stien ..... A43B 13/143
10,442,111 B1 * 10/2019 McDonald ..... B32B 21/13
2007/0011912 A1 * 1/2007 Clark ..... A43B 1/14 36/50.1
2007/0011914 A1 * 1/2007 Keen ..... A43B 7/1495 36/50.1
2007/0283594 A1 * 12/2007 Sink ..... A43B 3/126 36/11.5
2008/0127509 A1 * 6/2008 Amado ..... A43B 9/12 12/146 B
2009/0300943 A1 12/2009 Hsieh
2010/0122400 A1 * 5/2010 Nelson ..... A43B 1/06 2/200.1
2010/0293816 A1 * 11/2010 Truelsen ..... A43B 13/141 36/30 R
2011/0030245 A1 * 2/2011 Truelsen ..... A43B 13/12 36/76 R
2016/0278476 A1 * 9/2016 Stien ..... A43B 7/20
2017/0095034 A1 * 4/2017 Dupre ..... A43B 13/22
2017/0151688 A1 * 6/2017 Eckstein ..... B32B 21/13
2017/0202303 A1 * 7/2017 Shepherd ..... B29D 35/08
2017/0224049 A1 * 8/2017 Stien ..... A43B 13/125
2018/0168281 A1 * 6/2018 Case ..... A43B 13/026
2018/0352899 A1 * 12/2018 Ng ..... A43B 23/0295
2019/0200700 A1 * 7/2019 Hale ..... A43B 13/127
2019/0365030 A1 * 12/2019 Chambers ..... A43B 13/186
2019/0366680 A1 * 12/2019 Dua ..... A43B 23/0235
2020/0008514 A1 * 1/2020 Dua ..... B29D 35/146
2020/0223091 A1 * 7/2020 Hu ..... B27K 3/16
2020/0238565 A1 * 7/2020 Hu ..... B32B 21/13
2020/0323308 A1 * 10/2020 Dubuisson ..... A43B 9/00
2021/0169173 A1 * 6/2021 Oleson ..... A43D 27/00
2022/0125158 A1 * 4/2022 Ni ..... A43B 13/127

FOREIGN PATENT DOCUMENTS

WO 2018191181 A1 10/2018
WO 2018217562 A1 11/2018

* cited by examiner

ARTICLES OF FOOTWEAR WITH ENGINEERED WOOD

CROSS REFERENCE TO RELATED APPLICATIONS

This application is based on, claims priority to, and incorporates herein by reference in its entirety U.S. provisional patent application No. 63/072,459 entitled "ARTICLES OF FOOTWEAR WITH ENGINEERED WOOD" filed on Aug. 31, 2020.

BACKGROUND

1. Field of the Disclosure

The present disclosure relates generally to an article of footwear that includes densified wood therein.

2. Description of the Background

Many conventional shoes or other articles of footwear generally comprise an upper and a sole attached to a lower end of the upper. Conventional shoes further include an internal space, i.e., a void or cavity, which is created by interior surfaces of the upper and sole, that receives a foot of a user before securing the shoe to the foot. The sole is attached to a lower surface or boundary of the upper and is positioned between the upper and the ground. As a result, the sole typically provides stability and cushioning to the user when the shoe is being worn. In some instances, the sole may include multiple components, such as an outsole, a midsole, and an insole. The outsole may provide traction to a bottom surface of the sole, and the midsole may be attached to an inner surface of the outsole, and may provide cushioning or added stability to the sole. For example, a sole may include a particular foam material that may increase stability at one or more desired locations along the sole, or a foam material that may reduce stress or impact energy on the foot or leg when a user is running, walking, or engaged in another activity. The sole may also include additional components, such as plates, embedded with the sole to increase the overall stiffness of the sole and reduce energy loss during use.

The upper generally extends upward from the sole and defines an interior cavity that completely or partially encases a foot. In most cases, the upper extends over the instep and toe regions of the foot, and across medial and lateral sides thereof. Many articles of footwear may also include a tongue that extends across the instep region to bridge a gap between edges of medial and lateral sides of the upper, which define an opening into the cavity. The tongue may also be disposed below a lacing system and between medial and lateral sides of the upper, to allow for adjustment of shoe tightness. The tongue may further be manipulable by a user to permit entry or exit of a foot from the internal space or cavity. In addition, the lacing system may allow a user to adjust certain dimensions of the upper or the sole, thereby allowing the upper to accommodate a wide variety of foot types having varying sizes and shapes.

The upper may comprise a wide variety of materials, which may be chosen based on one or more intended uses of the shoe. The upper may also include portions comprising varying materials specific to a particular area of the upper. For example, added stability may be desirable at a front of the upper or adjacent a heel region so as to provide a higher degree of resistance or rigidity. In contrast, other portions of a shoe may include a soft woven textile to provide an area with stretch-resistance, flexibility, air-permeability, or moisture-wicking properties.

However, while many currently-available shoes have varying features related to the above-noted properties, many shoes, and the sole structures thereof, may be further optimized to provide targeted support to a user's foot to aid in stability while running, walking, or engaging in strenuous athletic activities. Additionally, many shoes, and their sole structures, may be further optimized to provide targeted support to a user's foot to reduce energy dissipation and thereby increase the efficiency of a user during physical activity, such as running.

Therefore, articles of footwear having features providing such effects across areas of the foot are desired. These and other deficiencies with the prior art are outlined in the following disclosure.

SUMMARY

An article of footwear, as described herein, may have various configurations. The article of footwear may comprise densified wood and have an upper and a sole structure. The sole structure may define a forefoot region, a midfoot region, and a heel region. Further, the sole structure may include an upper midsole cushioning member, a lower midsole cushioning member, and an outsole coupled to a bottom surface of the lower midsole cushioning member. The sole structure may further include a plate positioned between the upper midsole cushioning member and the lower cushioning member. A portion or the entirety of the sole structure may comprise densified wood.

In some embodiments, the plate may include a curved portion and a flat portion. In these embodiments, the curved portion may include an anterior curved portion that extends through at least the forefoot region of the article of footwear and a posterior curved portion that extends through the midfoot region of the article of footwear and at least a portion of the heel region of the article of footwear. In further embodiments, the plate may be constructed from densified wood. In addition, the anterior curved portion may include a first segment portion and a second segment portion with a split therebetween.

In further embodiments, the sole structure may also include a heel support structure in the heel region of the article of footwear and the heel support structure may be constructed from thermoplastic polyurethane. In some embodiments, the upper midsole cushioning member and the lower cushioning member are each a foam material. For example, in particular embodiments, the foam material is formed from a material selected from the group consisting of ethylene-vinyl acetate, thermoplastic polyurethane, thermoplastic elastomer, and mixtures thereof. In even further embodiments, the foam material is formed during a supercritical foaming process or physical foaming process, which may comprise nitrogen, carbon dioxide, supercritical nitrogen, or supercritical carbon dioxide.

In particular embodiments, the anterior curved portion is angled at an angle between about 5-degrees and about 45-degrees relative to a reference plane, the posterior curved portion is angled at an angle between about 3-degrees and about 45-degrees relative to the reference plane, and the flat portion is angled at an angle between about 0-degrees and about 5-degrees relative to the reference plane.

In some embodiments, the densified wood has a density between about 1.4 g/cc and about 1.6 g/cc. In some embodiments, the densified wood panel is delignified and at least 30% of the lignin has been removed relative to the lignin content of natural wood prior to delignification. In some embodiments, the densified wood panel has been treated with a chemical to increase hydrophobicity, weatherability, corrosion resistance, or flame resistance.

In further embodiments, the densified wood is made by a process comprising contacting natural wood comprising lignin and cellulose with a sodium based chemical solution for a time and under conditions sufficient to form delignified wood and compressing the delignified wood until the thickness is reduced by at least 40%. In particular embodiments, the sodium based chemical solution comprises NaOH, NaOH/$Na_2S$, $NaHSO_3$+$SO_2$+$H_2O$, NaHSCb, $NaHSO_3$+$Na_2SO3$, NaOH+$Na_2SO_3$, $Na_2SO_3$, NaOH+AQ, NaOH/$Na_2S$+AQ, $NaHSO_3$+$SO_2$+$H_2O$+AQ, NaOH+$Na_2SO_3$+AQ, $NaHSO_3$+AQ, $NaHSO_3$+$Na_2SO_3$+AQ, $Na_2SO_3$+AQ, NaOH+$Na_2S$+$Na_2S_n$, $Na_2SO_3$+NaOH+$CH_3OH$+AQ, $C_2H_5OH$+NaOH, NaClO, $NaClO_2$+acetic acid, or combinations thereof where n is an integer and AQ is Anthraquinone. In particular embodiments, the delignified wood is compressed at a pressure between 0.5 MPa and 10 MPa. In particular embodiments, the delignified wood is compressed at a temperature between about 100° F. and about 250° F.

In some embodiments, the densified wood is made by viscoelastic thermal compression of natural wood.

In another embodiment of the present disclosure, an article of footwear including an upper and a sole structure is provided. In this embodiment, the sole structure comprises a sole plate comprising densified wood, the sole plate including one or more protruding portions. In some embodiments, a stud is attached to each of the one or more protruding portions. In particular embodiments, the studs are formed from metal, rubber, or a thermoplastic material.

In another embodiment of the present disclosure, an article of footwear including an upper and a sole structure is provided. In this embodiment, the sole structure may define a forefoot region, a midfoot region, and a heel region, and the sole structure may include a midsole cushioning member, an outsole coupled with a bottom surface of the midsole cushioning member, and a densified wood plate. The plate may also include a toe portion, an arched portion, and a rear segment. Further, in these embodiments, the toe portion and the arched portion are positioned between the midsole cushioning member and the outsole, and the rear segment is positioned above the midsole cushioning member.

In some embodiments, the midsole cushioning member includes an aperture, and a portion of the plate between the rear segment and the arched portion extends between the aperture of the midsole cushioning member. The sole structure may further include a heel cushioning member and a heel support collar. In further embodiments, the plate may include an anterior curved portion, a medial curved portion, a posterior curved portion, and a flat portion. The anterior curved portion, the medial curved portion, the posterior curved portion, and the flat portion may be each angled relative to a reference plane.

In yet another embodiment, the present disclosure provides an article of footwear having an upper and a sole structure coupled to the upper. The sole structure, in this embodiment, may also define a forefoot region, a midfoot region, and a heel region. The sole structure may further include an upper midsole cushioning member, a lower midsole cushioning member, an outsole coupled between a bottom surface of the lower midsole cushioning member, and a plate comprising densified wood positioned between the upper midsole cushioning member and the lower midsole cushioning member. In these embodiments, the upper midsole cushioning member and the lower midsole cushioning member are foam materials formed using a supercritical gas, and the plate comprises carbon fiber.

In yet another embodiment, the present disclosure provides an article of footwear having an upper comprising densified wood and a sole structure coupled with the upper.

Other aspects of the articles of footwear described herein, including features and advantages thereof, will become apparent to one of ordinary skill in the art upon examination of the figures and detailed description herein. Therefore, all such aspects of the articles of footwear are intended to be included in the detailed description and this summary.

DETAILED DESCRIPTION OF THE DRAWINGS

Figure 1:
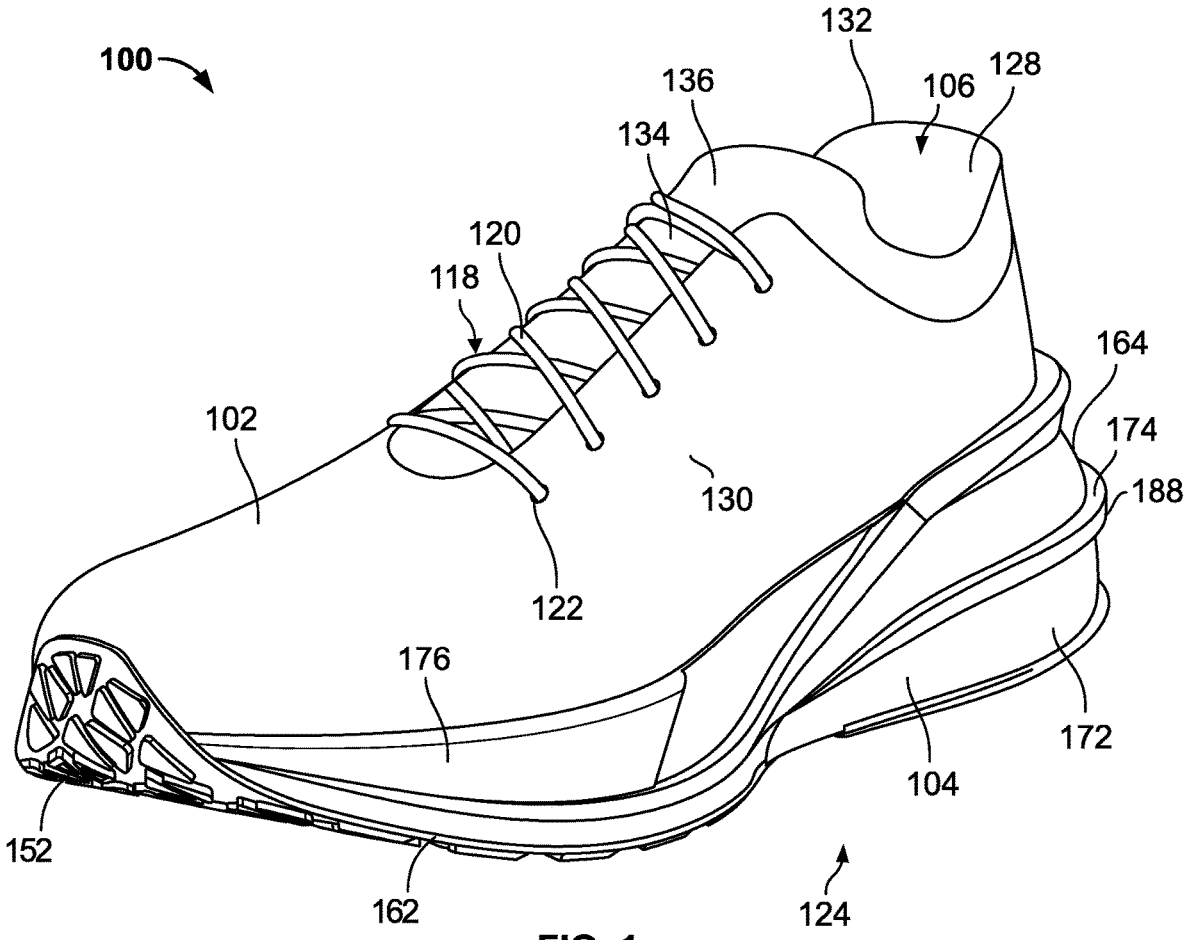
FIG. 1 is a perspective view of an article of footwear configured as a left shoe that includes an upper and a sole structure, as discussed herein.

The following discussion and accompanying figures disclose various embodiments or configurations of a shoe having an upper and a sole structure. Although embodiments are disclosed with reference to a sports shoe, such as a running shoe, tennis shoe, basketball shoe, etc., concepts associated with embodiments of the shoe may be applied to a wide range of footwear and footwear styles, including cross-training shoes, football shoes, golf shoes, hiking shoes, hiking boots, ski and snowboard boots, soccer shoes and cleats, walking shoes, and track cleats, for example. Concepts of the shoe may also be applied to articles of footwear that are considered non-athletic, including dress shoes, sandals, loafers, slippers, and heels.

The term "about," as used herein, refers to variations in the numerical quantity that may occur, for example, through typical measuring and manufacturing procedures used for articles of footwear or other articles of manufacture that may include embodiments of the disclosure herein; through inadvertent error in these procedures; through differences in the manufacture, source, or purity of the ingredients used to make the compositions or mixtures or carry out the methods; and the like. Throughout the disclosure, the terms "about" and "approximately" refer to a range of values ±5% of the numeric value that the term precedes.

The present disclosure is directed to an article of footwear or specific components of the article of footwear, such as an upper or a sole or a sole structure, comprising densified wood or formed at least partially from a densified wood panel.

As used herein, "densified wood" or "densified wood panel" are used interchangeably and refer to a processed wood material with increased strength, toughness, and density compared to a wood panel that has not been similarly processed. In some embodiments, the densified wood panel has a density between about 1.1 g/cm$^3$ and about 1.9 g/cm$^3$. In some embodiments, the densified wood panel has a density of about 1.5 g/cm$^3$.

Suitable methods for the formation of densified wood from natural wood are known and described in the art. See, for example, WO 2019/055789, WO 2018/191181, and Song et al. ("Processing bulk natural wood into a high-performance structural material," Nature, 2018, 554:224-228), each of which is incorporated herein by reference as if put forth in their entirety.

In some embodiments of the present disclosure, the densified wood panel is made by a process including a first step of contacting bulk natural wood with a sodium based chemical solution for a time and under conditions sufficient to remove lignin and hemicellulose from the natural wood and form delignified wood. The sodium based chemical solution can include chemicals used in pulping or pulp bleaching such as, but not limited to, NaOH, NaOH/$Na_2S$, $NaHSO_3$+$SO_2$+$H_2O$, NaHSCb, $NaHSO_3$+$Na_2SO3$, NaOH+$Na_2SO_3$, $Na_2SO_3$, NaOH+AQ, NaOH/$Na_2S$+AQ, $NaHSO_3$+$SO_2$+$H_2O$+AQ, NaOH+$Na_2SO_3$+AQ, $NaHSO_3$+AQ, $NaHSO_3$+$Na_2SO_3$+AQ, $Na_2SO_3$+AQ, NaOH+$Na_2S$+$Na_2S_n$, $Na_2SO_3$+NaOH+$CH_3OH$+AQ, $CH_3OH$, $C_2H_5OH$, $C_2H_5OH$+NaOH, $C_4H_9OH$, HCOOH, $CH_3COOH$, $CH_3OH$+HCOOH, $C_4H_8O_2$, $NH_3 \cdot H_2O$, p-TsOH, $H_2O_2$, NaClO, $NaClO_2$+acetic acid, $ClO_2$, and $Cl_2$, where n is an integer and AQ is Anthraquinone.

As used herein, "natural wood" refers to the composite of cellulose nanofibers embedded in a cross-linked matrix of lignin and hemicellulose as found in nature and produced by plants. Natural wood for use in the delignification and densification processes described herein can be any type of softwood or hardwood including but not limited to, basswood, oak, poplar, ash, alder, aspen, balsa wood, beech, birch, cherry, butternut, chestnut, cocobolo, elm, hickory, maple, oak, padauk, plum, walnut, willow, yellow poplar, bald cypress, cedar, cypress, douglas fir, fir, hemlock, larch, pine, redwood, spruce, tamarack, juniper and yew. In some embodiments, the natural wood for use in the densified wood is recycled or scrap wood.

The natural wood for use in the densified wood panels described herein may be selected based on its hardness. Methods for measuring hardness are known and described in the art, including, but not limited to, measuring the denting and wear resistance of a wood sample (e.g., the Janka Scale) or measuring the indentation hardness of a wood sample (e.g., the Brinell Scale. Table 1 below includes the Janka Scale hardness for several natural wood samples that may be used in the densified wood described herein.

TABLE 1

Janka Scale hardness of natural wood

| Natural wood | Janka Scale hardness |
|---|---|
| Balsa | 100 |
| Pine | 480 |
| Hemlock | 500 |
| Fir | 660 |
| Cedar | 900 |
| American Cherry | 950 |
| Black Walnut | 1010 |
| Yellow Birch | 1260 |
| Red Oak | 1290 |
| Beech | 1300 |
| Ash | 1320 |
| White Oak | 1360 |
| Hard Maple | 1450 |
| African Sapele | 1500 |
| Hickory | 1820 |
| Santos Mahogany | 2200 |
| Brazilian Cherry | 2820 |
| IPE | 3684 |

As used herein, "delignified wood" refers to wood in which at least a portion of, or substantially all of, the lignin has been removed. In some embodiments, delignified wood is wood in which at least 15%, at least 20%, at least 25%, at least 30%, at least 35%, at least 40%, at least 45%, at least 50%, at least 55%, at least 60%, at least 65%, at least 70%, at least 75%, at least 80%, at least 85%, or at least 90% of the lignin has been removed. In some embodiments, the densified wood is made of delignified wood in which at least 30% of the lignin has been removed. In some embodiments, the densified wood is made of delignified wood in which at least 40% of the lignin has been removed. The percent lignin removed is measured relative to the lignin content in the natural wood prior to any chemical delignification process.

Removal of "substantially all of the lignin" refers to removal of at least 90% of the lignin from the natural wood. In some embodiments, at least 90%, at least 95%, at least 98%, or at least 99% of the lignin has been removed from the natural wood to form the delignified wood. As used herein, "substantially free of lignin" refers to a wood product in which at least 98% of the lignin has been removed relative to natural wood.

In some embodiments, the delignified wood also has reduced hemicellulose content. In some embodiments, at least 20%, at least 30%, at least 40%, at least 50%, at least 60%, at least 70%, at least 75%, at least 80%, at least 85%, at least 90%, at least 95%, at least 98%, or at least 99% of the hemicellulose has been removed from the natural wood during the formation of delignified wood. As used herein, "substantially free of hemicellulose" refers to a wood product in which at least 98% of the hemicellulose has been removed relative to natural wood.

Without wishing to be bound by any particular theory or methodology, removal of the lignin and hemicellulose components of the natural wood results in a delignified wood that is more porous and less rigid than the natural wood due to its unique composition of mostly cellulose nanofibrils with open lumen. Compression of the delignified wood forms hydrogen bonds between the remaining cellulose nanofibers and thus improves mechanical characteristics of the densified wood.

Following delignification to form delignified wood, densified wood is formed by pressing the delignified wood to compact the cells of the delignified wood. The delignified wood is pressed at a pressure between about 0.5 MPa and about 10 MPa. In some embodiments, the delignified wood is heated at a temperature between about 100° F. and about 250° F. while being pressed. In some embodiments, the delignified wood is heated at a temperature between about 150° F. and about 220° F. while being pressed.

In some embodiments, the thickness along the axis of compression of the densified wood is reduced by at least 40%, at least 50%, at least 60%, at least 70%, at least 75%, at least 80%, at least 85%, at least 90%, or at least 95% as compared to the thickness of the natural wood across the same axis prior to delignification and densification.

In some embodiments, delignified wood is formed into transparent wood rather than being pressed to form densified wood. As used herein, "transparent wood" refers to a composite material comprised of a polymeric material and preserved naturally aligned nanoscale cellulose fibers. As described above in relation to the delignification and formation of densified wood, following delignification natural cellulose fibers remain intact in their naturally occurring orientation. Upon introduction of a polymeric material into the delignified wood product, the gaps and spaces left by the delignification process are replaced with a transparent polymeric material and the orientation and structure of the naturally occurring cellulose fibers is retained forming a transparent wood material. Suitable polymer materials include, but are not limited to, thermosetting polymers, thermoplastic polymers, cellulose based polymers, epoxy resins, polymer nano-glue, polyvinylpyrrolidone (PVP), Poly(methyl methacrylate) (PMMA), Poly(vinyl alcohol) (PVA), and Polydimethylsiloxane (PDMS). Suitable methods for the formation of transparent wood from natural wood are known and described in the art. See, for example, WO 2017/136714, and Zhu et al. ("Highly anisotropic, highly transparent wood composites," Advanced Materials, 2016, 28(26):5181-5187), each of which is incorporated herein by reference as if put forth in their entirety. It is envisioned that transparent wood can be used in addition to or in place of densified wood in any of the embodiments described herein.

In some embodiments, viscoelastic thermal compression (VTC) is used to densify natural wood without delignification. Methods for VTC processing of natural wood to form densified wood are known and described in the art. See for example Kutner et al. ("The mechanical properties of densified VTC wood relevant for structural composites," Holz als Roh-und Werkstoff, Volume 66, pages 439-446, 2008), U.S. Pat. Nos. 7,404,422, and 5,415,943, each of which is incorporated here by reference in its entirety.

Figure 9:
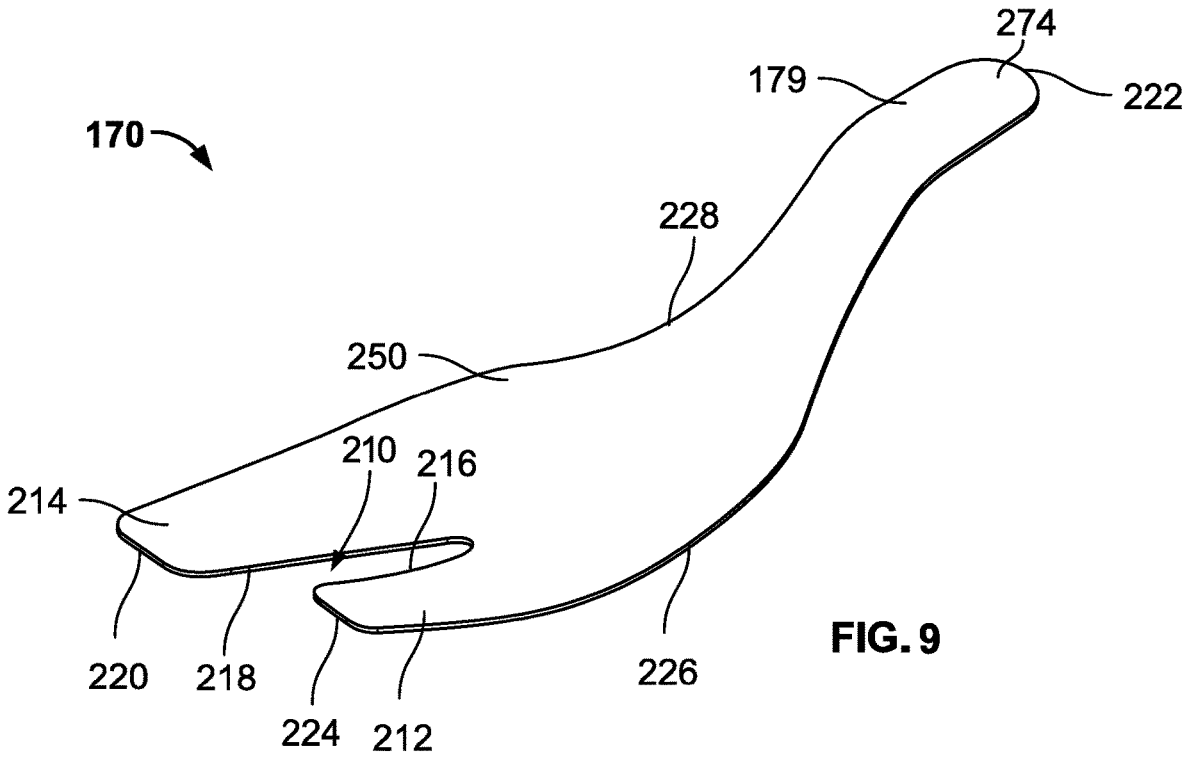
FIG. 9 is a perspective view of the plate of FIG. 8.
Figure 39:
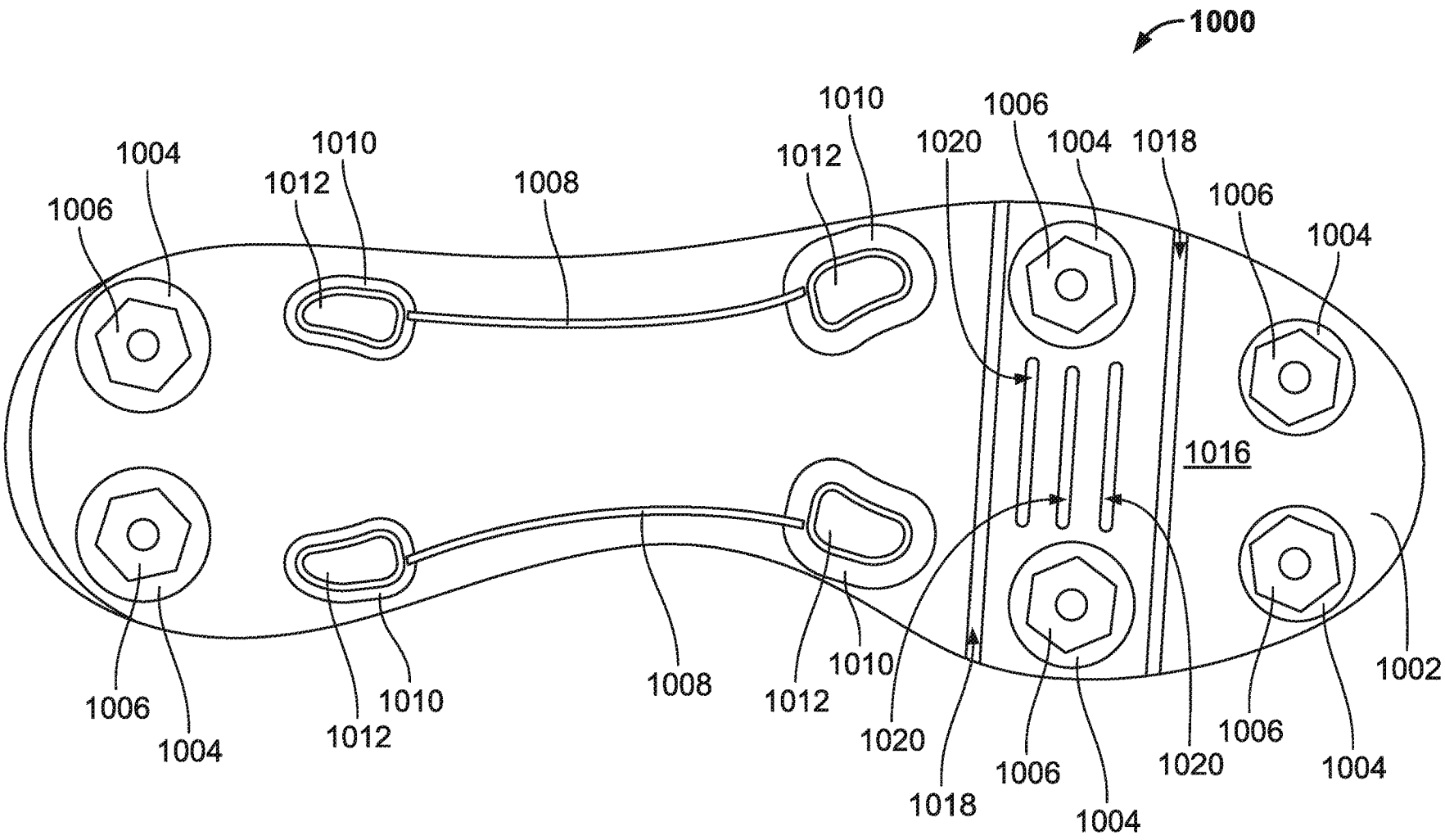
FIG. 39 is a bottom view of another sole structure for an article of footwear.
Figure 40:
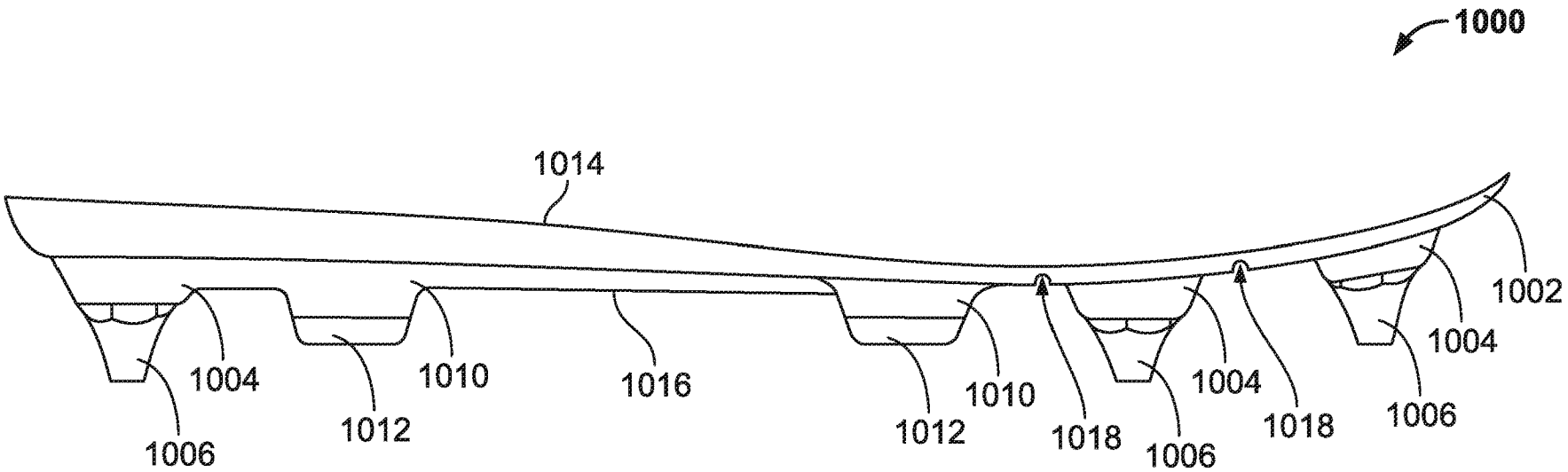
FIG. 40 is a lateral side view of the sole structure of FIG. 39.
Figure 41:
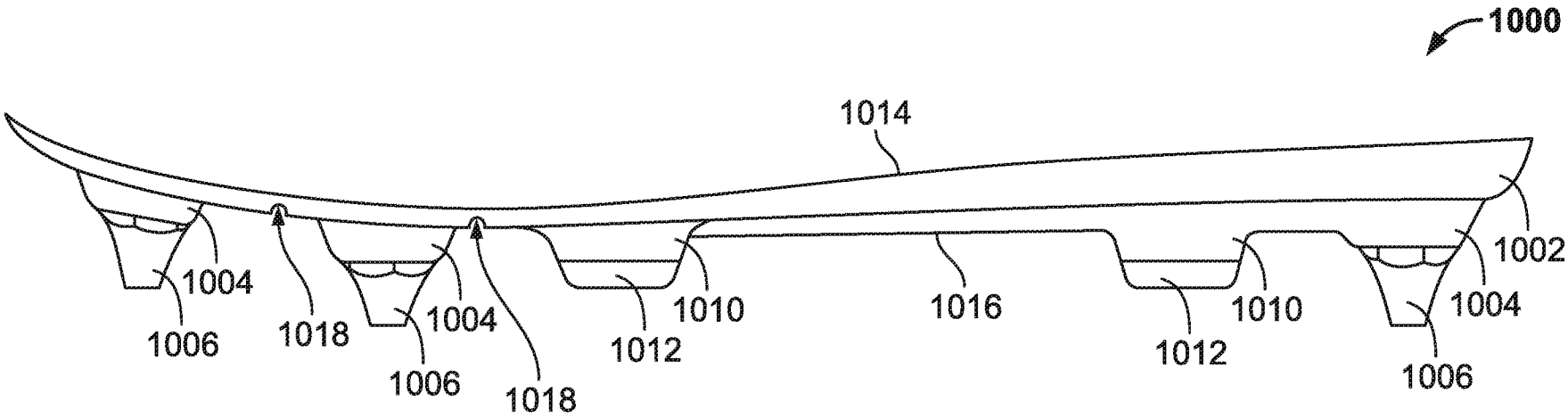
FIG. 41 is a medial side view of the sole structure of FIG. 39.
Figure 43:
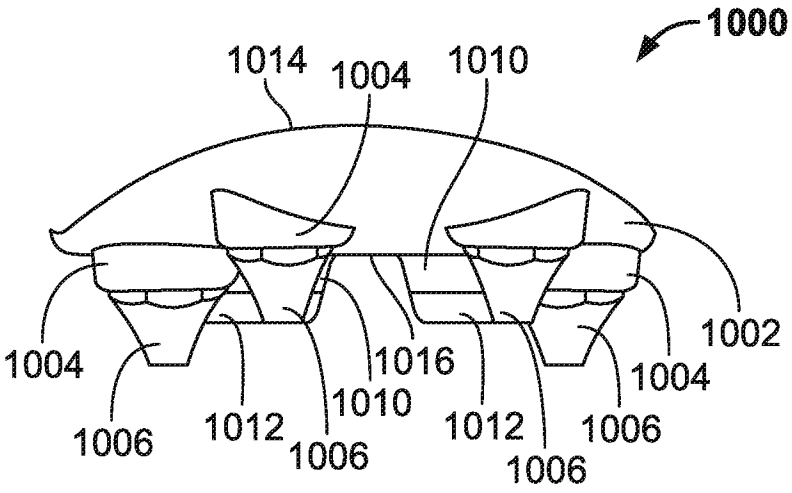
FIG. 43 is a back view of the sole structure of FIG. 39.
Figure 42:
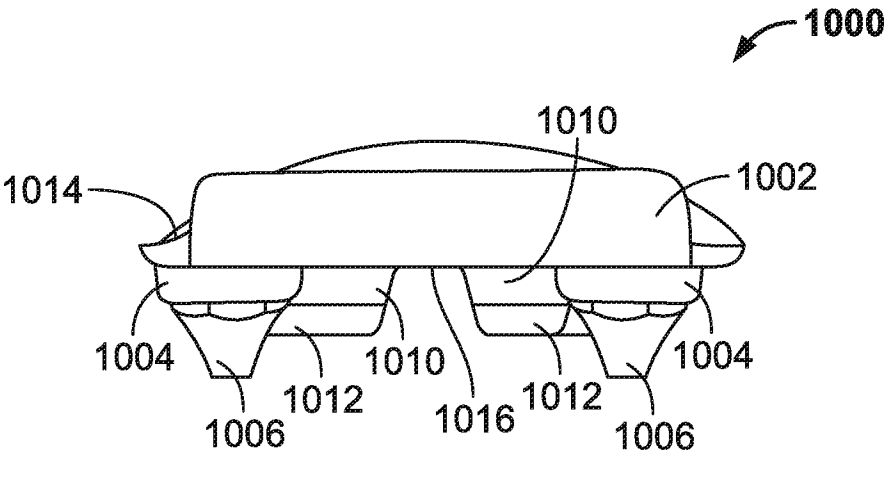
FIG. 42 is a front view of the sole structure of FIG. 39.
Figure 44:
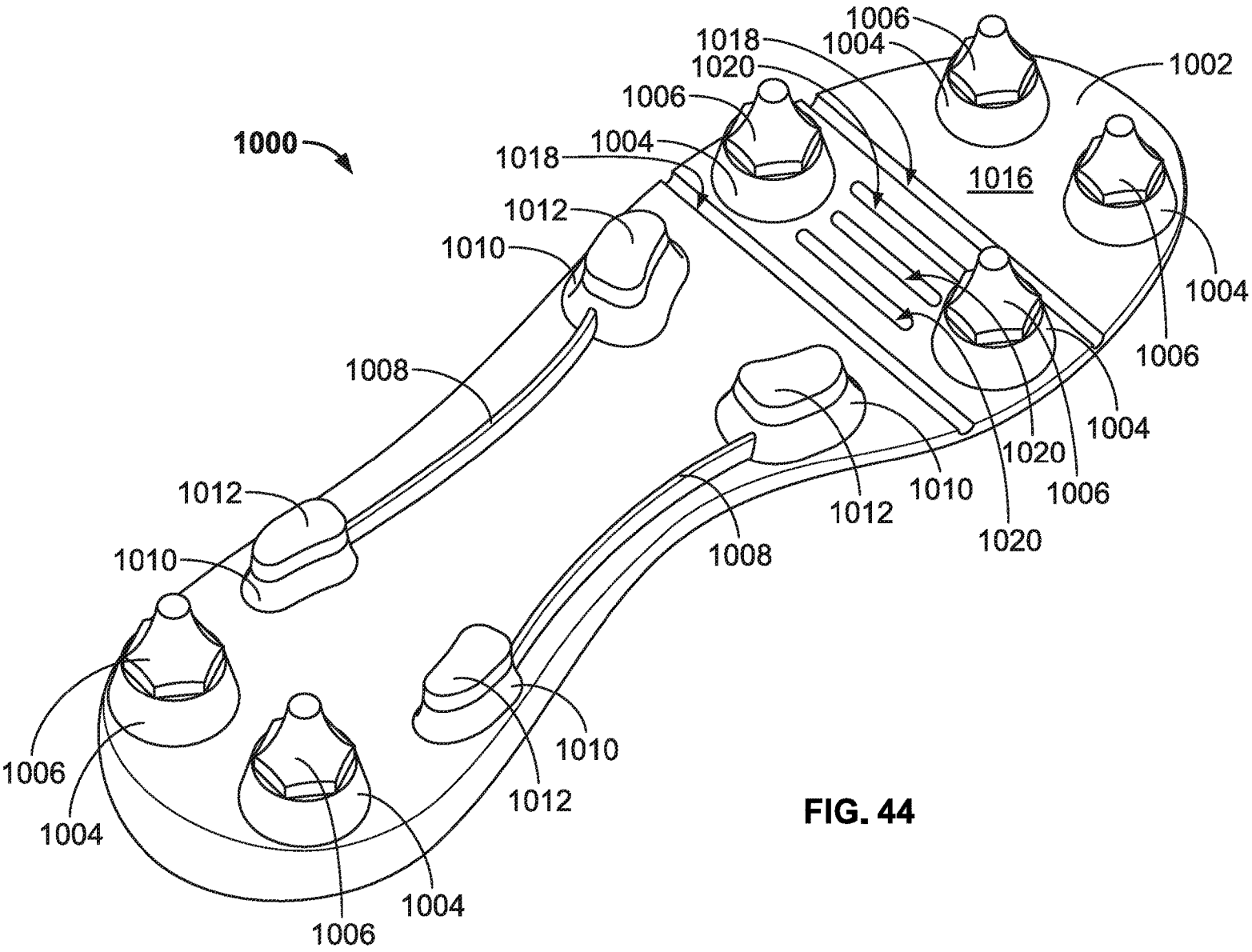
FIG. 44 is a bottom medial perspective view of the sole structure of FIG. 39.
Figure 45:
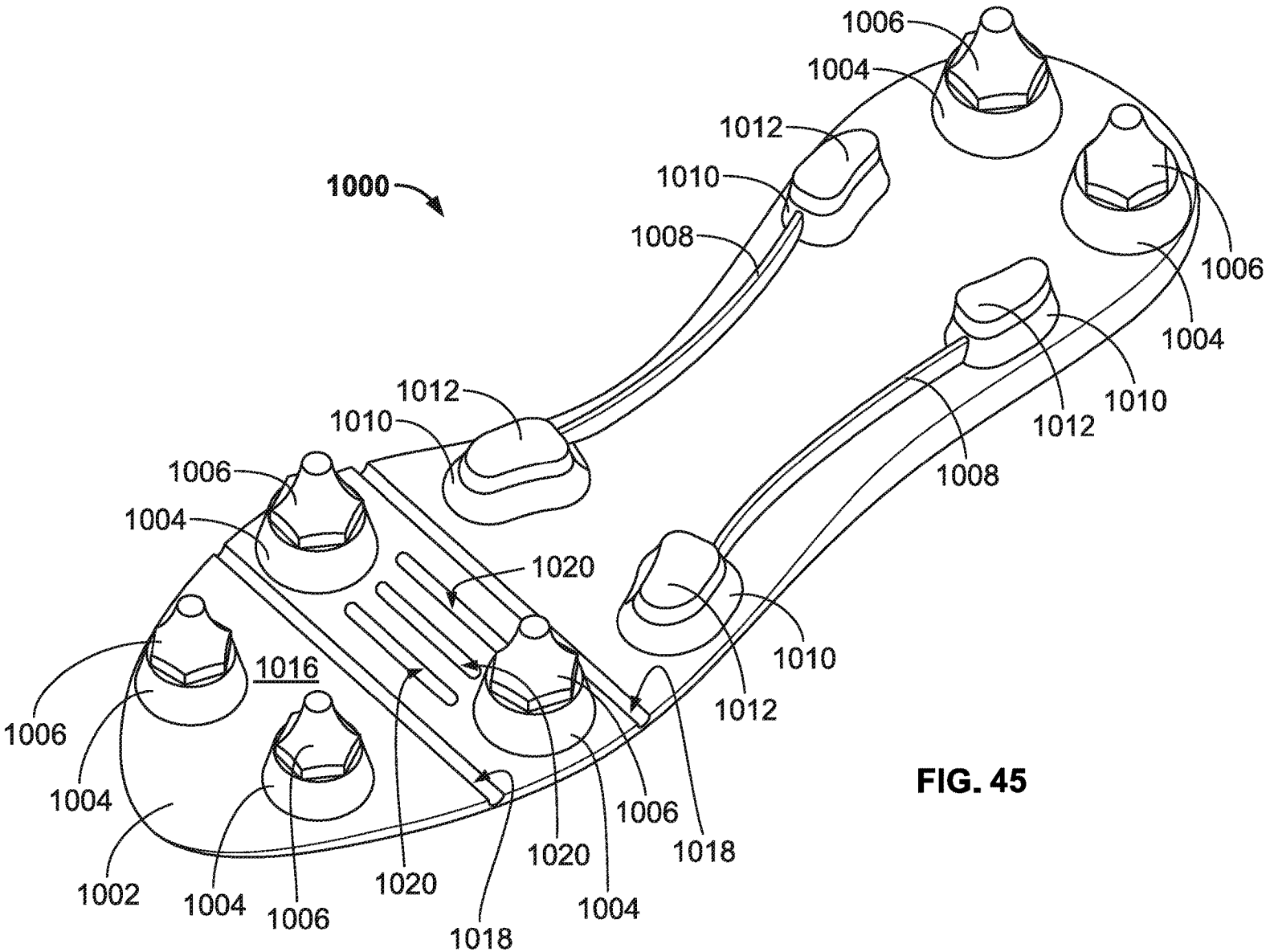
FIG. 45 is a bottom lateral perspective view of the sole structure of FIG. 39.
Figure 46:
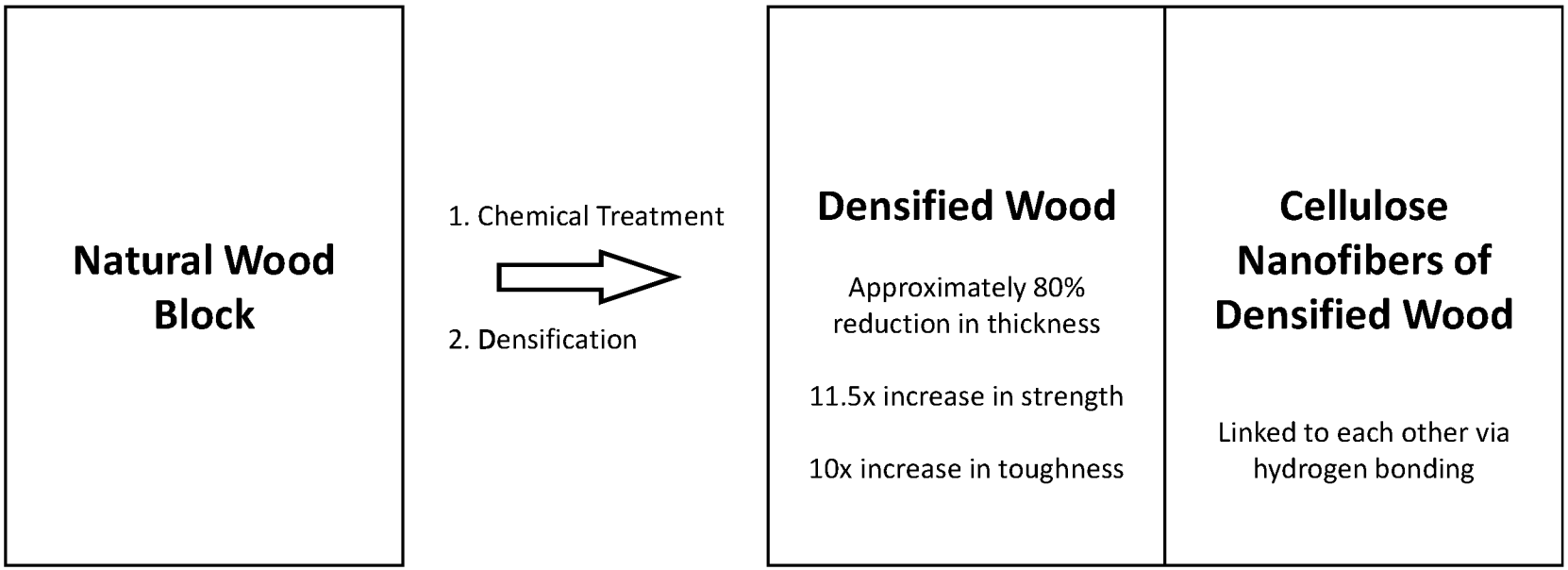
FIG. 46 shows the general schematic for one embodiment of the production of densified wood from natural wood.

During compression of the delignified wood or during VTC of natural wood, the wood may be shaped into a desired form. For example, the wood can be compressed and heated to form a curved and bent densified wood panel in the shape of plate 170 as depicted in FIG. 9. In another example, the wood can be compressed and heated to form a panel with a series of protruding portions in the shape of the sole plate 1002 as depicted in FIG. 39. A densified wood panel suitable for use in an article of footwear of the present disclosure may take any shape or configuration that is suitable for incorporation into an article of footwear as described herein. In some embodiments, the densified wood panel is shaped to include ridges, groves, ribbing, or other structures to provide support and reinforcement when incorporated into the article of footwear. The shape and configuration of the densified wood panel is not intended to be limited to those shapes and configurations shown herein.

In some embodiments, the densified wood panel is a laminate incorporating two or more layers of delignified or natural wood. In some embodiments, densified wood panel laminates are created by arranging at least two layers of delignified or natural wood and compressing the at least two layers together. In some embodiments, densified wood panel laminates are created by bonding two or more layers of densified wood after they have been compressed. In some embodiments, the densified wood panel laminates include at least two, at least three, at least four, at least five, or at least six layers.

Figures 47A, 47B, 47C:
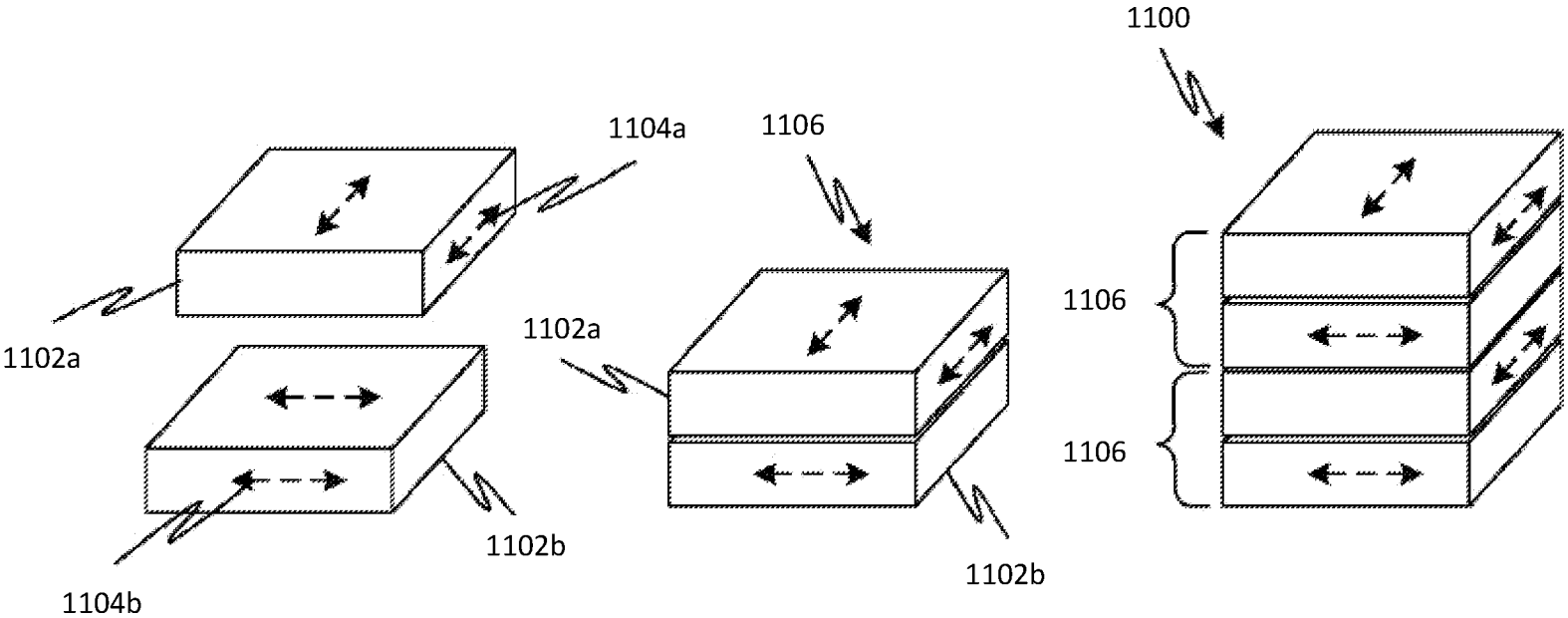
FIG. 47A shows an exploded view of a densified wood laminate.
FIG. 47B shows a perspective view of a laminate unit of densified wood.
FIG. 47C shows a perspective view of a densified wood laminate.

As shown in FIGS. 47A-47C, the layers 1102*a*, 1102*b* within the densified wood laminate 1100 may be arranged in parallel such that the cellulose microfiber lumens 1104*a*, 1104*b* are oriented perpendicular to the adjacent layer 1102*a*, 1102*b*. In FIG. 47A, a first layer 1102*a* has a cellulose microfiber lumen 1104*a* oriented in a first direction, which is perpendicular to the cellulose microfiber lumen 1104*b* in a second layer 1102*b*. The first and second layers 1102*a*, 1102*b* may be combined to from a laminate unit 1106 and the laminate units may be joined to form the densified wood laminate 1100. Alternatively, the layers within the densified wood panel laminate may be arranged such that the cellulose microfiber lumens of one layer are parallel to the cellulose microfiber lumens of the adjacent layer (not shown). In some embodiments, one or more layers of the densified wood laminate are replaced with a thermoplastic material, such as a thermoplastic polyurethane, a thermoplastic elastomer, a thermoplastic olefin, or the like, or one or more fibers, such as carbon fibers, aramid fibers, boron fibers, glass fibers, natural fibers, and polymer fibers, or a combination thereof to form a composite.

In some embodiments, the delignified wood is pretreated prior to, or is treated concurrently with, pressing or VTC processing. The treatment of the delignified wood, natural wood, or the densified wood may impart additional beneficial properties such as increased hydrophobicity, weather resistance, corrosion resistance (e.g., salt-water resistance), and flame resistance. In some embodiments, the delignified or densified wood may be pretreated or treated with a chemical to provide improved hydrophobic properties including, but not limited to, epoxy resin, silicone oil, polyurethane, paraffin emulsion, acetic anhydride, octadecyltrichloro silane (OTS), 1H, 1H, 2H, 2H-perfluorodecyltriethoxysilane, fluoroesin, polydimethylsiloxane (PDMS), methacryloxymethyltrimethyl-silane (MSi), polyhedral oligomeric silsesquioxane (POSS), potassium methyl siliconate (PMS), dodecyl(trimethoxy) silane (DTMS), hexamethyldisiloxane, dimethyl diethoxy silane, tetraethoxysilane, methyltrichlorosilane, ethyltrimethoxysilane, methyl triethoxysilane, rimethylchlorosilane, phenyltrimethoxysilane, phenyltriethoxysilane, propyltrimethoxysilane, polymethyl methacrylate, polydiallyldimethylammonium chloride (polyDADMAC), 3-(trimethoxy silyl)propyl methacrylate (MPS, hydrophobic stearic acid, amphiphilic fluorinated triblock azide copolymers, polyvinylidene fluoride and fluorinated silane, n-dodecyltrimethoxysilane, and sodium lauryl sulfate. In some embodiments, the delignified or densified wood may be pretreated or treated with a chemical to improve weatherability and corrosion resistance including, but not limited to cupramate (CDDC), ammoniacal copper quaternary (ACQ), chromated copper arsenate (CCA), ammoniacal copper zinc arsenate (ACZA), copper naphthenate, acid copper chromate, copper citrate, copper azole, copper 8-hydroxyquinolinate, pentachlorophenol, zinc naphthenate, copper naphthenate, kreosote, titanium dioxide, propiconazole, tebuconazole, cyproconazole, boric acid, borax, organic iodide (IPBC), and Na2B8O*i*3 4H2O. In some embodiments, the delignified or densified wood may be pretreated or treated with a chemical to provide a particular color, shading, or tint such as, but not limited to, a paint, a stain, or a varnish.

In some embodiments, when incorporated into an article of footwear, the densified wood panel has a thickness between about 0.5 mm and about 5 mm. In some embodiments, the thickness of the densified wood panel is between about 0.5 mm and about 3.0 mm, or between about 0.75 mm and about 3 mm, or between about 0.5 mm and about 2.0 mm, or between about 0.7 mm and about 1.0 mm. In some embodiments, the thickness of the densified wood panel is about 1 mm. The densified wood upon incorporation into the article of footwear may have a uniform or non-uniform thickness.

The densified wood panel may be incorporated into a portion of, or may form the entirety of, the upper portion (e.g., exterior surface, tongue, eyelets, strobel board, etc.) or sole portion (e.g., outsole, plate, cleat plate, midsole, etc.). The upper portion, including the exterior surface, tongue, eyelets, and strobel board, and the sole portion, including the plate, outsole, cleat plate, and midsole, and various embodiments of articles of footwear suitable for use with the densified wood panels or portions described herein are shown in FIGS. 1-45. The embodiments shown in FIGS. 1-45 are not intended to limit the scope of the disclosure and a skilled artisan will recognize that densified wood panels can be incorporated in a variety of locations on and within an article of footwear as described herein.

In addition to or as an alternative to the densified wood, the upper may comprise a knitted component, a woven textile, a non-woven textile, leather, mesh, suede, a densified wood panel or a combination of one or more of the aforementioned materials. The knitted component may be made by knitting of yarn, the woven textile by weaving of yarn, and the non-woven textile by manufacture of a unitary non-woven web. Knitted textiles include textiles formed by way of warp knitting, weft knitting, flat knitting, circular knitting, or other suitable knitting operations. The knit textile may have a plain knit structure, a mesh knit structure, or a rib knit structure, for example. Woven textiles include, but are not limited to, textiles formed by way of any of the numerous weave forms, such as plain weave, twill weave, satin weave, dobbin weave, jacquard weave, double weaves, or double cloth weaves, for example. Non-woven textiles include textiles made by air-laid or spun-laid methods, for example. The upper may comprise a variety of materials, such as a first yarn, a second yarn, or a third yarn, which may have varying properties or varying visual characteristics.

FIGS. 1-7 depict an exemplary embodiment of an article of footwear configured as a shoe 100 including an upper 102 and a sole structure 104. As will be further discussed herein, the upper 102 is attached to the sole structure 104 and together with the sole structure 104 defines an interior cavity 106 (see FIGS. 1 and 4) into which a foot of a user may be inserted. For reference, the article of footwear 100 includes a forefoot region 108, a midfoot region 110, and a heel region 112 (see FIGS. 4 and 5). The forefoot region 108 generally corresponds with portions of the article of footwear 100 that encase portions of the foot that includes the toes, the ball of the foot, and joints connecting the metatarsals with the toes or phalanges. The midfoot region 110 is proximate and adjoining the forefoot region 108, and generally corresponds with portions of the article of footwear 100 that encase the arch of the foot, along with the bridge of a foot. The heel region 112 is proximate and adjoining the midfoot region 110 and generally corresponds with portions of the article of footwear 100 that encase rear portions of the foot, including the heel or calcaneus bone, the ankle, or the Achilles tendon.

While only a single shoe 100 is depicted, i.e., a shoe that is worn on a left foot of a user, it should be appreciated that the concepts disclosed herein are applicable to a pair of shoes (not shown), which includes a left shoe and a right shoe that may be sized and shaped to receive a left foot and a right foot of a user, respectively. For ease of disclosure, however, a single shoe will be referenced to describe aspects of the disclosure, but the disclosure below with reference to the article of footwear 100 is applicable to both a left shoe and a right shoe. However, in some embodiments there may be differences between a left shoe and a right shoe other than the left/right configuration. Further, in some embodiments, a left shoe may include one or more additional elements that a right shoe does not include, or vice versa.

Still referring to FIGS. 1-7, the upper 102 is shown disposed above and coupled with the sole structure 104. The upper 102 could be formed conventionally from multiple elements, e.g., textiles, polymer foam, polymer sheets, leather, synthetic leather, or densified wood which are joined through bonding or stitching at a seam. In some embodiments, the upper 102 of the article of footwear 100 is formed from a knitted structure or knitted components. In various embodiments, a knitted component may incorporate various types of yarn that may provide different properties to an upper. For example, an upper mesh layer may be warp knit, while a mesh backing layer may comprise a circular knit. In some embodiments, the upper 102 of the article of footwear 100 comprises one or more densified wood panels.

In some embodiments, various layers of the upper 102 are heat pressed together so as to bond the various layers of the upper 102. For example, layers that comprise the upper 102 can be heat pressed together all at once and at a single temperature. The upper 102 may be further attached to a strobel board 114 (see FIG. 4) by strobel stitching (not shown). During manufacturing of the upper 102, locating pins (not shown) may be used to align with various holes (not shown) within the upper 102. In some embodiments, various layers of the upper 102 may be waterproof or semi-waterproof, and may include a plurality of layers of mesh or other materials. The materials that comprise the upper 102 may include an inner mesh layer, a thermoplastic polyurethane (TPU) film, and an outer mesh layer. In some embodiments, a TPU skin may be applied along the other surface of the upper.

In some embodiments, one or more layers of the upper 102 comprise densified wood. In some embodiments, a portion of or the entire outer surface 130 is formed from densified wood. In some embodiments, a portion of or the entire strobel board 114 is formed from densified wood.

With reference to the material, or materials, that comprise the upper 102, the specific properties that a particular type of yarn will impart to an area of a knitted component may at least partially depend upon the materials that form the various filaments and fibers of the yarn. For example, cotton may provide a soft effect, biodegradability, or a natural aesthetic to a knitted material. Elastane and stretch polyester may each provide a knitted component with a desired elasticity and recovery. Rayon may provide a high luster and moisture absorbent material, wool may provide a material with an increased moisture absorbance, nylon may be a durable material that is abrasion-resistant, and polyester may provide a hydrophobic, durable material.

Other aspects of a knitted component may also be varied to affect the properties of the knitted component and provide desired attributes. For example, a yarn forming a knitted component may include monofilament yarn or multifilament yarn, or the yarn may include filaments that are each formed of two or more different materials. In addition, a knitted component may be formed using a particular knitting process to impart an area of a knitted component with particular properties. Accordingly, both the materials forming the yarn and other aspects of the yarn may be selected to impart a variety of properties to particular areas of the upper 102.

In some embodiments, an elasticity of a knit structure may be measured based on comparing a width or length of the knit structure in a first, non-stretched state to a width or length of the knit structure in a second, stretched state after the knit structure has a force applied to the knit structure in a lateral direction.

In some embodiments, the upper 102 may include additional structural elements, or additional structural elements may surround or be coupled to the upper 102. For example, a heel cup may be provided at a heel end 116 within the heel region 112 of the shoe 100 to provide added support to a heel of a user. In some embodiments, a portion of or the entire heel cup may be formed from densified wood. In some instances, other elements, e.g., plastic material, densified wood material, logos, trademarks, etc., may also be applied and fixed to an exterior surface using glue or a thermoforming process. In some embodiments, the properties associated with an upper, e.g., a stitch type, a yarn type, or characteristics associated with different stitch types or yarn types, such as elasticity, aesthetic appearance, thickness, air permeability, or scuff-resistance, may be varied.

Still referring to FIGS. 1-7, the article of footwear 100 also includes a tightening system 118 that includes a lace 120 and a plurality of eyelets 122. In this embodiment, the lace 120 extends through the plurality of eyelets 122. In some embodiments, the eyelets are formed of densified wood. In some embodiments, the tightening system 118 may include elastic bands. The tightening system 118 may allow a user to modify dimensions of the upper 102, e.g., to tighten or loosen portions of the upper 102, around a foot as desired by the wearer. The tightening system 118 may also include a band (not shown) that runs along a center of the upper 118 and includes one or more loops through which the lace 120 may be guided. In other embodiments, the tightening system 118 may be a hook-and-loop fastening system, such as Velcro®. For example, in some embodiments, the tightening system 118 may include one or more hook-and-loop fastening straps. In further embodiments, the tightening system 118 may be another laceless fastening system known in the art. In still further embodiments, the tightening system 118 may include a different manual lacing system, a rotary closure device, or an automatic lacing system, such as the lacing systems described in U.S. patent application Ser. No. 15/780,368, filed on May 31, 2018 and U.S. patent application Ser. No. 16/392,470, filed on Apr. 23, 2019, both of which are hereby incorporated by reference in their entirety.

In some embodiments, a portion of or the entire eyelet 122 may be formed from densified wood.

Figure 2:
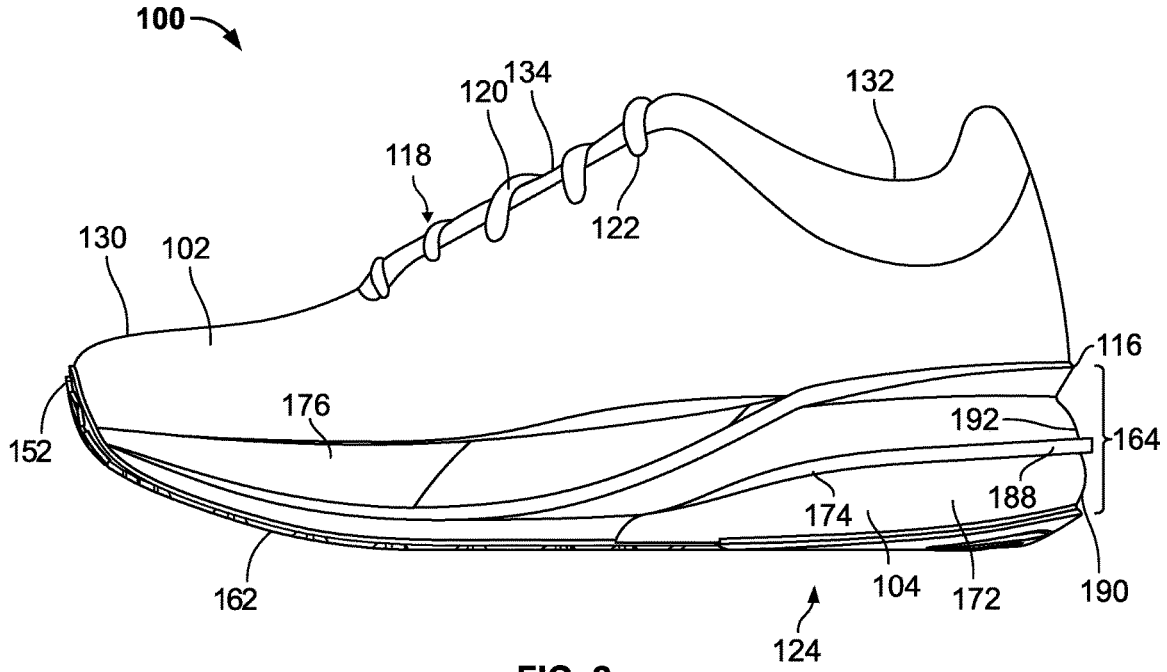
FIG. 2 is a lateral side view of the shoe of FIG. 1.
Figure 3:
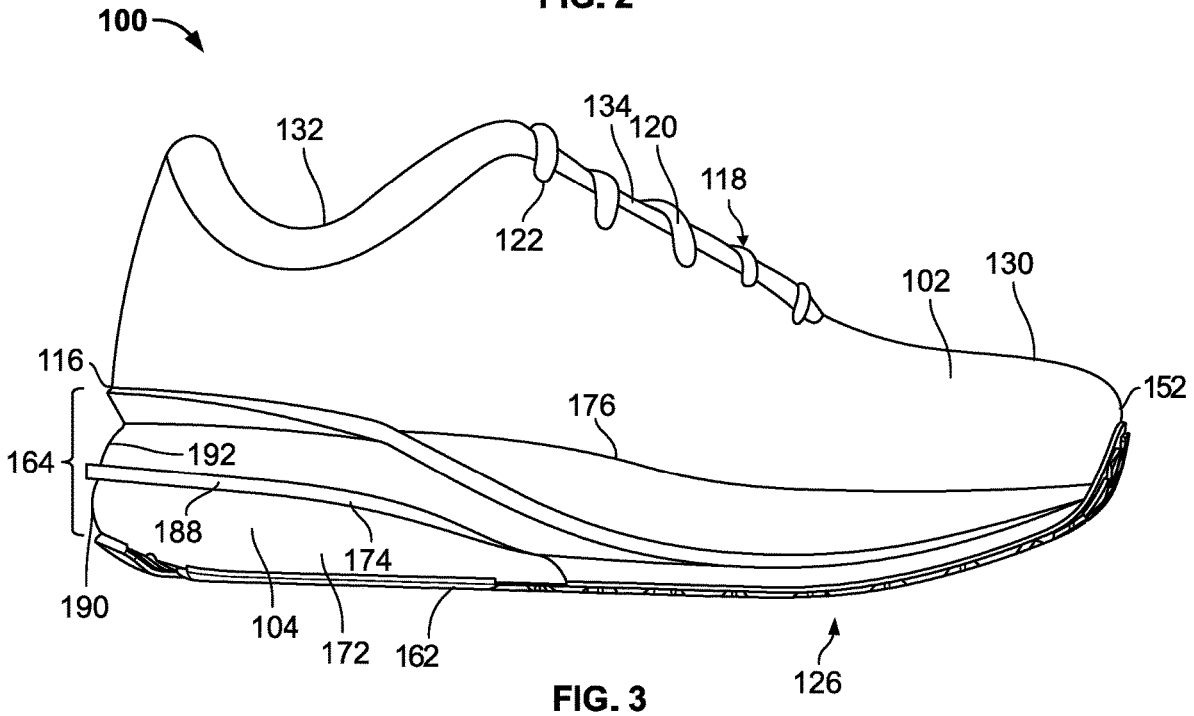
FIG. 3 is a medial side view of the shoe of FIG. 1.

Referring to FIGS. 2 and 3, the article of footwear 100 also defines a lateral side 124 and a medial side 126, the lateral side 124 being shown in FIG. 2 and the medial side 126 being shown in FIG. 3. The lace 120 extends from the lateral side 124 to the medial side 126. When a user is wearing the shoes, the lateral side 124 corresponds with an outside-facing portion of the article of footwear 100 while the medial side 126 corresponds with an inside-facing portion of the article of footwear 100. As such, a left shoe and a right shoe have opposing lateral sides and medial sides, such that the medial sides are closest to one another when a user is wearing the shoes, while the lateral sides are defined as the sides that are farthest from one another while the shoes are being worn. As will be discussed in greater detail below, the medial side 126 and the lateral side 124 adjoin one another at opposing, distal ends of the article of footwear 100.

Figure 4:
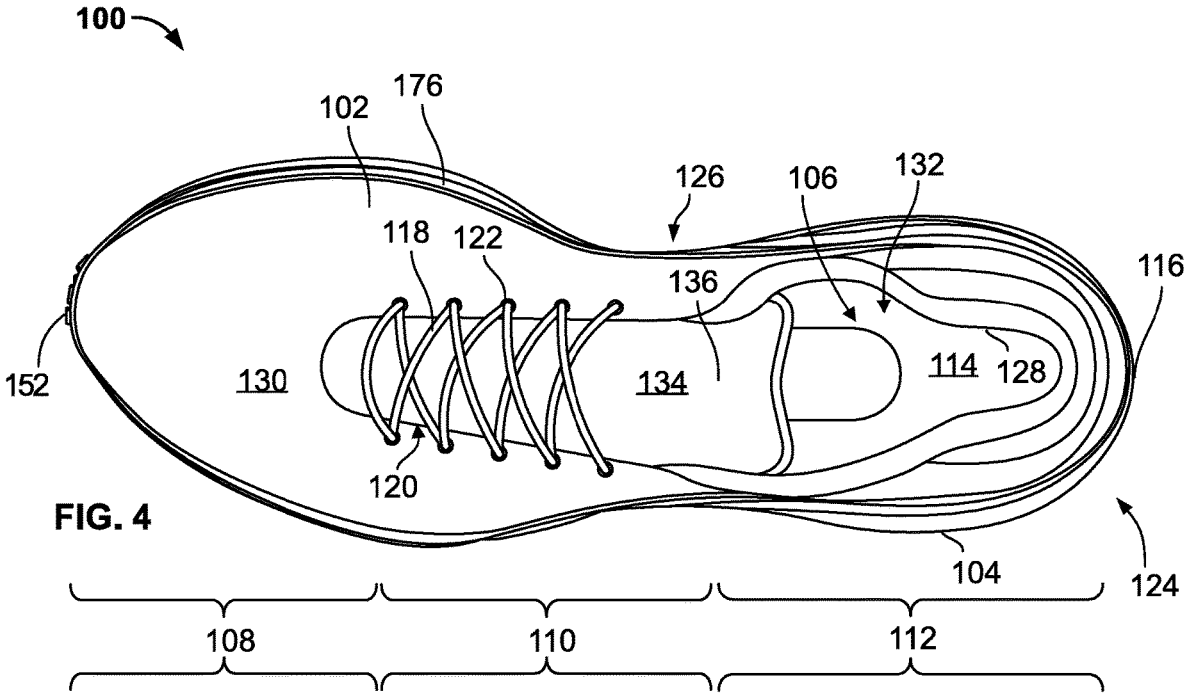
FIG. 4 is a top view of the shoe of FIG. 1.
Figure 5:
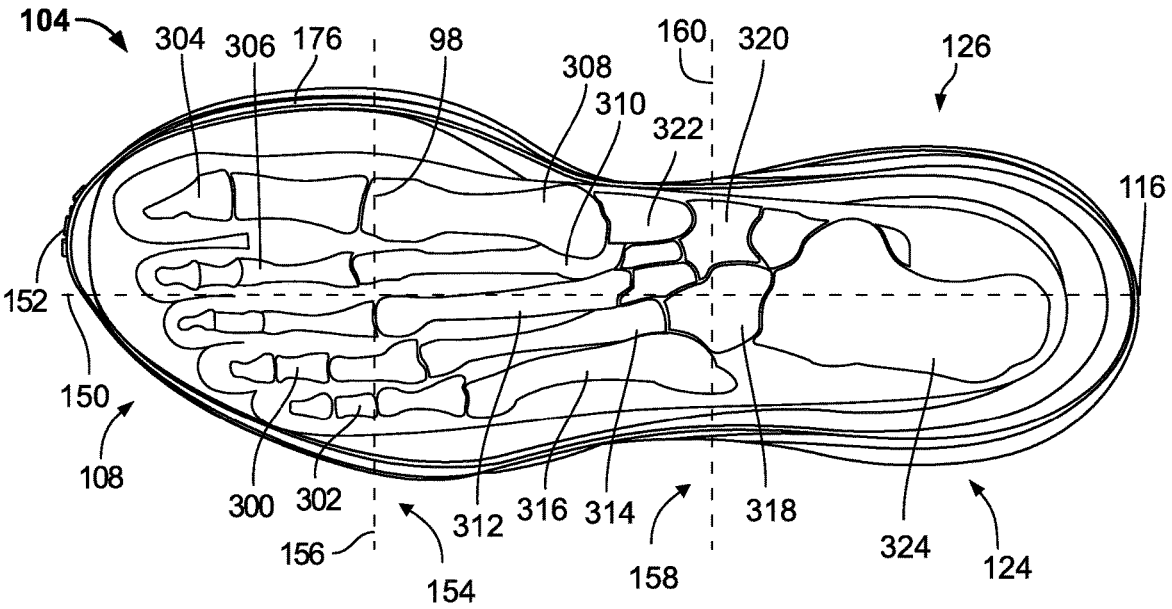
FIG. 5 is a top plan view of the shoe of FIG. 1, with the upper removed and a user's skeletal foot structure overlaid thereon.
Figure 6:
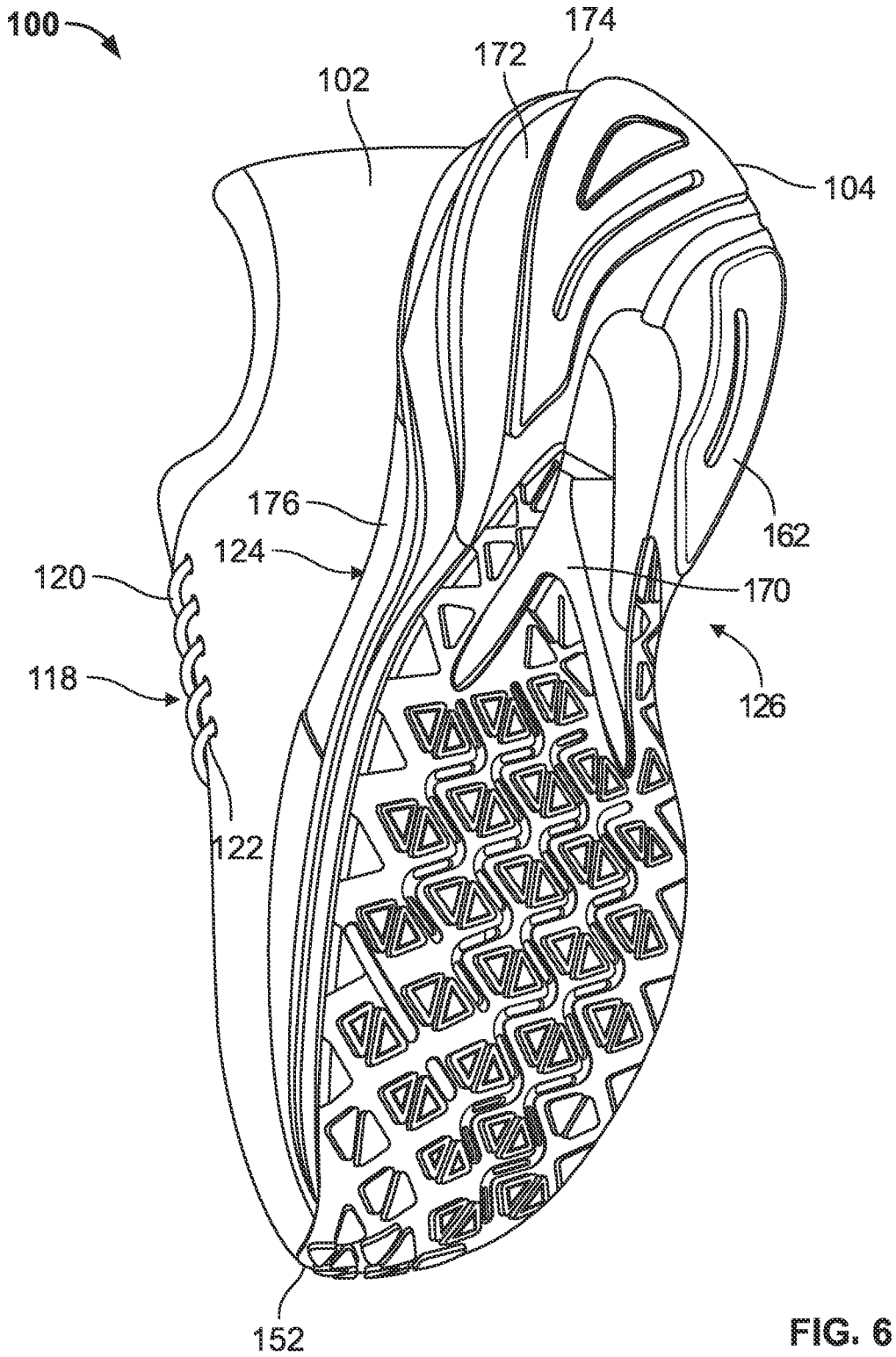
FIG. 6 is a bottom perspective view of the shoe of FIG. 1.
Figure 7:
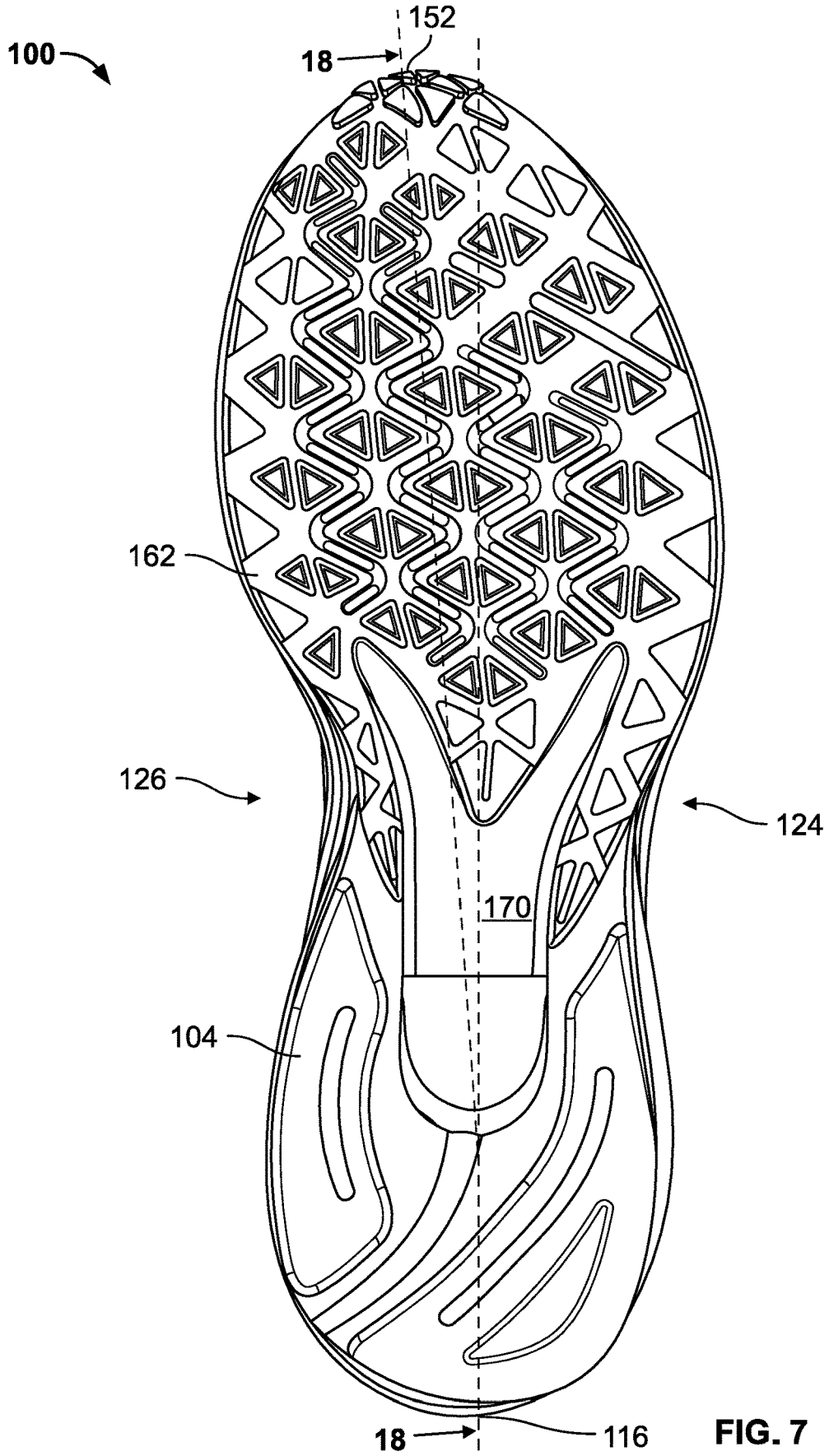
FIG. 7 is a bottom plan view of the shoe of FIG. 1.

Referring to FIGS. 4 and 5, the upper 102 extends along the lateral side 124 and the medial side 126, and across the forefoot region 108, the midfoot region 110, and the heel region 112 to house and enclose a foot of a user. When fully assembled, the upper 102 also includes an interior surface 128 and an exterior surface 130. The interior surface 126 faces inward and generally defines the interior cavity 106, and the exterior surface 130 of the upper 102 faces outward and generally defines an outer perimeter or boundary of the upper 102. The interior surface 128 and the exterior surface 130 may comprise portions of the upper layers disclosed above. The upper 102 also includes an opening 132 that is at least partially located in the heel region 112 of the article of footwear 100, that provides access to the interior cavity 106 (see, e.g., FIG. 4) and through which a foot may be inserted and removed. In some embodiments, the upper 102 may also include an instep area 134 that extends from the opening 132 in the heel region 112 over an area corresponding to an instep of a foot to an area adjacent the forefoot region 108. The instep area 134 may comprise an area similar to where a tongue 136 of the present embodiment is disposed. In some embodiments, the upper 102 does not include the tongue 136, i.e., the upper 102 is tongueless. In some embodiments, a portion of or the entire tongue 136 is formed from densified wood.

Referring in particular to FIG. 5, the medial side 126 and the lateral side 124 adjoin one another along a longitudinal central plane or axis 150 of the article of footwear 100. As will be further discussed herein, the longitudinal central plane or axis 150 may demarcate a central, intermediate axis between the medial side 126 and the lateral side 128 of the article of footwear 100. Put differently, the longitudinal plane or axis 150 may extend between the heel end 116 of the article of footwear 100 and a toe end 152 of the article of footwear 100 and may continuously define a middle of an insole, the sole structure 104, or the upper 102 of the article of footwear 100, i.e., the longitudinal plane or axis 150 may be a straight axis extending through the heel end 116 of the heel region 112 to the toe end 152 of the forefoot region 108.

The forefoot region 108, the midfoot region 110, the heel region 112, the medial side 126, and the lateral side 124 are intended to define boundaries or areas of the article of footwear 100. To that end, the forefoot region 108, the midfoot region 110, the heel region 112, the medial side 126, and the lateral side 124 generally characterize sections of the article of footwear 100. Certain aspects of the disclosure may refer to portions or elements that are coextensive with one or more of the forefoot region 108, the midfoot region 110, the heel region 112, the medial side 126, or the lateral side 124. Further, both the upper 102 and the sole structure 104 may be characterized as having portions within the forefoot region 108, the midfoot region 110, the heel region 112, or along the medial side 126 or the lateral side 124. Therefore, the upper 102 and the sole structure 104, or individual portions of the upper 102 and the sole structure 104, may include portions thereof that are disposed within the forefoot region 108, the midfoot region 110, the heel region 112, or along the medial side 126 or the lateral side 124.

Still referring to FIG. 5, the forefoot region 108, the midfoot region 110, the heel region 112, the medial side 126, and the lateral side 124 are shown in detail. The forefoot region 108 extends from the toe end 152 to a widest portion 154 of the article of footwear 100. The widest portion 154 is defined or measured along a first line 156 that is perpendicular with respect to the longitudinal axis 150 that extends from a distal portion of the toe end 152 to a distal portion of a heel end 116, which is opposite the toe end 152. The midfoot region 110 extends from the widest portion 154 to a thinnest portion 158 of the article of footwear 100. The thinnest portion 158 of the article of footwear 100 is defined as the thinnest portion of the article of footwear 100 measured along a second line 160 that is perpendicular with respect to the longitudinal axis 150. The heel region 112 extends from the thinnest portion 160 to the heel end 116 of the article of footwear 100.

It should be understood that numerous modifications may be apparent to those skilled in the art in view of the foregoing description, and individual components thereof, may be incorporated into numerous articles of footwear. Accordingly, aspects of the article of footwear 100 and components thereof, may be described with reference to general areas or portions of the article of footwear 100, with an understanding the boundaries of the forefoot region 108, the midfoot region 110, the heel region 112, the medial side 126, or the lateral side 124 as described herein may vary between articles of footwear. However, aspects of the article of footwear 100 and individual components thereof, may also be described with reference to exact areas or portions of the article of footwear 100 and the scope of the appended claims herein may incorporate the limitations associated with these boundaries of the forefoot region 108, the midfoot region 110, the heel region 112, the medial side 126, or the lateral side 124 discussed herein.

Still referring to FIG. 5, the medial side 126 begins at the distal toe end 152 and bows outward along the forefoot region 108 toward the midfoot region 110. At the first line 156, the medial side 126 bows inward, toward the central, longitudinal axis 150. The medial side 126 extends from the first line 156, i.e., the widest portion 154, toward the second line 160, i.e., the thinnest portion 158, entering into the midfoot region 110 upon crossing the first line 156. After reaching the second line 160, the medial side 126 bows outward, away from the longitudinal, central axis 150, at which point the medial side 126 extends into the heel region 112, i.e., upon crossing the second line 160. The medial side 126 then bows outward and then inward toward the heel end 116, and terminates at a point where the medial side 126 meets the longitudinal, center axis 150.

Still referring to FIG. 5, the lateral side 124 also begins at the distal toe end 152 and bows outward along the forefoot region 108 toward the midfoot region 110. The lateral side 124 reaches the first line 156, at which point the lateral side 124 bows inward, toward the longitudinal, central axis 150. The lateral side 124 extends from the first line 156, i.e., the widest portion 154, toward the second line 160, i.e., the thinnest portion 158, entering into the midfoot region 110 upon crossing the first line 156. After reaching the second line 160, the lateral side 124 bows outward, away from the longitudinal, central axis 150, at which point the lateral side 124 extends into the heel region 112, i.e., upon crossing the second line 160. The lateral side 124 then bows outward and then inward toward the heel end 116, and terminates at a point where the lateral side 124 meets the longitudinal, center axis 150.

Referring again to FIGS. 2 and 3, the sole structure 104 includes an outsole or outsole region 162, a midsole or midsole region 164, and an insole or insole region (not shown). In some embodiments, the sole structure 104 includes an insole, however, in the depicted embodiments, the insole is a separate element that is inserted into the foot cavity atop of the strobel board 114. The outsole 162, the midsole 164, and the insole, or any components thereof, may include portions within the forefoot region 108, the midfoot region 110, or the heel region 112. Further, the outsole 162, the midsole 164, and the insole, or any components thereof, may include portions on the lateral side 124 or the medial side 126. The outsole 162, the midsole 164, and any other portions of the sole structure 104 may be attached to one another via an adhesive (not shown). The upper 102 is further attached to the sole structure via adhesive or stitching.

In some embodiments, the article of footwear 100 includes an insole comprising densified wood. A portion of or the entire insole may be made from densified wood. In some embodiments, the densified wood of the insole incorporates aluminum and has anti-microbial or anti-odor properties.

In some instances, the outsole 162 may be defined as a portion of the sole structure 104 that at least partially contacts an exterior surface, e.g., the ground, when the article of footwear 100 is worn. The insole may be defined as a portion of the sole structure 104 that at least partially contacts a user's foot when the article of footwear is worn. Finally, the midsole 164 may be defined as at least a portion of the sole structure 104 that extends from the outsole toward the upper 102 or that otherwise extends between and connects the outsole 162 with the insole region.

Figure 8:
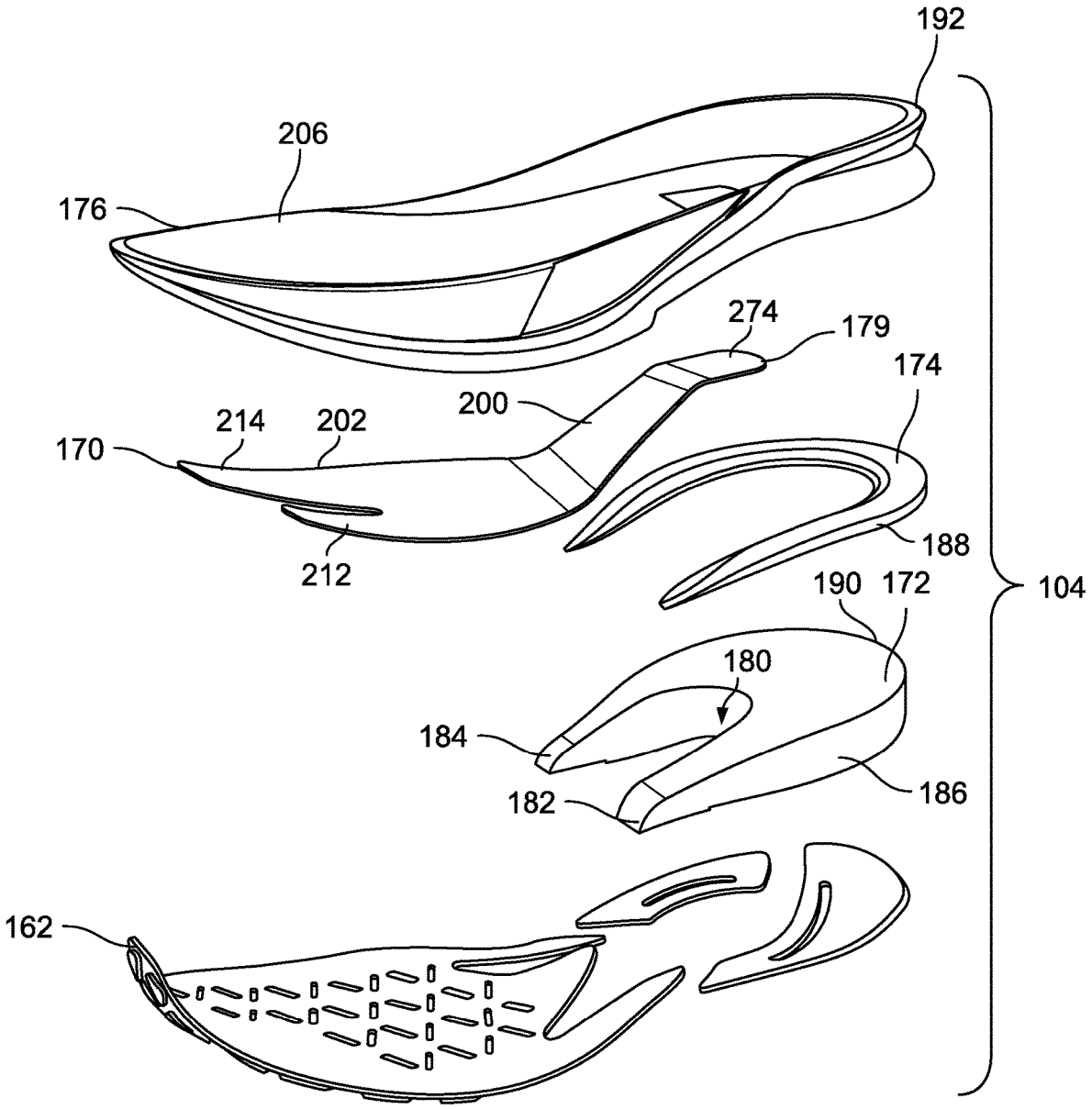
FIG. 8 is an exploded view of the sole structure of FIG. 1, wherein the sole structure includes an outsole, a midsole body, a plate, a heel support, and a heel support collar.

With particular reference to FIG. 8, which is an exploded view of the sole structure 104 of the article of footwear 100, the sole structure 104 may include the outsole 162, a plate 170, a heel cushioning member 172, a heel support collar 174, and a midsole cushioning member 176. In this embodiment, the midsole cushioning member 176 includes an aperture 178 (see FIGS. 14 and 15), through which a rear segment 179 of the plate 170 (see FIGS. 9-13) may be inserted, as will be further discussed herein. Although the outsole 162, the plate 170, the heel cushioning member 172, the heel collar 174, and the midsole cushioning member 176 are separate components in the present embodiment, these components or portions thereof may be integral with other components in alternative embodiments. For example, in some embodiments, the heel cushioning member 172 and the heel support collar 174 may be integral or a single piece.

Figure 18:
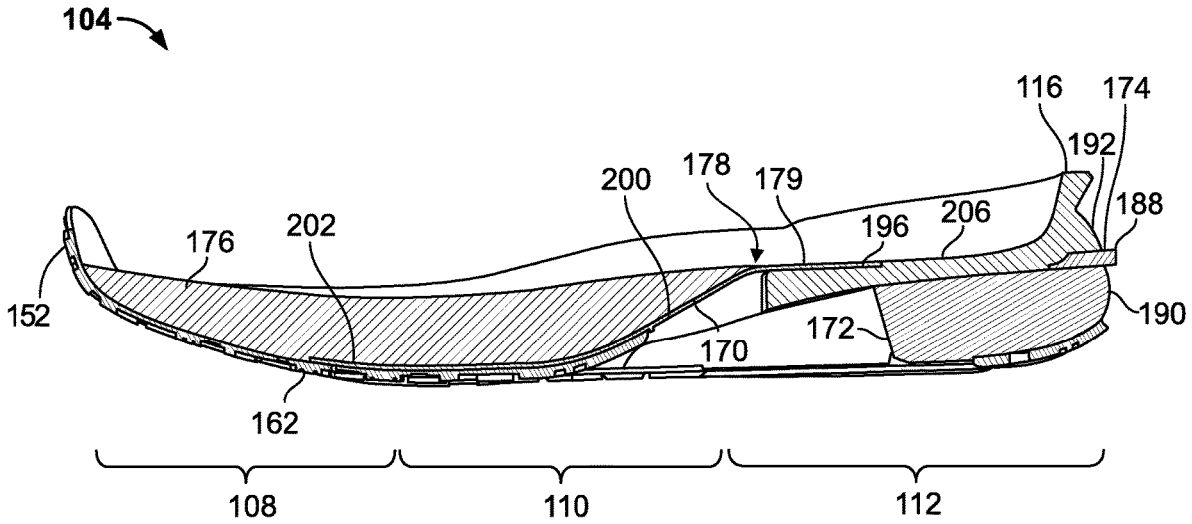
FIG. 18 is a cross-sectional view of the sole structure of FIG. 7 taken along line 18-18 thereof.

As shown in FIG. 8 and FIG. 18, which is a cross-sectional view of the sole structure 104, the outsole 162 may define a bottom end or surface of the sole structure 104 across the heel region 112, the midsole region 110, and the forefoot region 108. Further, as previously discussed herein, the outsole 162 may be a ground-engaging portion of the sole structure 104 and may be opposite from the insole thereof. The outsole 162 may be formed from one or more materials to impart durability, wear-resistance, abrasion resistance, or traction to the sole structure 104. In some embodiments, the outsole 162 may be formed from rubber, for example.

In this embodiment, the sole structure 104 may also include the heel cushioning member 172, which may be positioned adjacent to and on top of the outsole 162 in the heel region 112 and partially in the midfoot region 110. Put differently, the heel cushioning member 172 may be adjacent to the outsole 162, and may extend from the heel end 116 of the sole structure 104, through the heel region 112, and partially through the midfoot region 110. The heel cushioning member 172 may also include a cut-out portion 180 defined by a lateral prong 182 and a medial prong 184. The heel cushioning member 172 may be constructed from Ethylene-vinyl acetate (EVA), copolymers thereof, or a similar type of material. For example, in some embodiments, the heel cushioning member 172 may be an EVA-Solid-Sponge ("ESS") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. The heel cushioning member 172 may be a single polymeric material or may be a blend of materials, such as an EVA copolymer, a thermoplastic polyurethane, a polyether block amide (PEBA) copolymer, and/or an olefin block copolymer.

In embodiments where the heel cushioning member 172 is formed from a supercritical foaming process, the supercritical foam may comprise micropore foams or particle foams, such as a TPU, EVA, PEBAX®, or mixtures thereof, manufactured using a process that is performed within an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. During an exemplary process, a solution of supercritical fluid and molten material is pumped into a pressurized container, after which the pressure within the container is released, such that the molecules of the supercritical fluid rapidly convert to gas to form small pockets within the material and cause the material to expand into a foam, which may be used as the heel cushioning member 172. In further embodiments, the heel cushioning member 172 may be formed using alternative methods known in the art, including the use of an expansion press, an injection machine, a pellet expansion process, a cold foaming process, a compression molding technique, die cutting, or any combination thereof. For example, the heel cushioning member 172 may be formed using a process that involves an initial foaming step in which supercritical gas is used to foam a material and then compression molded or die cut to a particular shape. In particular embodiments, however, the heel cushioning member 172 is provided to reduce stress or increase the strength of portions, e.g., the heel region 112, of the sole structure 104. As such, in these embodiments, the heel cushioning member 172 has a stiffness (e.g., tensile strength or flexural strength) greater than the midsole cushioning member 176.

The heel cushioning member 172 may include a density within the range between about 0.05 grams per cubic centimeter ($g/cm^3$) and about 0.30 $g/cm^3$, or between about 0.10 $g/cm^3$ and about 0.20 $g/cm^3$. In further embodiments, the heel cushioning member 172 may have a hardness between about ten (10) Shore A to about fifty (50) Shore A. In even further embodiments, the heel cushioning member 172 may be a bladder encasing a plurality of beads, such as a plurality of spherical or ellipsoidal beads or pellets formed from thermoplastic polyurethane, a thermoplastic elastomer, or a supercritical foam. Further, the beads or pellets may be uniformly shaped, non-uniformly shaped, or be a combination of uniform and non-uniform shapes, e.g., a plurality of spherical and ellipsoidal beads or pellets. Still further, it is contemplated that the beads or pellets may take on any geometric shape. For example, the heel cushioning member 172 may define an interior void (not shown) that receives a pressurized fluid or a plurality of ellipsoidal or spherical beads, such as the hollow space filled with a number of plastic bodies described in PCT Publication No. WO 2017/097315, filed on Dec. 7, 2015, which is hereby incorporated by reference in its entirety.

With continued reference to FIGS. 8 and 18, the heel support collar 174 may be adjacent to and positioned on top of the heel cushioning member 172, and adjacent to and positioned below the midsole cushioning member 176. In particular embodiments, the heel support collar 174 may have a shape that mimics an outer peripheral wall 186 of the heel cushioning member 172. For example, in this particular embodiment, the heel support collar 174 mimics the outer peripheral wall 186 of the heel cushioning member 172 and is generally U-shaped or horseshoe shaped. Further, as best shown in FIG. 18, an exterior edge 188 of the heel support collar 174 may extend rearward a distance beyond a rearward end 190 of the heel cushioning member 172 and a rearward end 192 of the midsole cushioning member 176. The heel support collar 174 may be formed from a thermoplastic material, such as a thermoplastic polyurethane, a thermoplastic elastomer, a thermoplastic olefin, or the like. Further, in particular embodiments, the heel support collar 174 may have a hardness between about ten (10) Shore A to about ninety (90) Shore A. In some embodiments, the heel support collar 174 may have a hardness or stiffness value greater than a hardness or stiffness value of the heel cushioning member 176.

The sole structure 104 also typically includes a midsole cushioning member 176, which may be adjacent to and on top of the outsole 162 in the forefoot region 108, and adjacent to and on top of the heel cushioning member 172 in the heel region 112 of the article of footwear 100. The sole structure 104 may also include recessed portions 194, 196 (see FIGS. 15 and 16) that communicate with, embed, or encapsulate at least a portion of the plate 170 and the heel cushioning member 172, as will be further discussed herein. Even further, as will be further discussed herein, the midsole cushioning member 176 may include an aperture 178 through which a portion of the plate 170 may extend, such that a portion of the plate 170, e.g., a rear segment 179 thereof, is vertically above the midsole cushioning member 176 in the heel region 112 (see FIG. 18) and a portion of the plate 170, e.g., an arched segment 200 and/or toe segment 202 thereof (see FIGS. 10 and 12), is vertically below the midsole cushioning member 176 in the midfoot region 110 and/or the forefoot region 108 of the article of footwear 100 (see FIG. 18). In this embodiment, the midsole cushioning member 176 may also include a recessed portion 196 (see FIG. 14) in the heel region 112 that cooperates with and defines the shape and size of the rear segment 179 of the plate 170. For example, in this particular embodiment, a top surface 206, which may be strobel board 114, may include the recessed portion 196.

Figure 14:
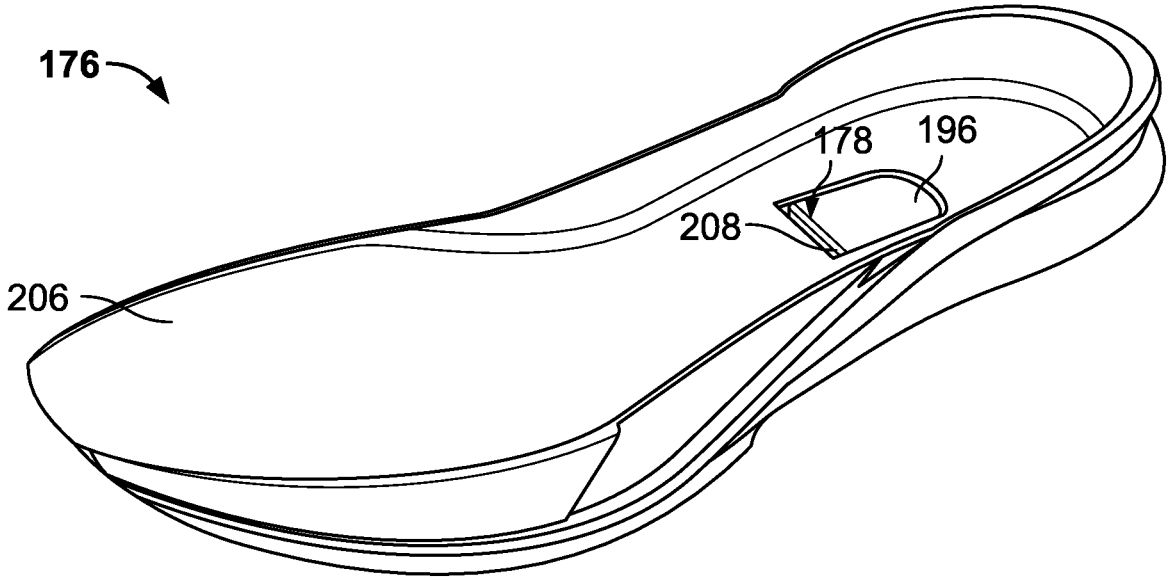
FIG. 14 is a perspective view of the midsole body of FIG. 8.
Figure 15:
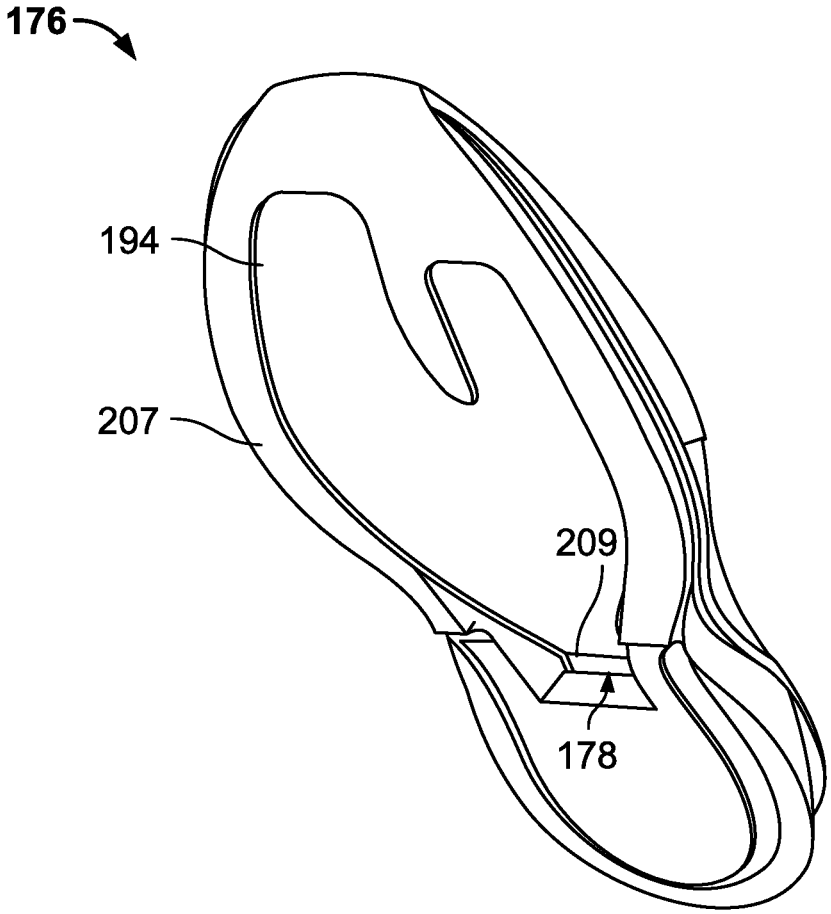
FIG. 15 is a bottom perspective view of the midsole body of FIG. 8.
Figure 16:
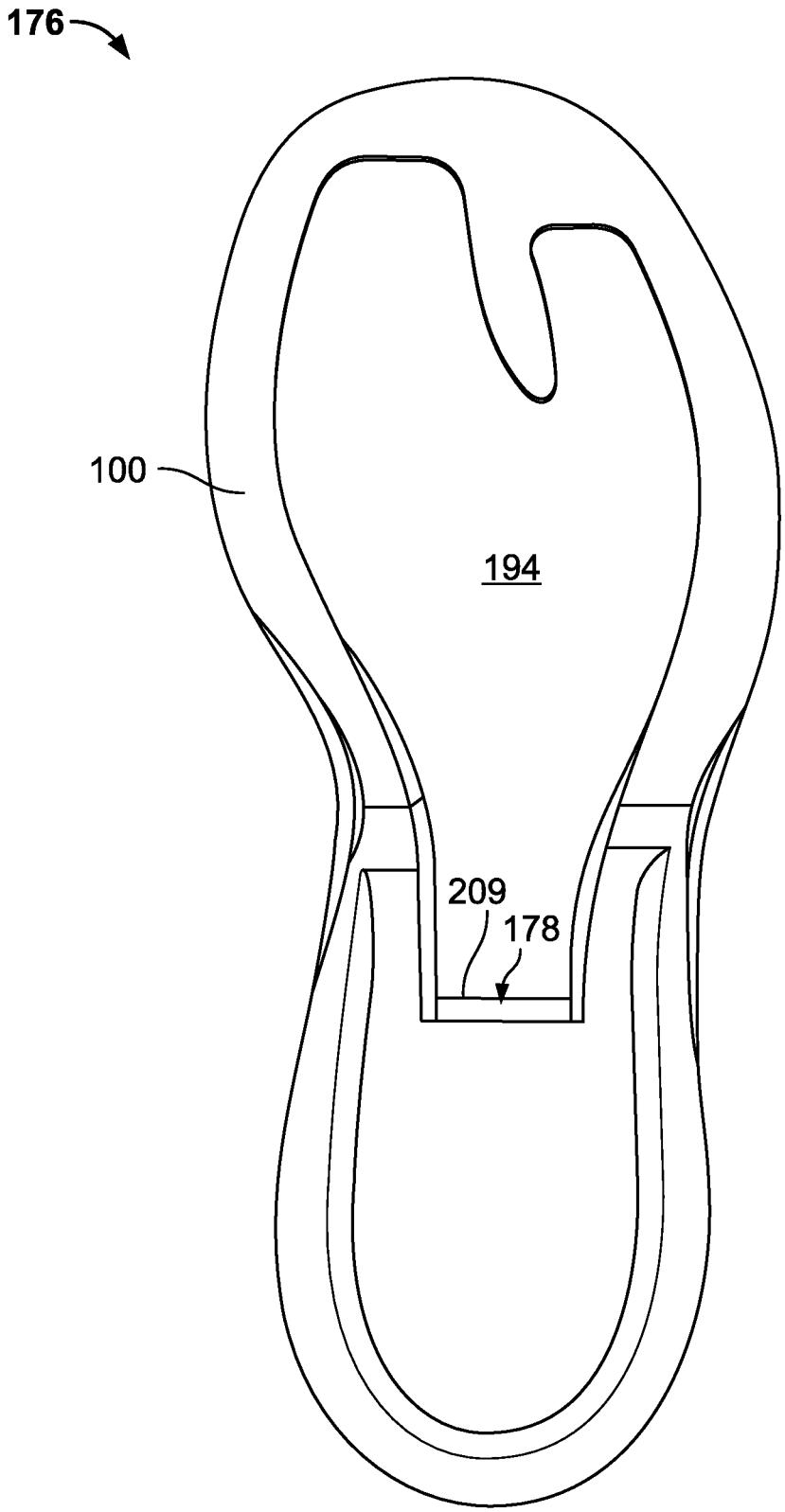
FIG. 16 is a bottom view of the midsole body of FIG. 8.
Figure 17:
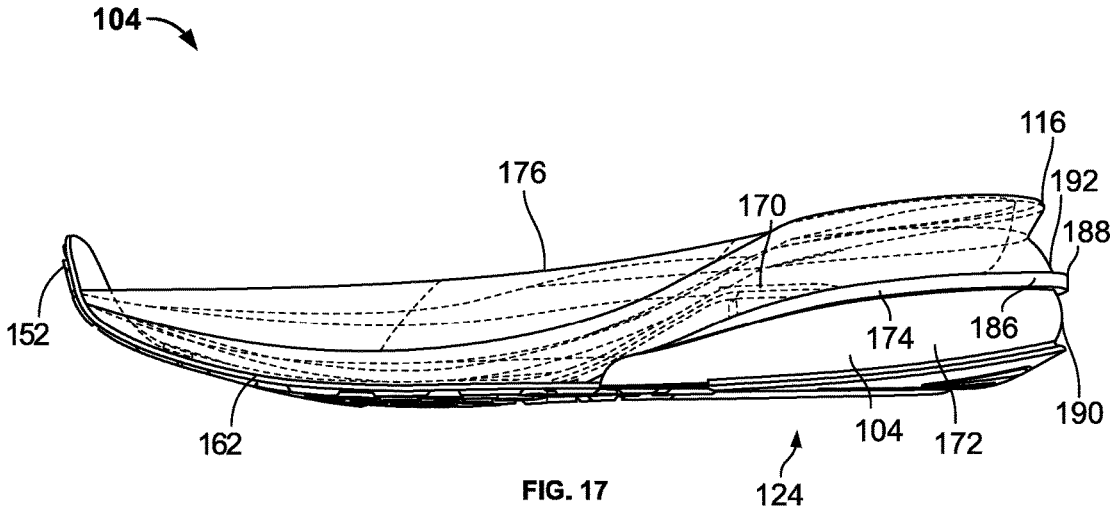
FIG. 17 is a lateral side view of the midsole body of FIG. 8, with internal structure thereof show in broken lines.

With reference to FIGS. 14-16, the midsole cushioning member 176 may include a top surface 206, which may be the strobel board 114, with a recessed portion 196 within the heel region 112 that mimics the rear segment 179 of the plate 170. The midsole cushioning member 176 may further include a bottom surface 207 having the recessed portion 194 within the forefoot region 108 and the midfoot region 110 of the article of footwear 100 that mimics the toe segment 202 and the arched segment 200 of the plate 170. Further, an aperture 178 is proximate to a front end 208 of the recessed portion 196, i.e., an end of the recessed portion 196 closest to the toe end 152 of the article of footwear 100, and proximate to a rear end 209 of the recessed portion 194, i.e., an end of the recessed portion 194 closest to the heel end 116 of the article of footwear 100.

In some embodiments, a sidewall may partially surround a portion of a perimeter of the midsole cushioning member 176 to define a cavity that helps support and retain a foot. For example, in this particular embodiment, the midsole cushioning member 176 may include the sidewall that forms a rim around the heel region 112 and at least a portion of the midfoot region 110 of the article of footwear 100, which acts to cradle and support a foot during use of the article of footwear 100.

The midsole cushioning member 176 may be constructed from EVA, copolymers thereof, or a similar type of material. For example, in some embodiments, the midsole cushioning member 176 may be an ESS material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. Similar to the heel cushioning member 172, the midsole cushioning member 176 may be a single polymeric material or may be a blend of materials, such as an EVA copolymer, a thermoplastic polyurethane, a polyester block amide (PEBA) copolymer, and/or an olefin block copolymer. Further, the midsole cushioning member 176 may also be formed from a supercritical foaming process that uses a supercritical gas, e.g., $CO_2$, $N_2$, or mixtures thereof, to foam a material, e.g., EVA, TPU, TPE, or mixtures thereof. In such embodiments, the midsole cushioning member 176 may be manufactured using a process that is performed in an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. For example, in an exemplary process, a solution of supercritical fluid is mixed with a molten material. This mixture is pumped or injected into a pressurized container, after which the pressure within the container is released, such that the molecules of the supercritical fluid rapidly convert to gas to form small pockets within the material and cause the material to expand into a foam, which may be used as the midsole cushioning member 176. In further embodiments, the midsole cushioning member 176 may be formed using alternative methods known in the art, including the use of an expansion press, an injection machine, a pellet expansion process, a cold foaming process, a compression molding technique, die cutting, or any combination thereof. In particular embodiments, the midsole cushioning member 176 may be formed using a process that involves an initial foaming step, during which supercritical gas is used to foam a material, and a second step, during which the foamed material is compression molded or die cut to a particular shape. For example, the midsole cushioning member 176 may be formed using a process that involves an initial foaming process that uses a supercritical fluid to foam a material, and then a second step that compression molds the foamed material to form the recessed surfaces 194, 196 on a top surface 206 and a bottom surface 207, respectively, of the midsole cushioning member 176.

In particular embodiments, the midsole cushioning member 176 is provided to deliver ample cushioning to the sole structure 104. The midsole cushioning member 176 may have a density within the range between about 0.05 g/cm$^3$ and about 0.20 g/cm$^3$, or between about 0.10 g/cm$^3$ and about 0.20 g/cm$^3$. In further embodiments, the midsole cushioning member 176 may have a hardness between about ten (10) Shore A to about fifty (50) Shore A. In even further embodiments, the midsole cushioning member 176 may be a bladder encasing a plurality of beads, such as a plurality of spherical or ellipsoidal beads or pellets formed from thermoplastic polyurethane, a thermoplastic elastomer, or a supercritical foam. For example, the midsole cushioning member 176 may define an interior void (not shown) that receives a pressurized fluid or a plurality of beads, such as the hollow space filled with a number of plastic bodies described in PCT Publication No. WO 2017/097315, filed on Dec. 7, 2015, and noted above.

Referring back to FIGS. 8 and 18, the sole structure 104 may also include the plate 170, or a plurality of plates, positioned therein. In particular embodiments, the plate 170 may be adjacent to and positioned between the outsole 162 and the midsole cushioning member 176 in the forefoot region 108 of the article of footwear 100, such that the plate 170 is vertically below the midsole cushioning member 176 in the forefoot region 108 and/or vertically below the midsole cushioning member 176 in the midfoot region 110 of the article of footwear 100. Further, as previously noted, the midsole cushioning member 176 includes a recessed portion 194 into which the plate 170 may fit or be seated, such that the midsole cushioning member 176 at least partially encases the plate 170. The plate 170 also extends through the aperture 178 and, more particularly, the rear segment 179 of the plate 170 extends through the aperture 178. As such, in this embodiment, at least a portion of the rear segment 179 is positioned above the midsole cushioning member 176. Further, the recessed portion 196 of the midsole cushioning member 176 may partially encase the rear segment 179 of the plate 170. In this particular embodiment, the recessed portion 196 of the midsole cushioning member 176 completely surrounds and encases the rear segment 179, such that a top surface 274 of the plate 170 is flush with the top surface 206 of the midsole cushioning member 176 (see FIG. 18).

Figure 10:
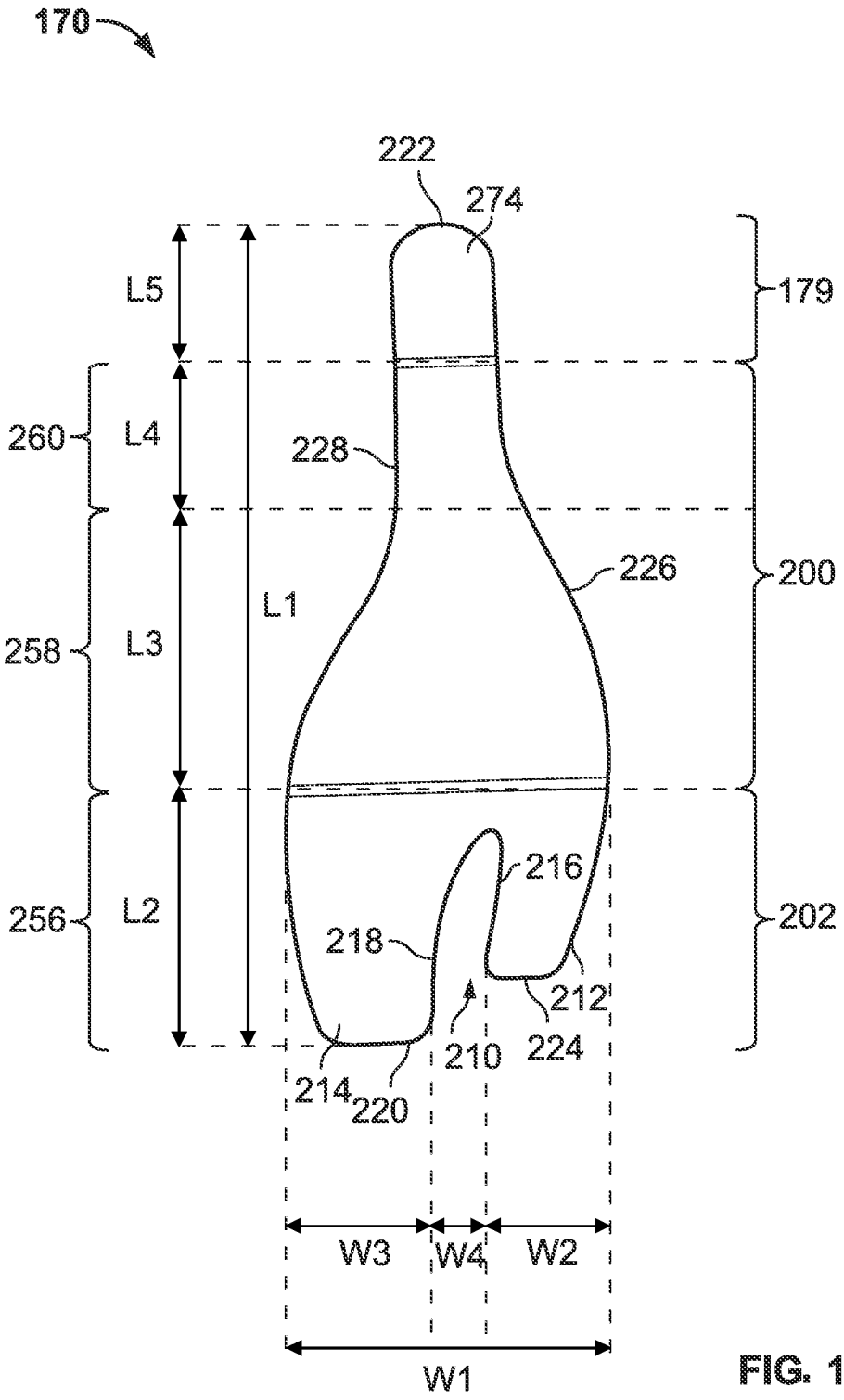
FIG. 10 is a top view of the plate of FIG. 8.
Figure 11:
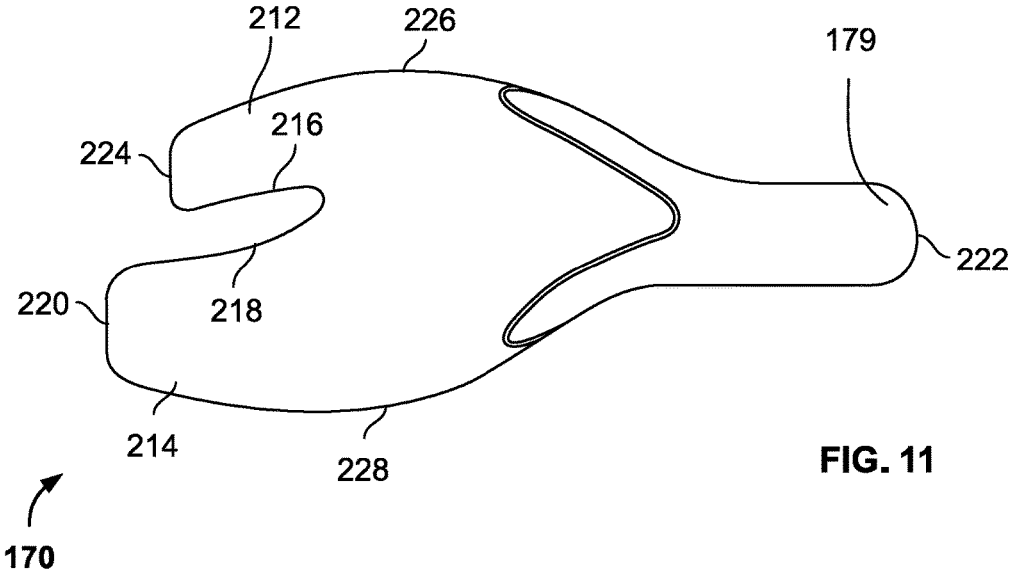
FIG. 11 is a bottom view of the plate of FIG. 8.
Figure 12:
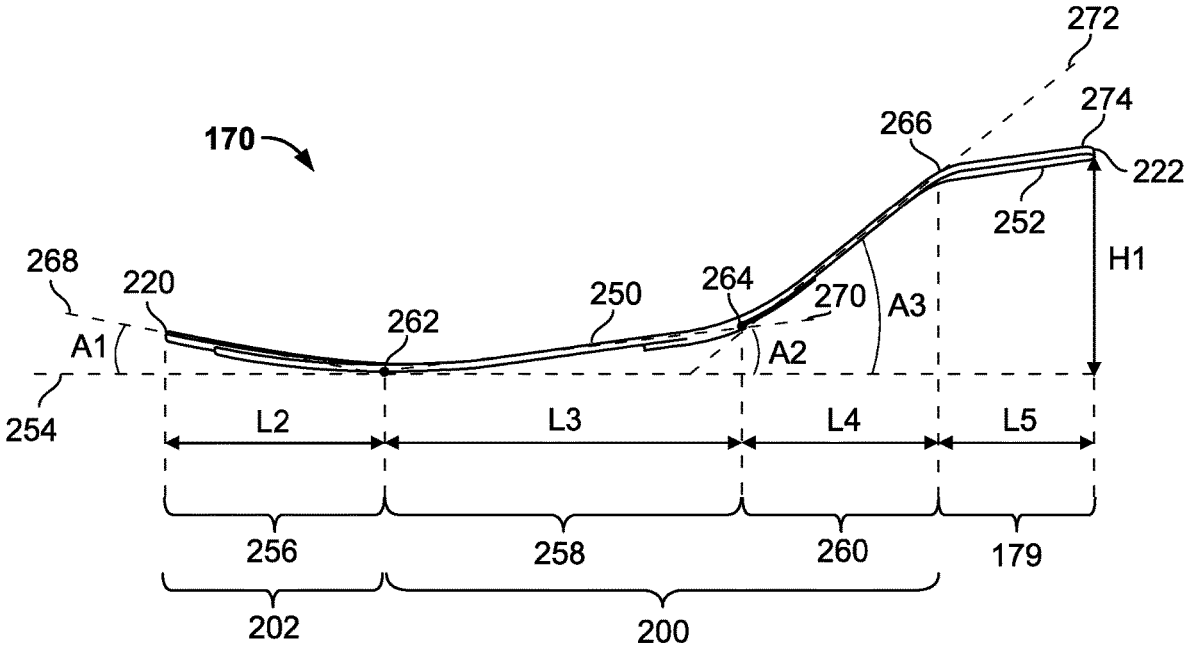
FIG. 12 is a lateral side view of the plate of FIG. 8.
Figure 13:
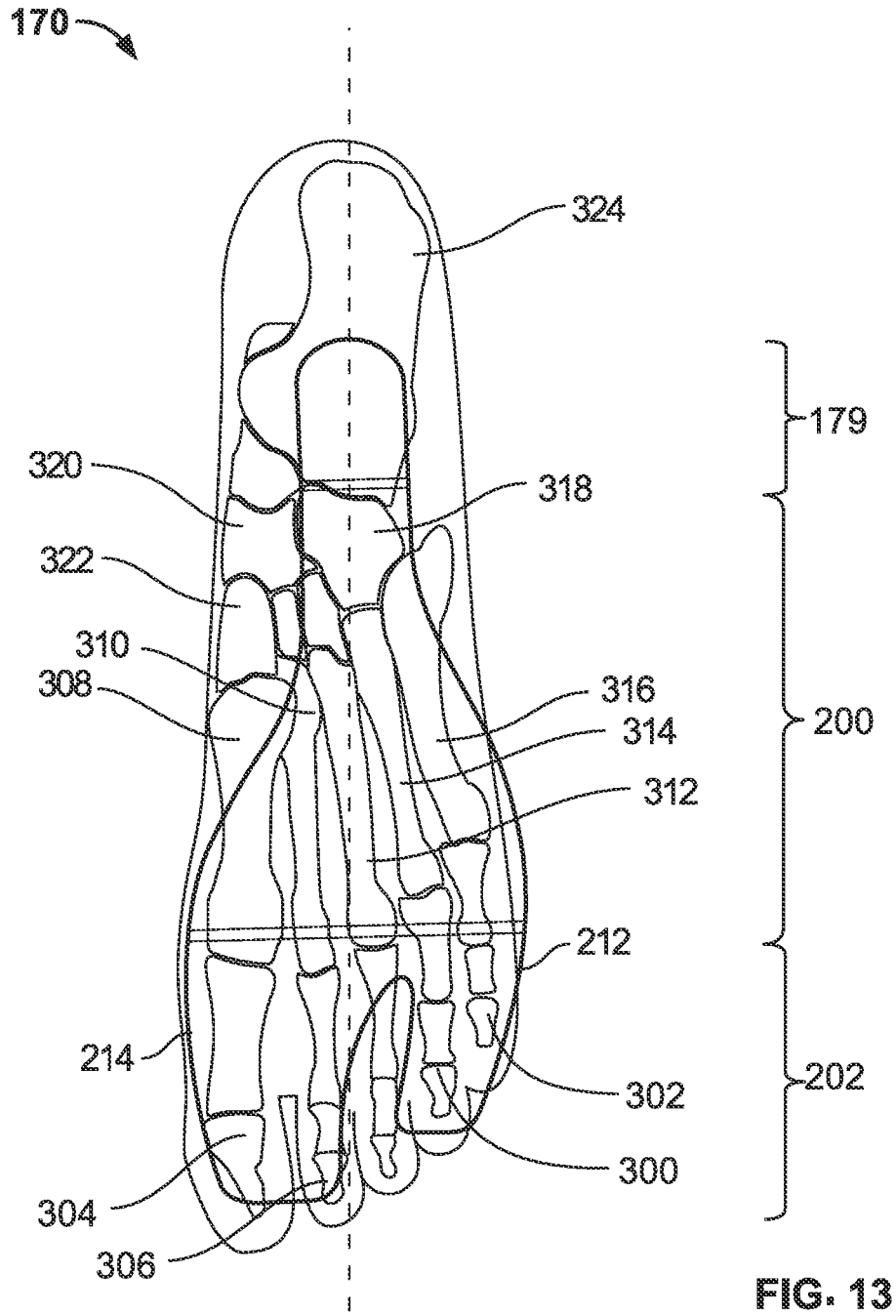
FIG. 13 is a top plan view of the plate of FIG. 8, with a user's skeletal foot structure overlaid thereon.

FIGS. 9-13 depict the footwear plate or plate 170 that may be incorporated in the article of footwear 100. FIG. 9 provides a top perspective view of the plate 170, FIG. 10 provides a top view of the plate 170, FIG. 11 provides a bottom view of the plate 170, FIG. 12 provides a side elevational view of the plate 170, and FIG. 13 provides another top view of the plate 170 with a skeletal structure of a left foot overlaid thereon.

The plate 170 may be defined by the rear segment 179, the arched segment 200, and the toe segment 202. With reference to FIGS. 10 and 18, the rear segment 179 may extend through at least the heel region 112 of the article of footwear 100 when incorporated therein and may correspond with portions of the plate 170 positioned near rear portions of a foot, including the heel or calcaneus bone, the ankle, or the Achilles tendon. The arched segment 200 of the plate 170 is proximate and adjoining the rear segment 179, and corresponds with portions of the plate 170 positioned near the midfoot region 110 of the article of footwear 100 that encase the arch of the foot, along with the bridge of a foot. The toe segment 202 of the plate 170 is proximate and adjoining the arched segment 200, and corresponds with portions of the plate 170 positioned near the forefoot region 108 of the article of footwear 100, which encases portions of the foot that includes the toes, the ball of the foot, and joints connecting the metatarsals with the toes or phalanges (i.e., the metatarsophalangeal joints).

As shown in FIGS. 9-13, the toe segment 202 of the plate 170 may also include a split 210 that bifurcates the toe segment 202 into a first toe segment portion 212 on the lateral side of the plate 170 and a second toe segment portion 214 on the medial side of plate 170. In this embodiment, the split 210 may be defined by an interior wall 216 of the first toe segment portion 212 and an interior wall 218 of the second toe segment portion 212, and may be generally curved or parabolic. The first toe segment portion 212, as shown in FIG. 13, may support the fourth and fifth toes or phalanges and the second toe segment portion 214 may support the first and second toes or phalanges, as will be further discussed herein. In alternative embodiments, the sizes of the first toe segment portion 212, the second toe segment portion 214, and the split 210 may vary. As a result, the first toe segment portion 212 and/or the second toe segment portion 214 may individually support any one of the toes or phalanges, as will be later discussed herein.

As best shown in FIG. 10, the plate 170 may also be defined by a first end 220, which is a distal end of the second toe segment portion 214, and a second end 222, which is a distal end of the rear segment 179. In this embodiment, the plate 170 may also include a third end 224, which may be a distal end of the first toe segment portion 212. In these embodiments, a length L1 of the plate 170 may be defined by the distance between the first end 220 and the second end 222, and may be equal to or less than the length of the midsole cushioning member 176. The plate 170 may also include a lateral side 226 and a medial side 228 that extend between the first end 220 and the second end 222. The distance between the lateral side 226 and the medial side 228 may also define a width, e.g., a width W1, of the plate 170, which may vary between the first end 220 and the second end 222 of the plate 170.

Still referring to FIG. 10, the medial side 228 begins at the first end 220 and bows outward along the toe segment 202 toward the arched segment 200. Proximate to the arched segment 200, the medial side 228 bows inward toward the rear segment 179, at which point the medial side 228 extends linearly toward the second end 222. The lateral side 226 begins at the third end 224 and bows outward along the toe segment 202 toward the arched segment 200. Proximate to the arched segment 200, the lateral side 226 bows inward toward the rear segment 179, at which point the lateral side 226 extends linearly toward the second end 222.

With reference to FIG. 12, the plate 170 may also be defined by a curved portion 250 that extends through the forefoot region 108 and the midfoot region 110 of the article of footwear 100, and a flat region 252 that extends through the heel region 112 of the article of footwear 100 to the second end 222. The flat region 252 is substantially flat, such that the flat portion 252 is approximately within ten degrees or five degrees horizontal to a ground surface, or reference plane 254 (see FIG. 12), when the plate 170 is positioned within the article of footwear 100. The flat region 252 may also be at a height H1 relative to the reference plane 254. In some embodiments, the height H1 may range between about 1 millimeter and about 50 millimeters. In other embodiments, the height H1 may range between about 5 millimeters and about 35 millimeters, or between about 10 millimeters and about 20 millimeters.

With continued reference to FIG. 12, the curved portion 250 may include one or more radii of curvature. For example, in this embodiment, the curved portion 250 includes an anterior curved portion 256, a medial curved portion 258, and a posterior curved portion 260 each with a radius of curvature. The anterior curved portion 256 may extend between the first end 220 and a vertex 262, which in this embodiment is the position along the plate 170 where the plate 170 is tangent to the reference plane 254. The medial curved portion 258 may be adjacent to the anterior curved portion 256 and may extend between the vertex 262 and a transition point 264 defined as a location along the plate at which point the angle of the plate 170 relative to the reference plane 254 changes. For example, in this embodiment, the angle of the curved portion 250 relative to the reference plane 254 increases at the transition point 264. The posterior curved portion 260 is adjacent to the medial curved portion 258 and extends from the transition point 264 to the flat region 252 of the plate 170.

Still referencing FIG. 12, the anterior curved portion 256, the medial curved portion 258, and the posterior curved portion 260 may each be defined by a length L2, L3, L4 and an angle A1, A2, A3, respectively. The length L2 is measured along the reference plane 254 between the vertex 262 and the front end 220 of the plate 170, the length L3 is measured along the reference plane 254 between the vertex 262 and the transition point 264, and the length L4 is measured along the reference plane 254 between the transition point 264 and a front end 266 of the rear segment 179 of the plate 170. As further shown in FIG. 12, the rear segment 179 or flat portion 252 may have a length L5, which is measured from the front end 266 thereof to the second end 222. In some embodiments, the length L2 may be approximately 10 percent (10%), 20%, 30%, or 40% of the total length L1 of the plate 170; the length L3 may be approximately 10%, 20%, 30%, 40%, 50%, or 60% of the total length L1 of the plate 170; the length L4 may be approximately 10%, 20%, 30%, 40%, 50%, or 60% of the total length L1 of the plate 170; and the length L5 of the flat portion 179 may be approximately 10%, 20%, 30%, or 40% of the total length L1 of the plate 170. In alternative embodiments, the curved portion 250 may not include the transition point 264 such that the plate 170 only includes the anterior portion 256 extending from the vertex 262 to the front end 220 of the plate 170 and a posterior portion (not shown) extending from the vertex 262 to the front end 266 of the rear segment 179. In such embodiments, the length of the posterior portion may be approximately equal to the summation of the length L3 and the length L4.

As previously discussed above, the anterior curved portion 256, the medial curved portion 258, and the posterior curved portion 260 of the plate 170 may also be defined by the angles A1, A2, A3, respectively. The angle A1 of the anterior curved portion 256 may be defined as the angle at which the anterior portion 256 extends from the vertex 262 toward the front end 220. Or put differently, the angle A1 may be defined as the angle between the reference plane 254 and a linear plane 268 extending between the vertex 262 and the front end 220. The angle A1 may be a value between about 3-degrees and about 45-degrees, or between about 5-degrees and about 20-degrees, or between about 10-degrees and about 20-degrees.

Similarly, the angle A2 of the medial curved portion 258 may be defined as the angle at which the medial curved portion 258 extends from the vertex 262 and toward the rear segment 179 of the plate 170. Or put differently, the angle A2 may be defined as the angle between the reference plane 254 and a second linear plane 270 extending between the vertex 262 and the transition point 264. The angle A2 may be a value between about 3-degrees and about 45-degrees, or between about 5-degrees and about 20-degrees, or between about 10-degrees and about 20-degrees. In some embodiments, the angle A2 of the medial curved portion 258 and the angle A1 of the anterior curved portion 268 are substantially equal to one another.

The angle A3 of the posterior curved portion 260 may be defined as the angle at which the posterior curved portion 260 extends toward the rear segment 179 and may be defined as the angle between the reference plane 254 and a third linear plane 272 extending between the transition point 264 and a front end 266 of the rear segment 179 of the plate 170. The angle A3 may be a value between about 5-degrees and about 70-degrees, or between about 20-degrees and about 50-degrees, or between about 30-degrees and about 50-degrees. In some embodiments, the angle A3 of the posterior curved portion 260 is greater than the angles A1, A2 of the medial curved portion 258 and the anterior curved portion 256.

Figure 48:
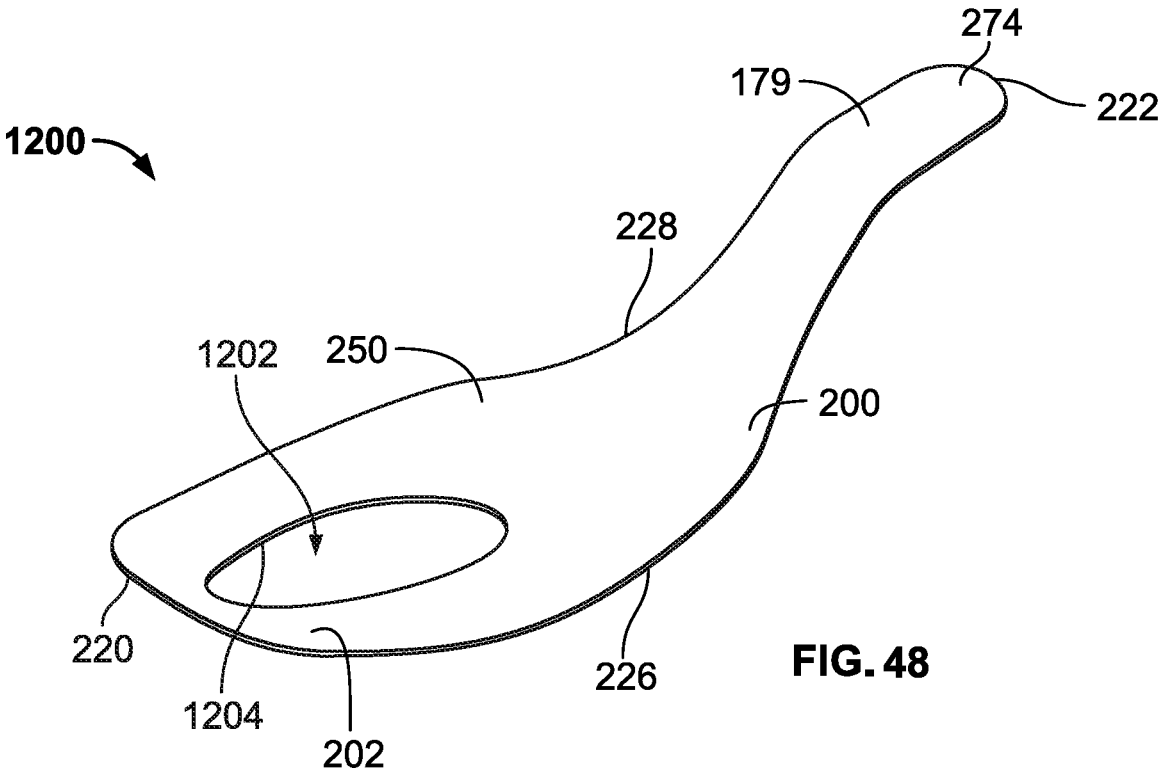
FIG. 48 shows a perspective view of another embodiment of the plate of FIG. 8.

FIG. 48 shows another configuration of the plate 1200. Features of the plate 1200 that are the same as those shown and described with respect to plate 170 are indicated with like reference numbers. The plate 1200 may be defined by the rear segment 179, the arched segment 200, and the toe segment 202. The plate 1200 may also include an aperture 1202 proximate to the first end 220 of the plate 1200 and defined by an interior wall 1204. The aperture may be circular or oblong, and may be contained entirely within the toe segment 202, entirely within the arched segment 200, or may extend from the toe segment 202 into the arched segment 200.

The plate 170 may be formed from densified wood or densified wood panels formed from chemically treating natural wood to remove lignin or hemicellulose therefrom, or compressing natural wood, as described herein. In some embodiments, the plate 170 may be formed from a composite of densified wood and a thermoplastic material, such as a thermoplastic polyurethane, a thermoplastic elastomer, a thermoplastic olefin, or the like. In some embodiments the plate 170 may be formed from a composite of densified wood and one or more fibers, such as carbon fibers, aramid fibers, boron fibers, glass fibers, natural fibers, and polymer fibers, or a combination thereof. In these embodiments, the densified wood and/or fibers may be affixed or bonded to a substrate or a thermoplastic material, e.g., a thermoplastic polyurethane, a thermoplastic polyolefin, or a thermoplastic elastomer, by stitching or an adhesive. In other embodiments, the plate 170 may be formed from a unidirectional tape that includes carbon fibers, aramid fibers, boron fibers, glass fibers, polymer fibers, or the like. In other embodiments, the plate 170 may be formed from a composite with at least one layer of densified wood.

In some embodiments, the one or more materials of the plate 170 may have a stiffness (e.g., a tensile strength) defined by a Young's modulus. For example, in particular embodiments, the one or more materials forming the plate 170 may have a Young's modulus of at least about 25 gigapascals (GPa), at least about 40 GPa, or at least about 70 GPa, or at least about 85 GPa, or at least about 200 GPa. In further embodiments, the one or more materials forming the plate 170 may have a Young's modulus between about 25 GPa and about 200 GPa, or between about 25 GPa and about 80 GPa, or between about 25 GPa and about 70 GPa, or between about 50 GPa and about 75 GPa.

In some embodiments, a portion of or the entire plate 170 is formed from densified wood with a Young's modulus of between about 10 GPa and about 70 GPa, between about 12 GPa and about 60 GPa, between about 18 GPa and about 58 GPa, between about 25 GPa and about 55 GPa, or between about 35 GPa and about 50 GPa. In some embodiments, a portion of or the entire plate 170 is formed from densified wood with a Young's modulus of at least 10.0 GPa, at least 12.0 GPa, at least 15.0 GPa, at least 20.0 GPa, at least 25.0 GPa, at least 30.0 GPa, at least 40.0 GPa, at least 50.0 GPa, or at least 55.0 GPa.

In some embodiments, the plate 170, and the stiffness thereof, may be selected and designed for a particular user. For example, a stiffness of the plate 170 may be selected based on the particular muscle strength, tendon flexibility, or joint flexibility of a user. In further embodiments, the stiffness of the plate 170 may vary, such that a portion of the plate 170 is stiffer compared to another portion of the plate 170. For example, in the instance the user pronates, the second toe segment portion 214 of the plate 170 on a medial side thereof may be stiffer than the first toe segment portion 212, the arched portion 200 (or, individually, the medial curved portion 258 and/or the posterior curved portion 260), and the rear segment 179 of the plate 170. In other embodiments, where additional support is desired in the arch or midfoot region 110 of the article of footwear 100, the arched segment 200 (or, individually, the medial curved portion 258 and/or the posterior curved portion 260) of the plate 170 may be stiffer than the toe segment 202 and the rear segment 179 of the plate 170. In essence, it is envisioned that the first toe segment portion 212, the second toe segment portion 214, the arched segment 200 (or, individually, the medial curved portion 258 and/or the posterior curved portion 260), and the rear segment 179 may each have an individual stiffness within the aforementioned ranges and an individual stiffness that is greater than or less than the stiffness of the other segments of the plate 170. In alternative embodiments, the stiffness of the plate 170 may be uniform and constant between the first toe segment portion 212, the second toe segment portion 214, the arched segment 200, and the rear segment 179.

In some embodiments, the stiffness of the plate 170 may be altered by increasing or decreasing the number of layers of densified wood therein. In some embodiments, certain regions of the plate 170 may include more layers of densified wood to increase stiffness. In some embodiments, the stiffness of the plate 170 may be altered by combining the densified wood with one or more additional materials to achieve the desired stiffness.

The plate 170 may also include a uniform thickness or substantially uniform thickness between about 0.5 millimeters (mm) and about 3.0 mm, or between about 0.5 mm and about 2.0 mm, or between about 0.7 mm and about 1.0 mm. In other embodiments, the plate 170 may have a non-uniform thickness or a thickness that varies across the plate 170. For example, similar to a stiffness of the plate 170, a thickness of the first toe segment portion 212 may be a different thickness than a thickness of the second toe segment portion 214, the arched segment 200 (or, individually, the medial curved portion 258 and/or the posterior curved portion 260), and/or the rear segment 179; the second toe segment portion 214 may be a different thickness than a thickness of the first toe segment portion 214, the arched segment 200, and/or the rear segment 179; the arched segment 200 may be a different thickness than a thickness of the first toe segment portion 212, the second toe segment portion 214, and/or the rear segment 179; or the rear segment 179 may have a thickness different than a thickness of the first toe segment portion 212, the second toe segment portion 214, and/or the arched segment 200. In essence, the thickness of the first toe segment portion 212, the second toe segment portion 214, the arched segment 200, or the rear segment 179 may be individually selected when the plate 170 is formed. In particular embodiments, the thickness of the plate 170, and the regions thereof, may be selected for the particular user and their particular muscle strength, tendon flexibility, or joint flexibility. In these embodiments, the thickness of the plate 170, and the individual thicknesses of the segments 179, 200, 212, 214 thereof, may range between about 0.5 mm and about 3.0 mm, or between about 0.5 mm and about 2.0 mm, or between about 0.7 mm and about 1.0 mm.

With particular reference to FIG. 13, the first toe segment portion 212 may be positioned proximate to and support a fourth distal phalanx and/or a fourth proximal phalanx 300, and a fifth distal phalanx and/or fifth proximal phalanx 302. As such, the properties of the first toe segment portion 212 may be tuned to provide optimal or a desired amount of support, elasticity, or spring force to those particular areas of a user's foot. Further, the second toe segment portion 214 may be positioned proximate to and support a first distal phalanx and/or a first proximal phalanx 304, and a second distal phalanx and/or a second proximal phalanx 306. As such, the properties of the first toe segment portion 212 may be tuned to provide optimal or a desired amount of support, elasticity, or spring force to those particular areas of a user's foot. The arch segment 200 may be positioned proximate to and support a first metatarsal 308, a second metatarsal 310, a third metatarsal 312, a fourth metatarsal 314, and/or a fifth metatarsal 316, as well as the cuboid 318, a navicular 320, and/or cuneiforms 322, such as the lateral cuneiform, middle or intermediate cuneiform, and/or medial cuneiform, of a user's foot. As such, the properties of the arch segment 200 may be tuned to provide optimal or a desired amount of support, elasticity, or spring force to those particular areas of a user's foot. Last, the rear segment 179 may be proximate to and support the heel or calcaneus 324 of a user's foot and, as such, the properties of the rear segment 179 may be tuned to provide optimal or a desired amount of support, elasticity, or spring force to those particular areas of a user's foot. For example, if a runner has a forefoot strike, i.e., the runner places the weight of their impact on the toes and ball of the foot (e.g., the distal phalanges and/or proximal phalanges 300-306), the majority of a user's weight and force may be applied to the first toe segment portion 212 and the second toe segment portion 214 of the plate 170 when running. As such, the first toe segment portion 212 and the second toe segment portion 214 may be designed to provide the necessary rigidity to support a user's foot when running and thereby reduce energy dissipation. Further, in this embodiment, the arched segment 200 and the rear segment 179 of the plate 170 may be constructed from a lightweight material because minimal weight or force is applied to these regions and, as such, less support is needed for these particular regions for a runner with a forefoot strike. Alternatively, if a runner has a heel strike or a midfoot strike, the first toe segment portion 212, the second toe segment portion 214, the arched segment 200, and the rear segment 179 may be constructed from a rigid material to provide support to a user's foot throughout their stride and during contact with the ground.

In other embodiments, as will be further discussed herein, the size and shape of the plate 170 may be altered to provide the desired support and structure to the foot of a wearer. For example, in this particular embodiment, the first toe segment portion 212 may have a width W2 (see FIG. 10). The width W2 may be defined as the distance between the lateral side 226 of the plate 170 and the interior walls 216, 218 of the split 210 on the third distal end 224 of the plate 170. Further, the second toe segment portion 214 may have width W3 defined as the distance between the medial side 228 of the plate 170 and the interior wall 218 of the split 210. In addition, the split 210 may have a width W4 that is defined as the distance between the first toe segment portion 212 and the second toe segment portion 214. In some embodiments, the width W4 of the split 210 may be increased and the respective widths of the first toe segment portion 212 and the second toe segment portion 214 may be decreased, as will be further discussed herein (see FIGS. 19 and 20, for example).

In some embodiments, the widths W2, W3 individually may be between about 2.5 millimeters (mm) and about 100 mm, or between about 5 mm and about 50 mm, or between about 10 mm and about 30 mm, or between about 15 mm and about 30 mm, or between about 20 mm and about 30 mm, or about 25 mm. Further, the width W4 of the split 210 may be between about 2.5 mm and about 100 mm, or between about 5 mm and about 50 mm, or between about mm and about 30 mm, or between about 15 mm and about 30, or between about 20 mm and about 30 mm, or between about 30 mm and about 70 mm, or between about 30 mm and about 50 mm, or between about 35 mm and about 45 mm.

Figure 19:
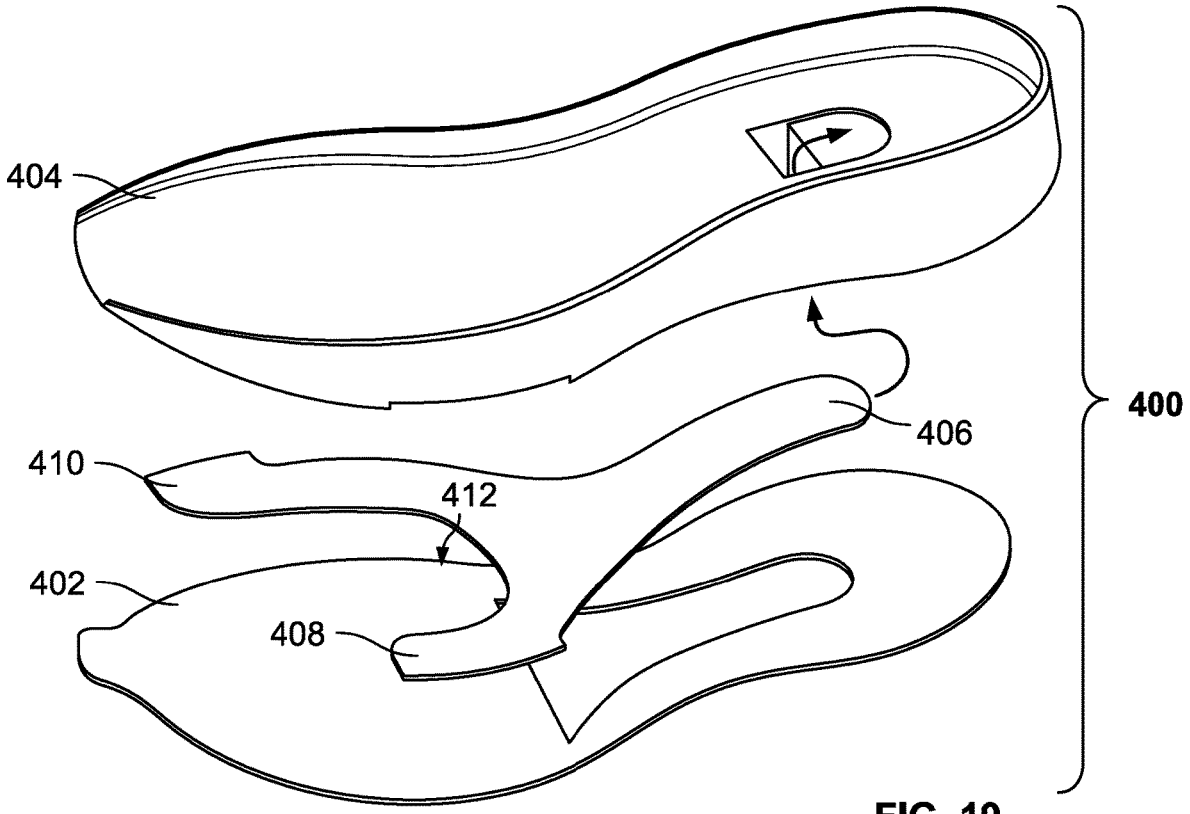
FIG. 19 is an exploded, top perspective view of another sole structure, according to a second embodiment of the present disclosure.
Figure 20:
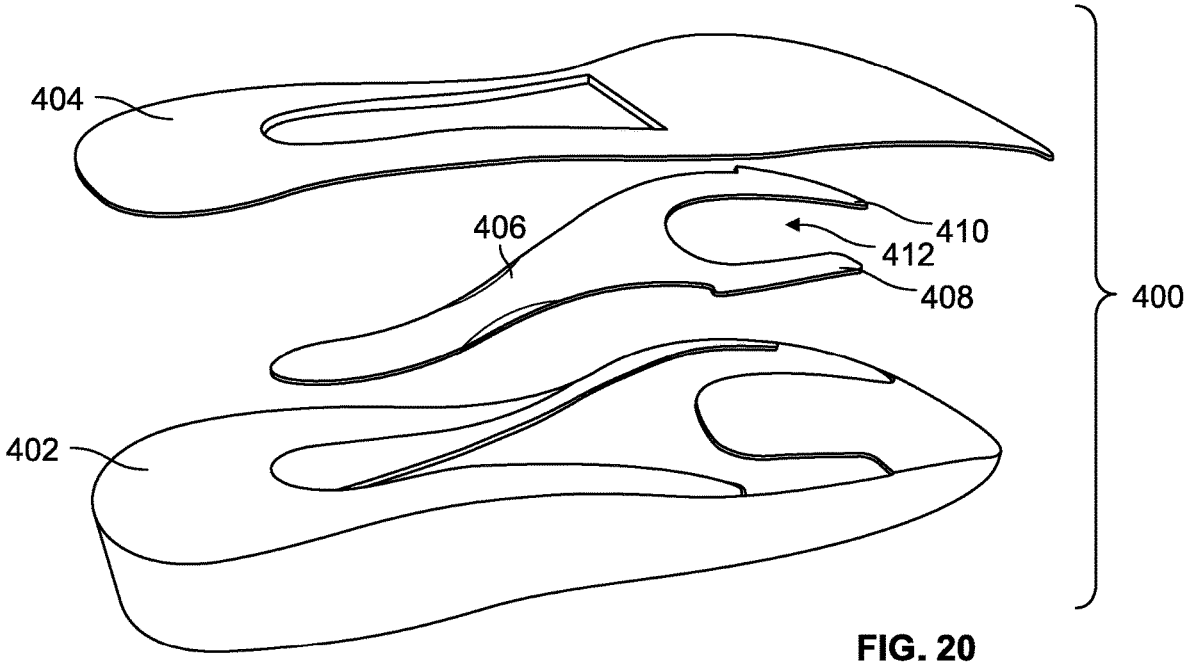
FIG. 20 is an exploded, bottom perspective view of the sole structure of FIG. 19.

FIGS. 19 and 20 provide a sole structure 400, according to a second embodiment of the present disclosure. In this embodiment, the sole structure 400 includes an outsole 402, a midsole cushioning member 404, and a plate 406. Further, although FIGS. 19 and 20 only depict a sole structure 400, it should be appreciated by those skilled in the art that the sole structure 400 may be connected to an upper, such as the upper 102, to form an article of footwear. Therefore, aspects of the upper 102 in combination with the sole structure 400 is anticipated and the upper 102 may be attached to the sole structure 400 and together with the sole structure 400 may define an interior cavity into which a foot may be inserted.

The configuration of the sole structure 400 is substantially similar to the sole structure 104 with the exception that the sole structure 400 does not include a heel cushioning member 172 and the heel support collar 174, but rather an outsole 402, a midsole cushioning member 404, and a plate 406 having a first toe segment portion 408 and a second toe segment portion 410.

As previously discussed herein, the width W2 of the first toe segment portion 212, the width W3 of the second toe segment portion 214, and the width W4 of the split 210 may vary and be dependent on the desired support needed for the sole structure 104. For example, if relatively minor support is needed on the lateral side 124 of the sole structure 104 and relatively minor support is needed on the medial side 126 of the sole structure 104, a width W2 of the first toe segment portion 212 and a width W3 of the second toe segment portion 214 may be decreased, while the width W4 of the split 210 may increase. For example, with particular reference to FIGS. 10 and 20, a width of the first toe segment portion 408 is smaller than the width W2 of the first toe segment portion 212, a width of the second toe segment portion 410 is smaller than the width W3 of the second toe segment portion 410, and a width of a split 412 is larger than the width W4 of the split 210.

Figure 21:
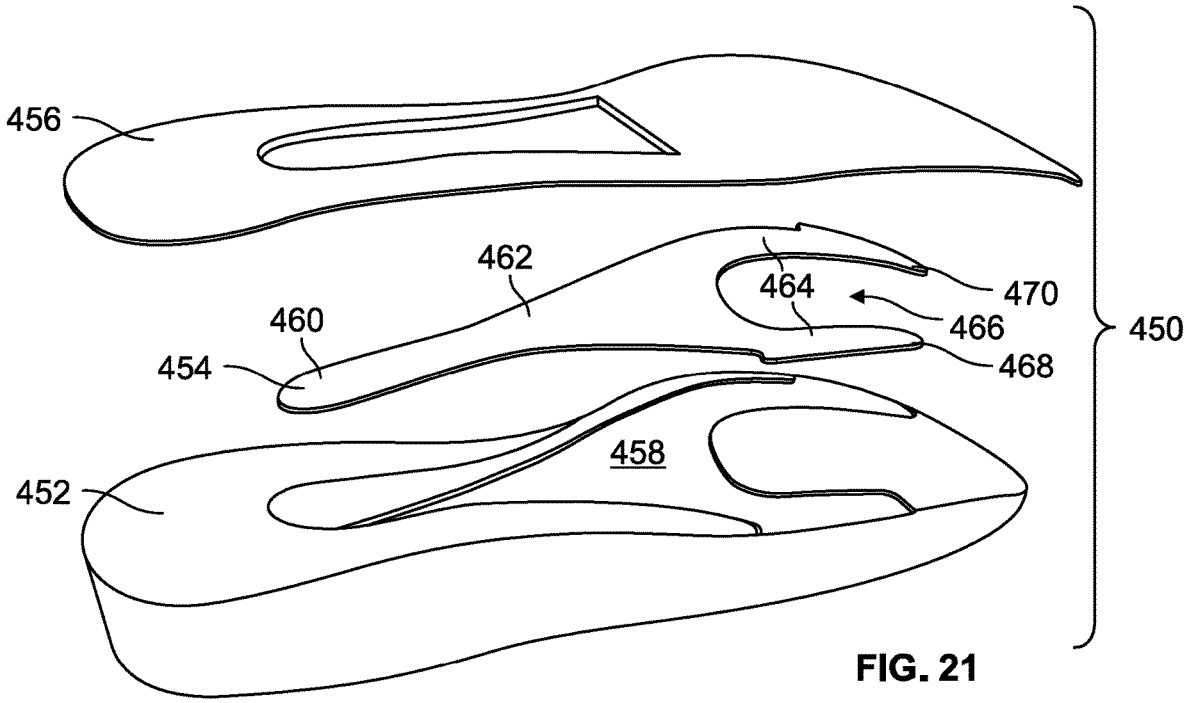
FIG. 21 is an exploded, bottom perspective view of yet another sole structure, according to a third embodiment of the present disclosure.

FIG. 21 provides a sole structure 450 that includes a midsole cushioning member 452, a plate 454, and an outsole 456, according to a third embodiment of the present disclosure. Although FIG. 21 only depicts the sole structure 450, it should be appreciated that the sole structure 450 may be connected to an upper, such as the upper 102, to form an article of footwear. Therefore, aspects of the upper 102 in combination with the sole structure 450 is anticipated and the upper 102 may be attached to the sole structure 450 and together with the sole structure 450 may define an interior cavity into which a foot of a user may be inserted.

In this embodiment, the midsole cushioning member 452 may be adjacent to and on top of the outsole 456 in the forefoot region, the midsole region, and the heel region. The midsole cushioning member 452 may also include a recessed portion 458 that communicates with the plate 454. In other words, the recessed portion 458 of the midsole cushioning member 452 may embed, encapsulate, or surround at least a portion of the plate 170. As such, the recessed portion 458 of the midsole cushioning member 452 may also define the shape and size of the plate 170.

As previously discussed, the sole structure 450 may also include the plate 454 positioned therein. In particular embodiments, the plate 454 may be adjacent to and positioned between the outsole 456 and the midsole cushioning member 452 in the forefoot region of the article of footwear, such that the plate 454 is vertically below the midsole cushioning member 452 in the forefoot region and/or vertically below the midsole cushioning member 452 in the midfoot region of the article of footwear. Put differently, the plate 454 may be positioned between the midsole cushioning member 452 and the outsole 456 in the forefoot region and/or the midfoot region. Further, in this particular embodiment, a depth of the recessed portion 458 in the forefoot region is smaller than a depth of the recessed portion 458 in the heel region of the sole structure 450. As a result, the plate 454 is positioned within, but extends from, the recessed portion 458 in the forefoot region of the sole structure 450 when assembled, such that the outsole 456 engages or contacts the plate 454 in the forefoot region. However, because a depth of the recessed portion 458 is greater than a thickness of the plate 454 in the heel region, in this embodiment, the midsole cushioning member 452 completely surrounds the plate 454 and a gap (not shown) is present between the plate 454 and the outsole 456 when assembled.

In this embodiment, the plate 454 may also be defined by a rear segment 460, an arched segment 462, and a toe segment 464. The rear segment 460 may extend through at least a portion of the heel region of the sole structure 450 when incorporated therein and may correspond with portions of the plate 454 positioned near rear portions of the foot, including the heel or calcaneus bone, the ankle, or the Achilles tendon. The arched portion 462 of the plate 454 is proximate to and adjoins the rear segment 460, and corresponds with portions of the plate 454 positioned near the midfoot region of the article of footwear that encase the arch of the foot, along with the bridge of a foot. The toe segment 464 of the plate is proximate to and adjoins the arched segment 462, and corresponds with portions of the foot that includes the toes, the ball of the foot, and joints connecting the metatarsals with the toes or phalanges (i.e., the metatarsophalangeal joints).

The toe segment 464 of the plate 454 may also include a split 466 that bifurcates the toe segment 464 into a first toe segment portion 468 on the lateral side of the plate and a second toe segment portion 470 on the medial side of the plate 454.

Still referencing FIG. 21, the arched portion 462 may also be curved or bowed, such that when the plate 454 is positioned in the sole structure 450, the toe segment 464 has a relative position below the arched portion 462 and/or the rear segment 460 of the plate 454. Put differently, when assembled, the toe segment 464 of the plate 454 is closer to the outsole 456 compared to the rear segment 460 of the plate 454, and the rear segment 460 of the plate 454 is closer to the insole or the top surface (not shown) of the midsole cushioning member 452 compared to the toe segment 464 of the plate 454. In these embodiments, the arched portion 462 bows upwardly toward the rear segment 460, which is relatively flat. In particular embodiments, the rear segment 460 is substantially flat, such that the rear segment 460 is approximately within ten degrees or five degrees horizontal to a ground surface, or a reference plane, when the plate 454 is positioned within the sole structure 450. Unlike the sole structures 104, 400, however, the midsole cushioning member 452 does not include an aperture through which a portion of the plate 454 extends and, as such, no portion of the plate 454 is above the midsole cushioning member 452. Rather, the entire length of the plate 454 is below the midsole cushioning member 452 and positioned between the midsole cushioning member 452 and the outsole 456, in this embodiment.

As discussed above in connection with FIGS. 1-21, the toe segments, e.g., the toe segments 202, 464 of the plates 170, 406, 454 may be modified to alter the support for the sole structures 104, 400, 450 and, by extension, the support provided to the forefoot region of a user's foot. Similarly, in alternative embodiments, the rear segments, e.g., the rear segments 179, 460, of the plates 170, 406, 454 may be modified to alter or optimize the support provided to the heel region of the sole structures 104, 400, 450. In other words, the rear segments of the plates 170, 406, 454 may be modified to increase or decrease the support to the heel region of a user's foot. For example, FIG. 22 and FIG. 23 depict additional embodiments of a sole structure 500 (see FIG. 22) and a sole structure 600 (see FIG. 23), wherein a rear segment of a plate is modified to provide optimized support to the heel region of an article of footwear.

Figure 22:
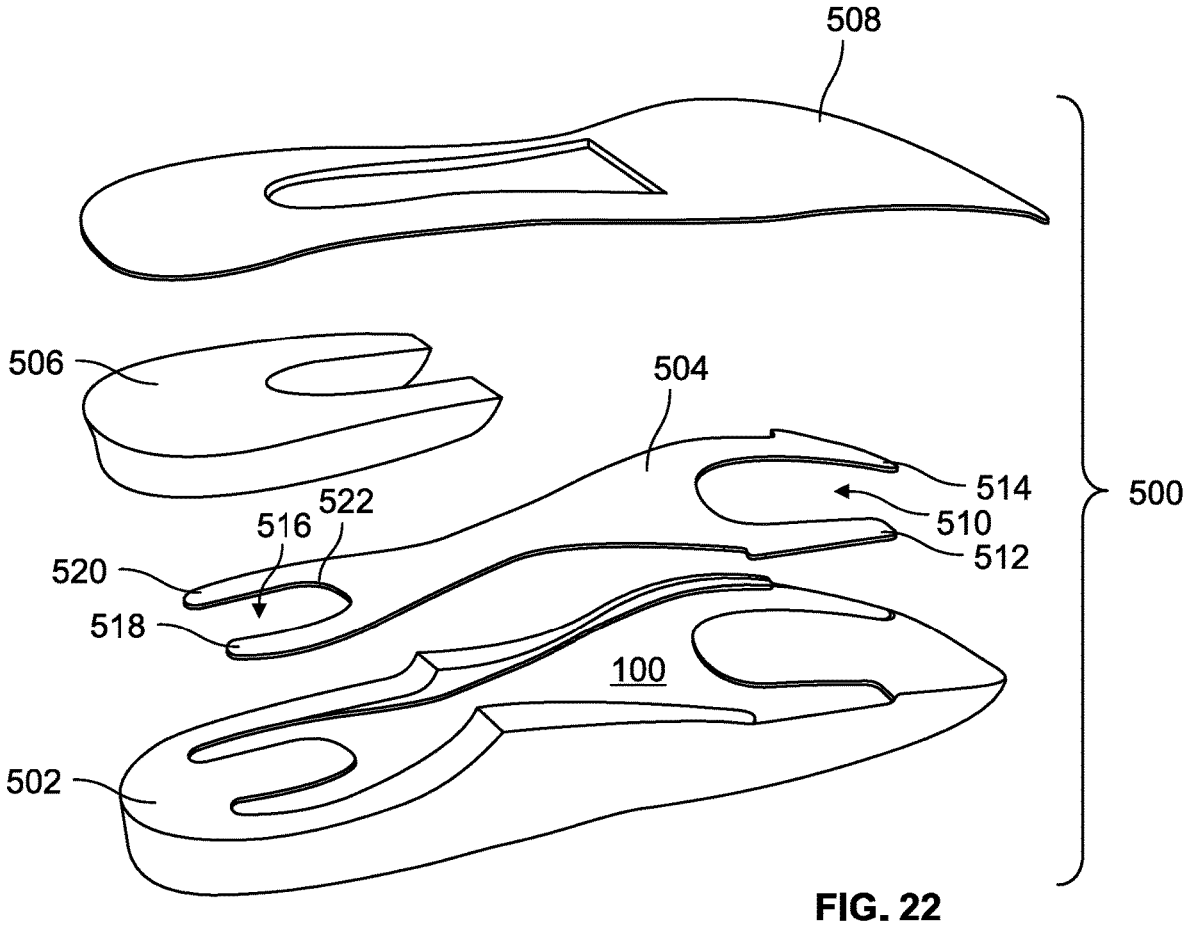
FIG. 22 is an exploded, bottom perspective view of still another sole structure, according to a fourth embodiment of the present disclosure.

With reference to FIG. 22, the sole structure 500 may include a midsole cushioning member 502, a plate 504, a heel cushioning member 506, and an outsole 508. With regard to FIG. 23, the sole structure 600 may include an upper midsole cushioning member 602, a plate 604, a lower midsole cushioning member 606, a heel support collar 608, and an outsole 610. In these embodiments, similar to the prior embodiments, although FIGS. 22 and 23 only depict the sole structures 500, 600 it should be appreciated that the sole structures 500, 600 may be connected to an upper, such as the upper 102, to form an article of footwear.

Figure 23:
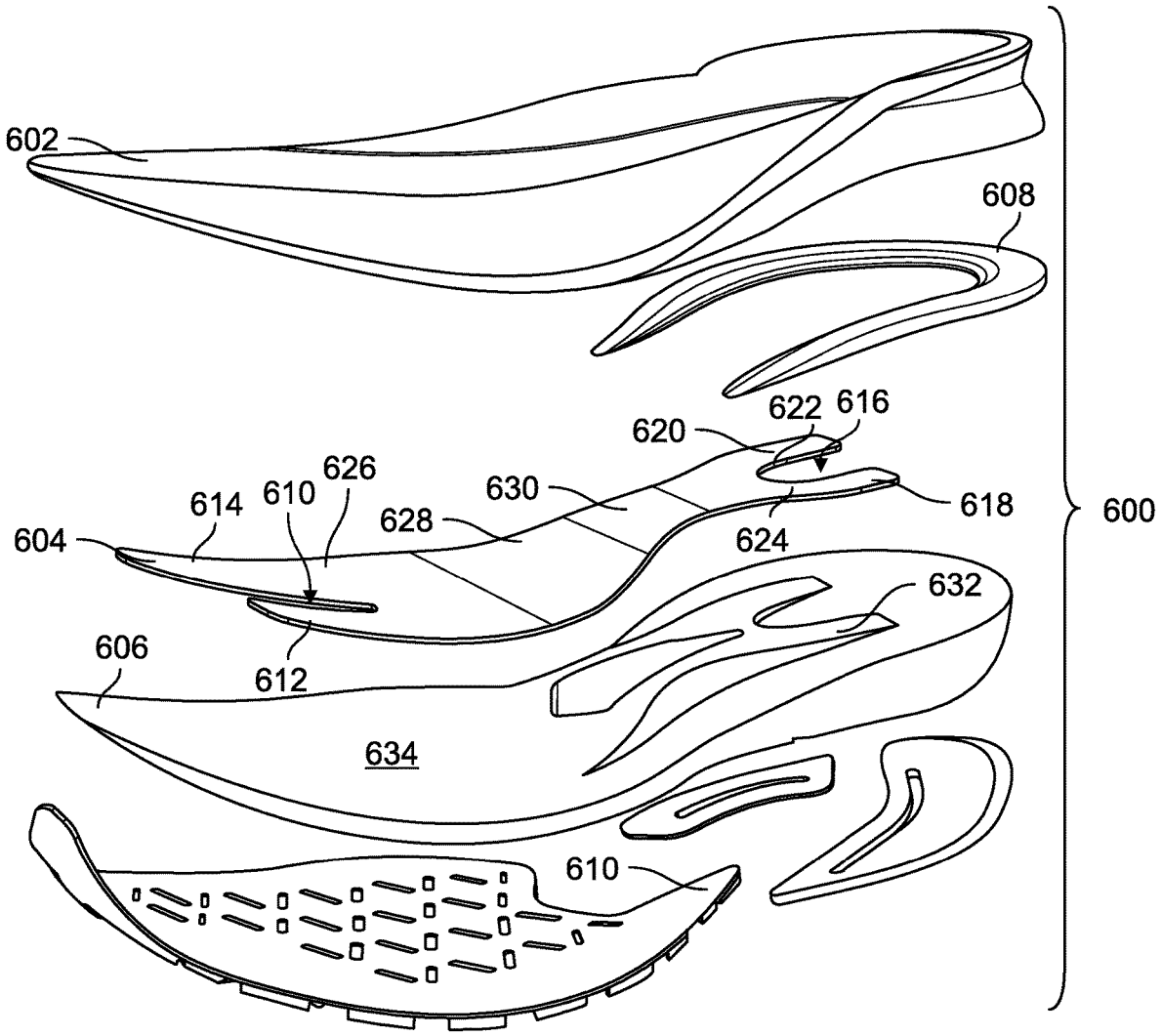
FIG. 23 is an exploded, top perspective view of another sole structure having an outsole, a lower midsole cushioning member, an upper midsole cushioning member, a heel support, and a plate, according to a fifth embodiment of the present disclosure.

With continued reference to FIGS. 22 and 23, the sole structures 500, 600 include plates 504, 604 having splits 510, 610 that bifurcate the toe segment into first toe segment portions 512, 612 on a lateral side of the plates 504, 604 and second toe segment portions 514, 614 on the medial side of the plates 504, 604, as well as a second split 516, 616 that bifurcates the rear segment into first rear segment portions 518, 618 on a lateral side of the plates 504, 604 and second rear segment portions 520, 620 on the medial side of the plates 504, 604. In these embodiments, the second split 516, 616 may be defined by an interior wall 522, 622, which may be generally curved or parabolic. In some embodiments, the sizes of the first rear segment portions 518, 618 and/or the second rear segment portions 520, 620 may support the heel region of the sole structures 500, 600.

Further, similar to the plate 170 of the sole structure 104, the plates 504, 604 may include a flat portion, and a curved portion having an anterior curved portion, a medial curved portion, and/or a posterior curved portion. For example, as shown in FIG. 23, the plate 604 may include a flat portion 624 and a curved portion having an anterior curved portion 626, a medial curved portion 628, and a posterior curved portion 630. The lower midsole cushioning member 606 may also include a supporting surface 632 that projects upwardly from a top surface 634 of the lower midsole cushioning member 606. In this embodiment, the supporting surface 632 contacts or engages the lower surfaces of the flat portion 624, the posterior curved portion 630 and the medial curved portion 628.

Figure 24:
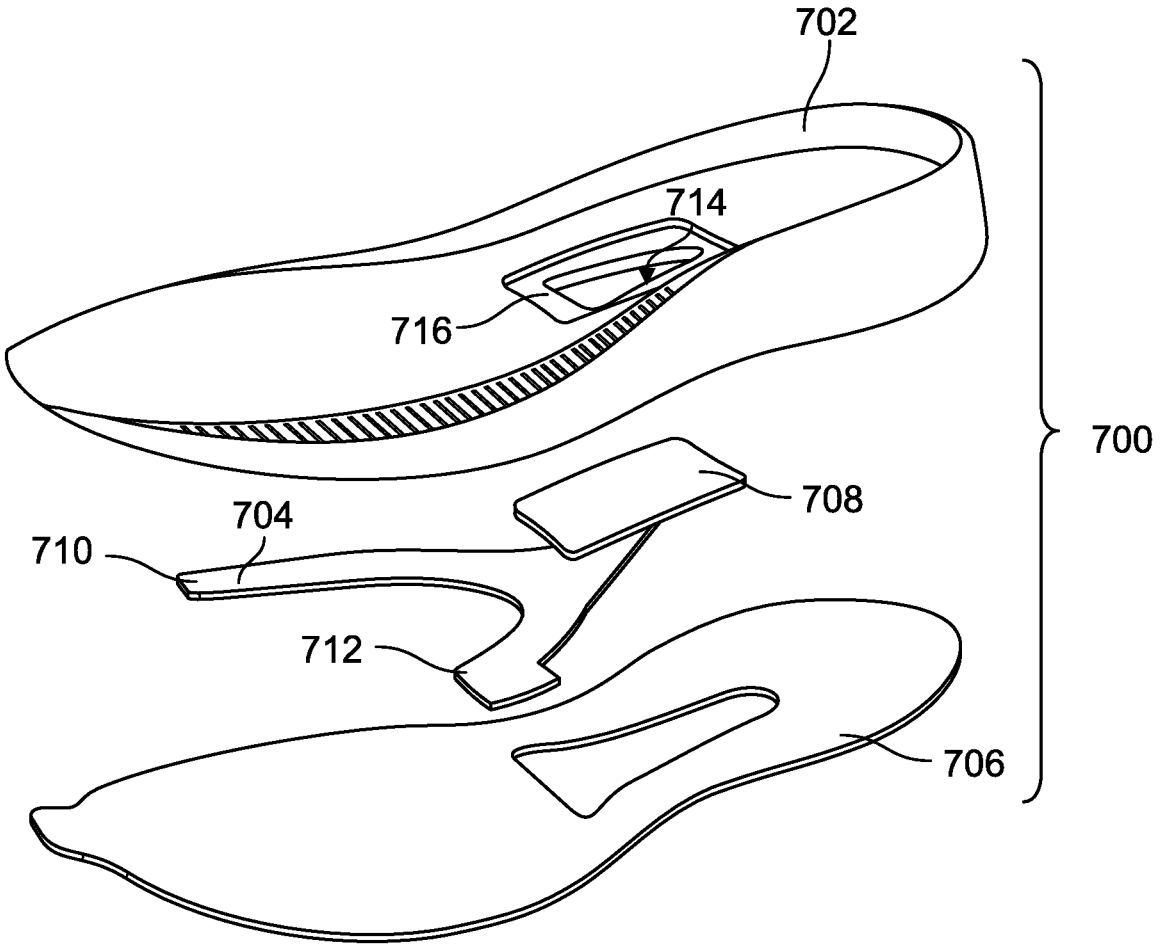
FIG. 24 is an exploded, top perspective view of yet another sole structure having an outsole, a midsole, and a plate, according to a sixth embodiment of the present disclosure.
Figure 25:
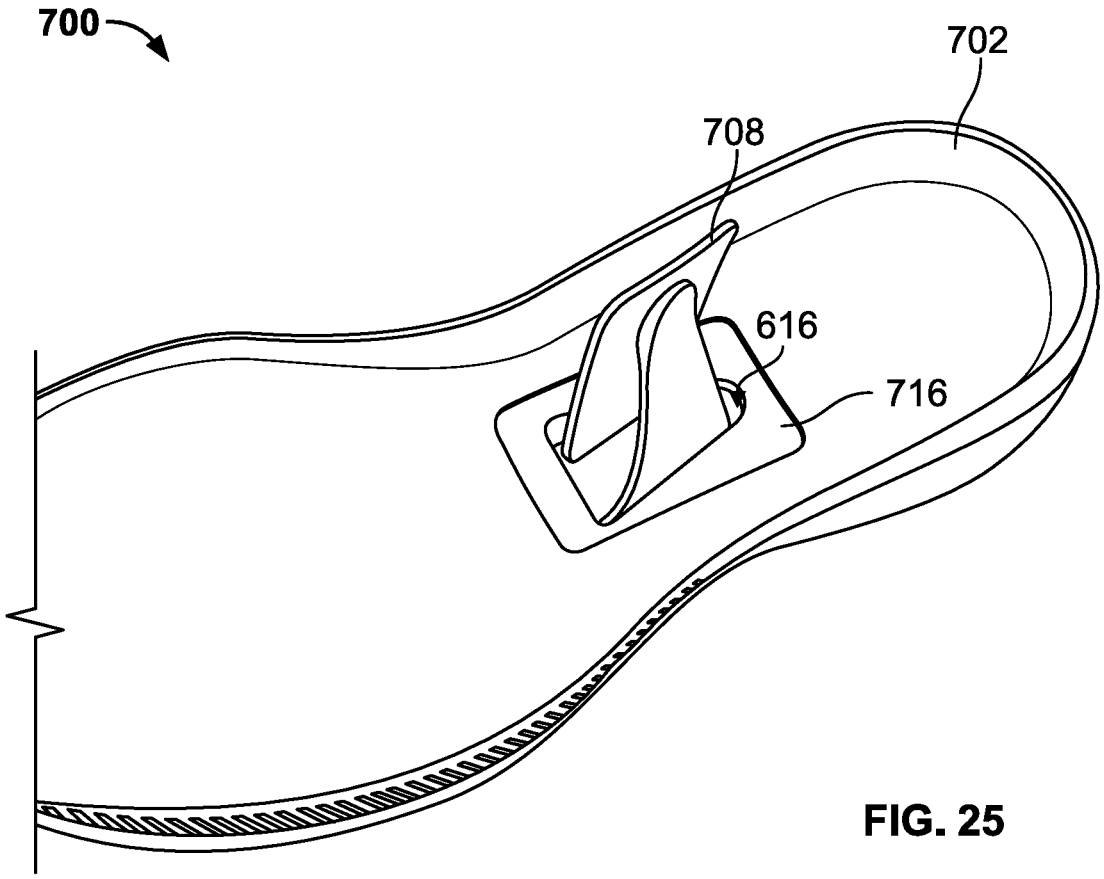
FIG. 25 is a partial view of the sole structure of FIG. 24, wherein the plate is in a first state relative to the midsole.
Figure 26:
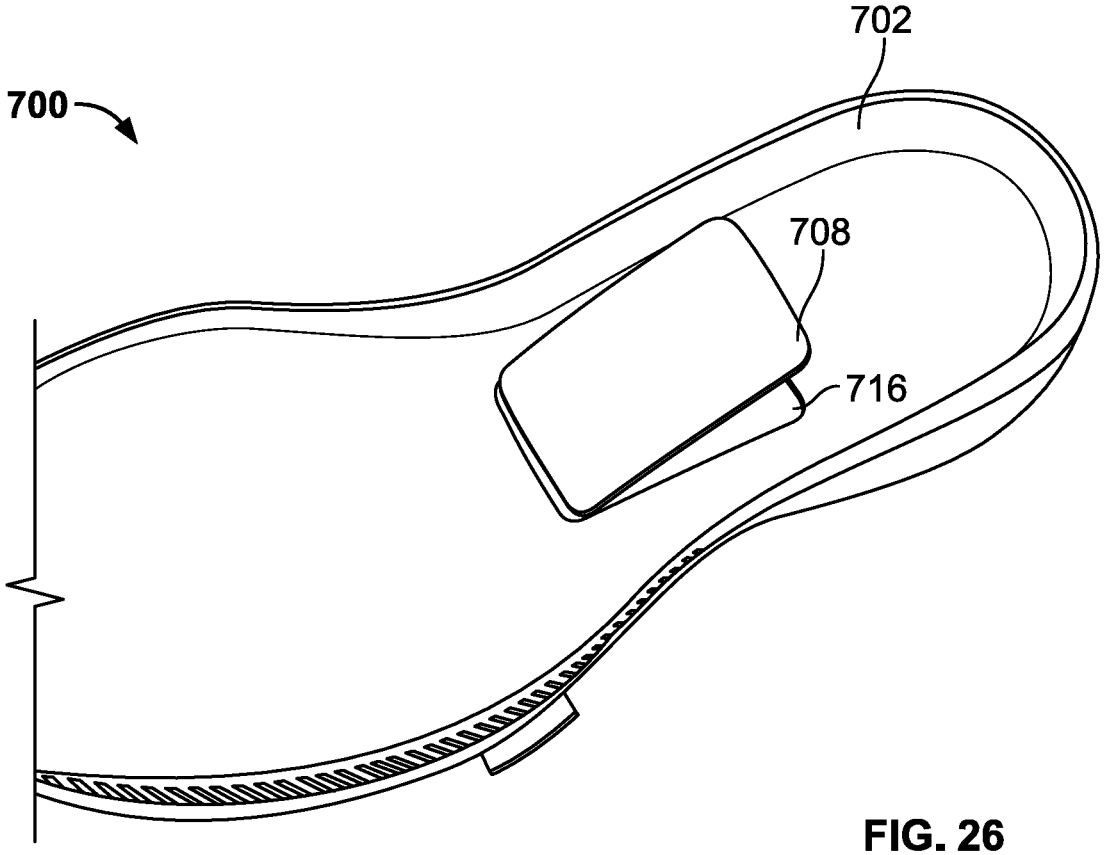
FIG. 26 is a partial view of the sole structure of FIG. 24, wherein the plate is in a second state relative to the midsole.

FIGS. 24-26 provide another sole structure 700 that includes a midsole cushioning member 702, a plate 704, and an outsole 706, according to another aspect of the present disclosure. In this particular embodiment, the plate 704 includes a base 708 and medial and lateral arms 710, 712. Further, the midsole cushioning member 702 may include an aperture 714 through which the base 708 may extend through. For example, as shown in FIGS. 25 and 26, the base 708 may be folded upon itself and inserted through the aperture 714. Once the base 708 is inserted through the aperture 714, the base 708 may be positioned within a recess 716.

Figure 27:
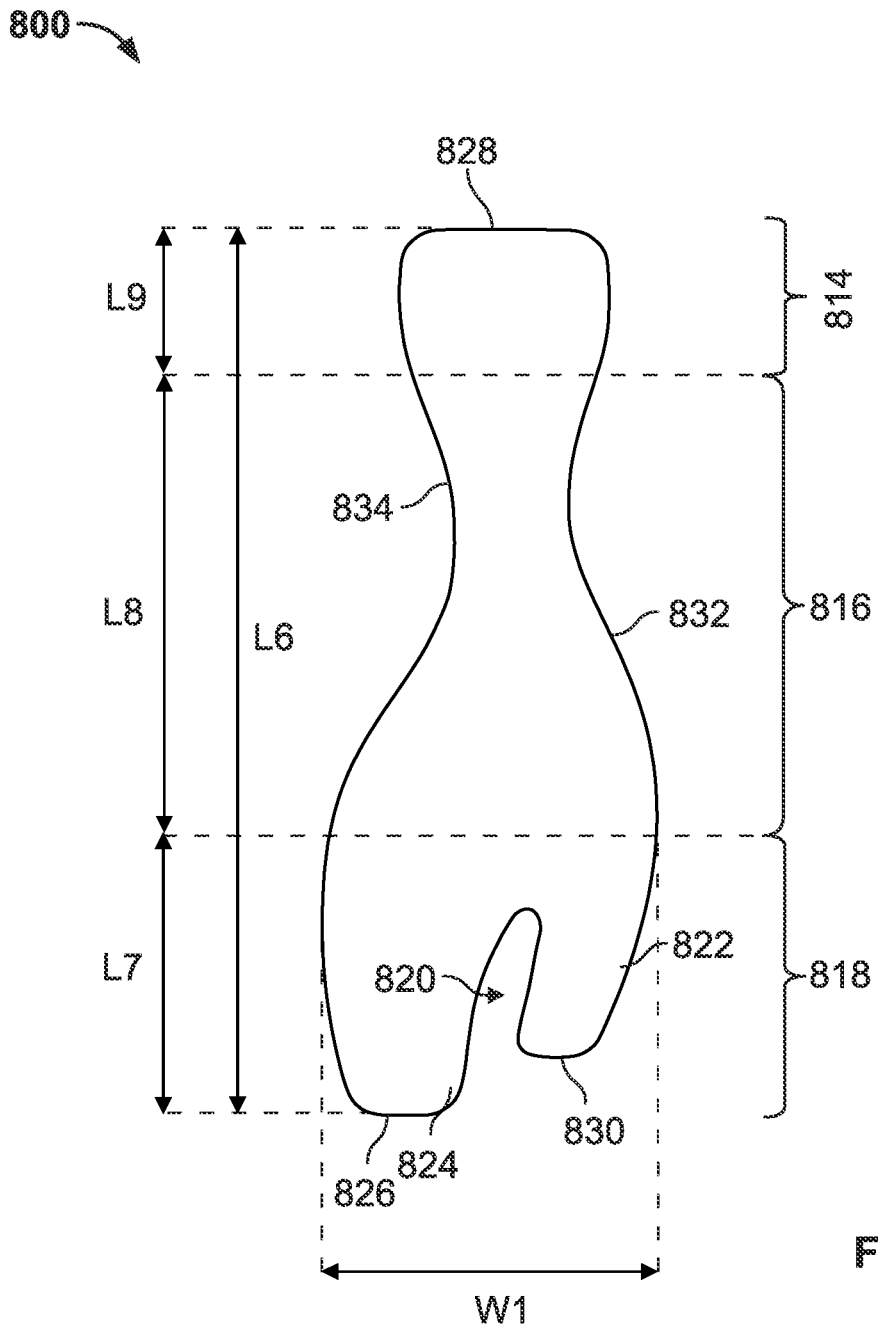
FIG. 27 is a top view of another embodiment of a plate for a sole structure.
Figure 28:
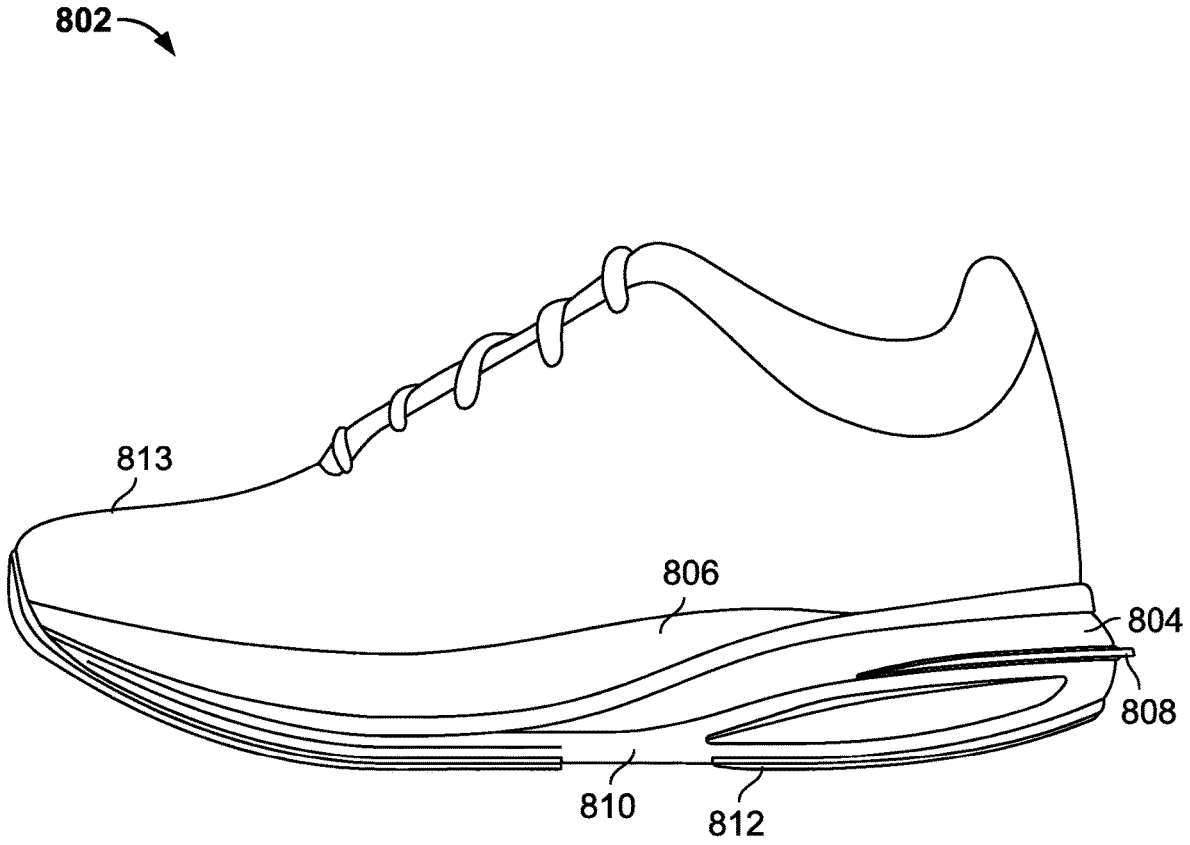
FIG. 28 is a lateral side view of an article of footwear having a sole structure with the plate of FIG. 27.
Figure 29:
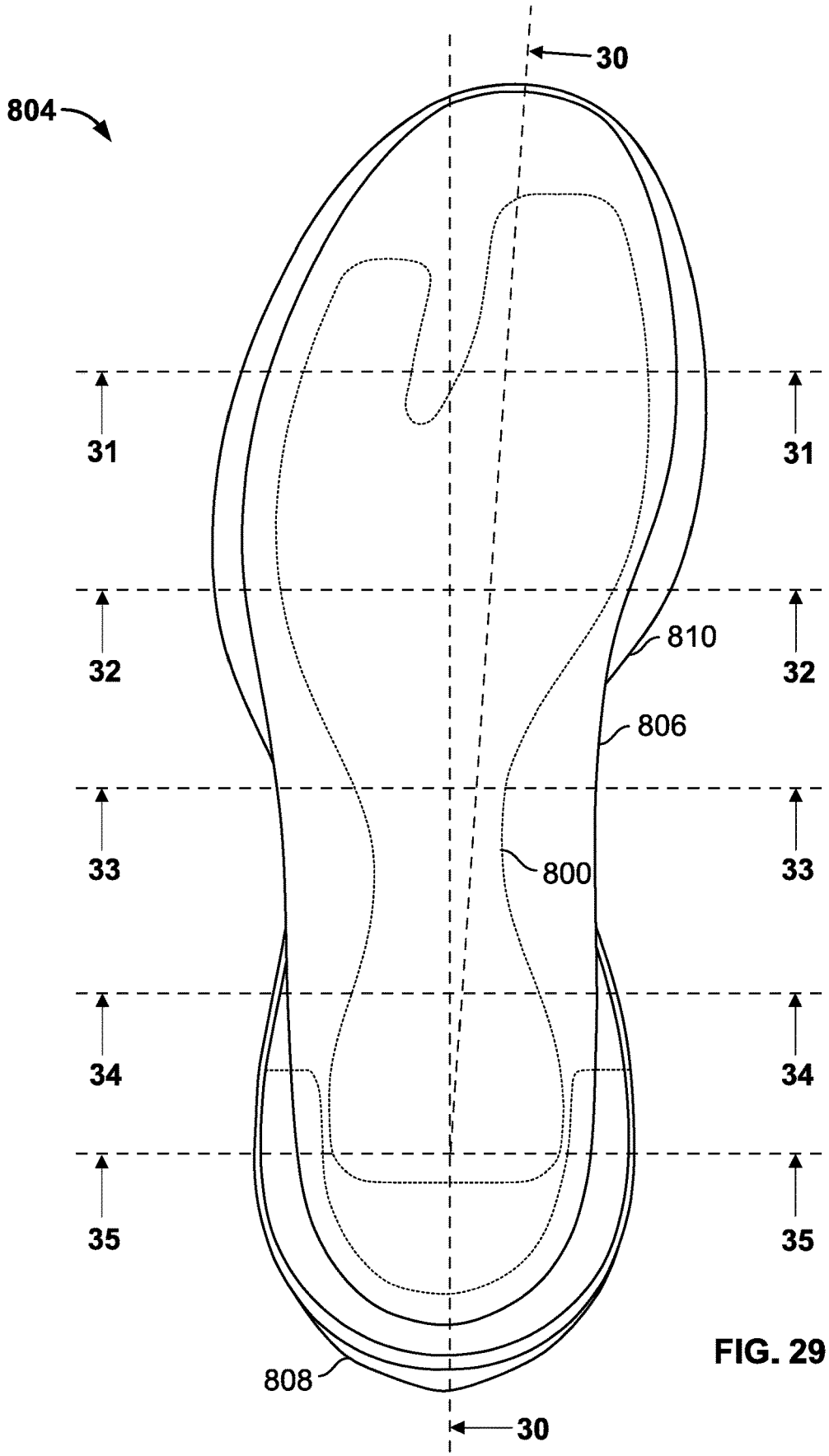
FIG. 29 is a top view of the sole of FIG. 28 with internal components thereof shown in broken lines.

FIG. 27 depicts a top view of a plate 800, according to another embodiment of the present disclosure, which may the characterized and defined in a similar manner to the plate 170 previously discussed herein. Further, FIGS. 28-35 depict an article of footwear 802, or a sole structure 804 thereof, that includes the plate 800. The article of footwear 802, or the sole structure 804 thereof, may also include an upper midsole cushioning member 806, a heel support collar 808, the plate 800, a lower midsole cushioning member 810, an outsole 812, and an upper 813 according to yet another aspect of the present disclosure. Similar to the embodiments previously discussed herein, the plate 800 may be defined by a rear segment 814 (see FIG. 30), an arch segment 816 (see FIG. 30), and a toe segment 818 (see FIG. 30). With continued reference to FIG. 30, the rear segment 814 may extend through at least the heel region of the article of footwear 802 when incorporated therein and may correspond with portions of the plate 800 positioned near rear portions of a foot, as previously discussed herein. The arched segment 816 of the plate 800 is proximate to and adjoins the rear segment 814, and corresponds with portions of the plate 800 positioned near the midfoot region of the article of footwear 802 that encase the arch of the foot, along with the bridge of the foot. The toe segment 818 of the plate 800 is proximate to and adjoins the arched segment 816, and corresponds with portions of the plate 800 positioned near the forefoot region of the article of footwear 802.

Similar to the plate 170, the toe segment 818 of the plate 800 may also include a split 820 that bifurcates the toe segment 818 into a first toe segment portion 822 on the lateral side of the plate 800 and a second toe segment portion 824 on the medial side of the plate 800. The first toe segment portion 822, the second toe segment portion 824, and the split 820 may have properties similar to the first toe segment portion 212, the second toe segment portion 214, and the split 210. For example, the first toe segment 822, the second toe segment 824, and the split 820 may have a width equal to the widths W2, W3, and W4, respectively, as previously discussed herein. As best shown in FIG. 27, the plate 800 may also be defined by a first end 826, which is a distal end of the second toe segment portion 824, a second end 828, which is a distal end of the rear segment 814, and a third end 830, which may be a distal end of the first toe segment portion 822. A length L6 of the plate 800 may be defined by the distance between the first end 826 and the second end 828, and may be equal to or less than the length of a midsole, such as the upper midsole cushioning body 806, of an article of footwear. The plate 800 may also include a lateral side 832 and a medial side 834 that extend between the first end 826 and the second end 828. The distance between the lateral side 832 and the medial side 834 may also define a width W5 of the plate 800, which may vary between the first end 826 and the second end 828 of the plate 800.

Still referring to FIG. 27, the medial side 834 begins at the first end 826 and bows outward along the toe segment 818 toward the arched segment 816. Proximate to the arched segment 816, the medial side 834 bows inward toward the rear segment 814, at which point the medial side 834 bows outwardly again. The lateral side 832 begins at the third end 830 and bows outward along the toe segment 818 toward the arched segment 816. Proximate to the arched segment 816, the lateral side 832 bows inward toward the rear segment 814, at which point the lateral side 832 bows outwardly again.

Figure 30:
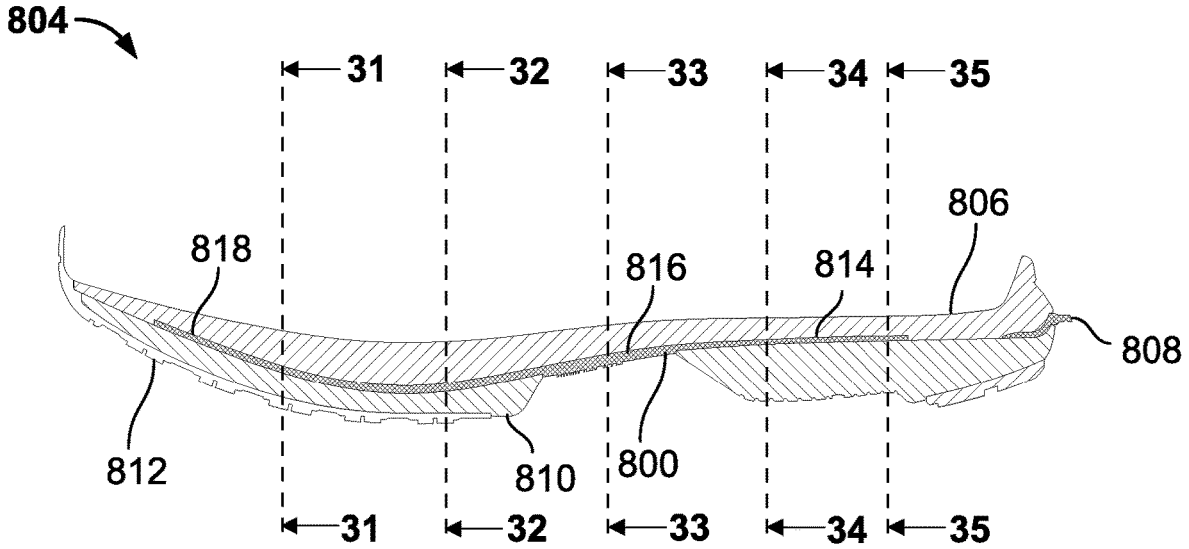
FIG. 30 is a cross-sectional view of the sole structure of FIG. 28 taken through line of FIG. 29.
Figure 31:
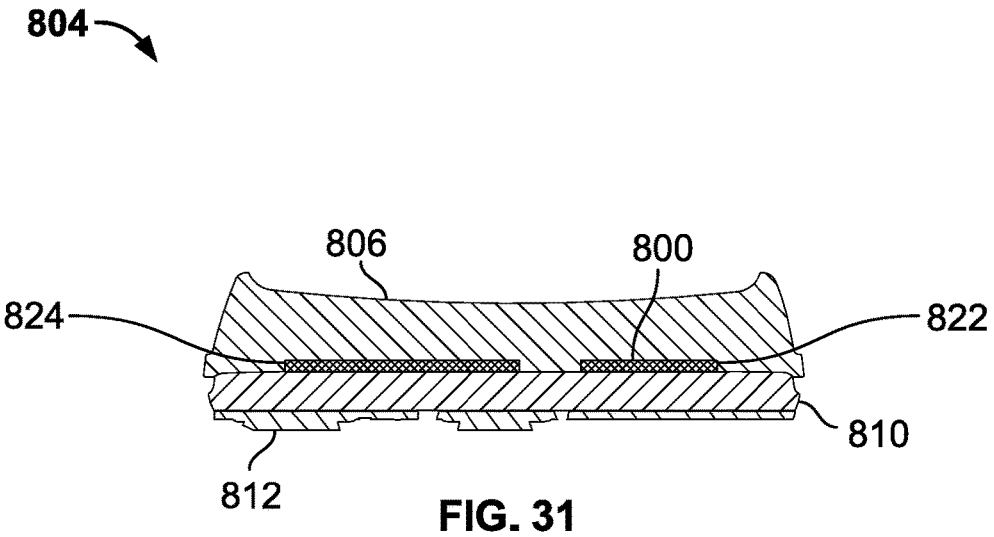
FIG. 31 is a cross-sectional view of the sole structure of FIG. 28 taken through line 31-31 of FIG. 29.
Figure 32:
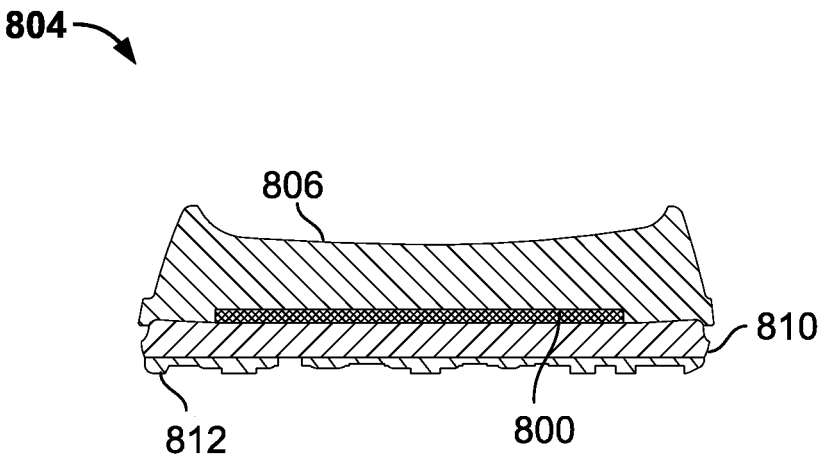
FIG. 32 is a cross-sectional view of the sole structure of FIG. 28 taken along line 32-32 of FIG. 29.
Figure 33:
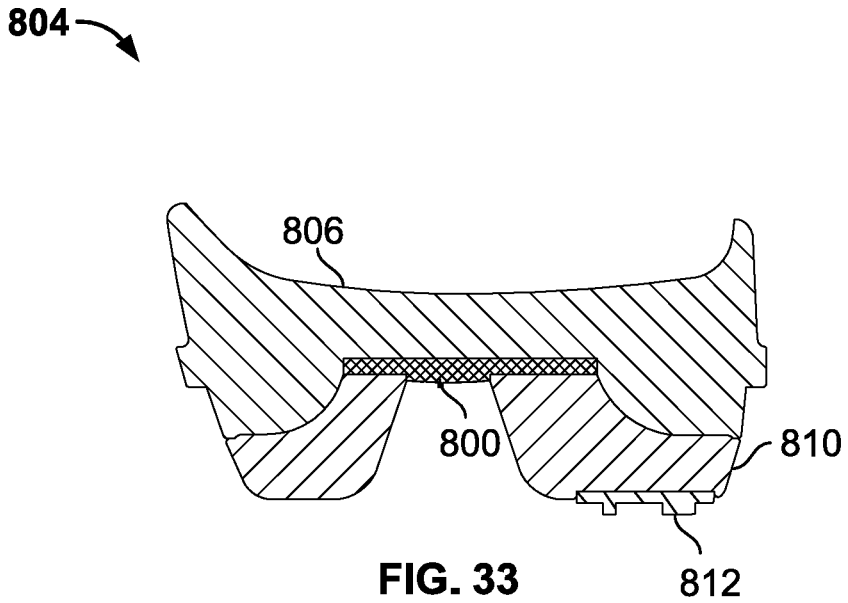
FIG. 33 is a cross-sectional view of the sole structure of FIG. 28 taken along line 33-33 of FIG. 29.
Figure 34:
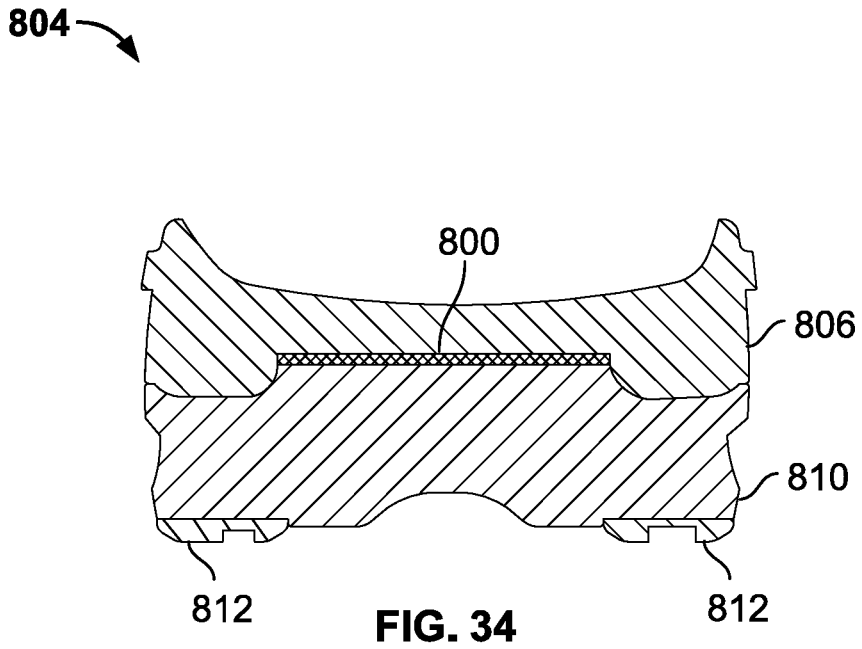
FIG. 34 is a cross sectional view of the sole structure of FIG. 28 taken along line 34-34 of FIG. 29.
Figure 35:
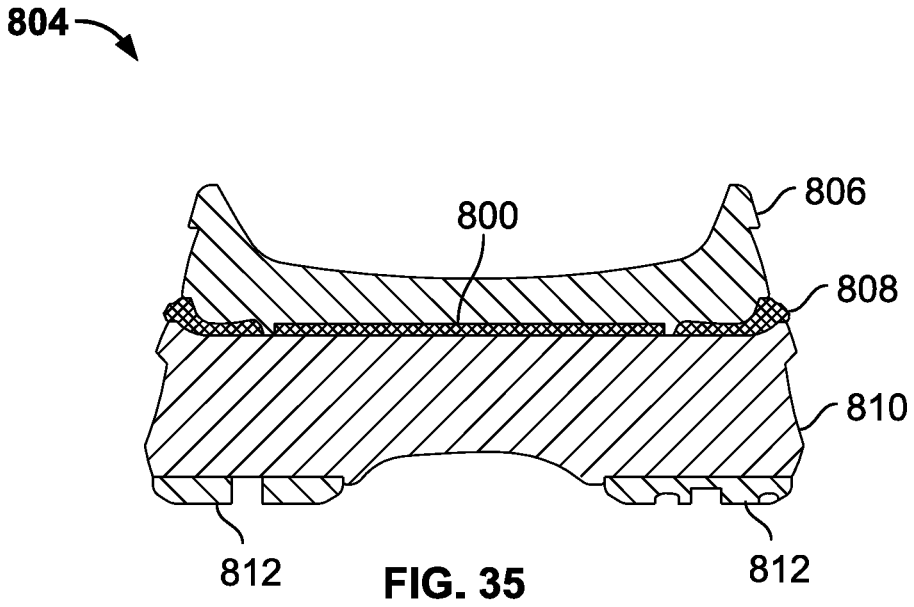
FIG. 35 is a cross-sectional view of the sole structure of FIG. 28 taken along line 35-35 of FIG. 29.

With reference to FIG. 30, the plate 800 may also include a curved portion 816 that extends through the forefoot region and the midfoot region of the article of footwear 802, and a flat region 814 that extends through the heel region of the article of footwear 802 to the second end 828. The flat region 814 is substantially flat, such that the flat region 814 is approximately within ten degrees or five degrees horizontal to a ground surface, when the plate 800 is positioned within the article of footwear 802.

Similar to the plate 170, the toe segment portion 818 and the curved portion 816 may include one or more radii of curvature. For example, in this embodiment, the curved portion 816 may be angled similar to the posterior curved portion 256 and the toe segment portion 818 may be angled similar to the medial curved portion 256 and/or the posterior curved portion 260. The toe segment portion 818 and the curved portion 816 may each be defined by a length, such as a length L7 or L8, respectively, and an angle, such as the angles A1, A2, and/or A3, as previously discussed herein. The rear segment 814 may also be defined by a length L9, similar to the length L5.

As previously discussed herein, a portion of or the entirety of plate 800, or the plates 170, 406, 454, 504, 604, 704, may be formed of densified would. In some embodiments, the plate 800, or the plates 170, 406, 454, 504, 604, 704, may be formed from a composite of densified wood and a thermoplastic material, such as a thermoplastic polyurethane, a thermoplastic elastomer, a thermoplastic olefin, or the like. In particular embodiments, however, the plate 800, or the plates 170, 406, 454, 504, 604, 704, may be formed from a composite or one or more layers of densified wood together with fibers, such as carbon fibers, aramid fibers, boron fibers, glass fibers, and polymer fibers, or a combination thereof. In these embodiments, the densified wood and/or fibers may be affixed or bonded to a substrate or a thermoplastic material, e.g., a thermoplastic polyurethane, a thermoplastic polyolefin, or a thermoplastic elastomer, by stitching or an adhesive. In other embodiments, the plate 800, or the plates 170, 406, 454, 504, 604, 704, may be formed from a unidirectional tape that includes densified wood, carbon fibers, aramid fibers, boron fibers, glass fibers, polymer fibers, or the like.

In some embodiments, the one or more materials of the plate 800, or the plates 170, 406, 454, 504, 604, 704, may have a stiffness (e.g., a tensile strength) defined by a Young's modulus. For example, in particular embodiments, the one or more materials forming the plate 800, or the plates 170, 406, 454, 504, 604, 704, may have a Young's modulus of at least about 25 gigapascals (GPa), at least about 40 GPa, or at least about 70 GPa, or at least about 85 GPa, or at least about 200 GPa. In further embodiments, the one or more materials forming the plate 800 may have a Young's modulus between about 25 GPa and about 200 GPa, or between about 25 GPa and about 80 GPa, or between about 25 GPa and about 70 GPa, or between about 50 GPa and about 75 GPa. In some embodiments, the plate 800, or the plates 170, 406, 454, 504, 604, 704, and the stiffness thereof, may be selected and designed for a particular user. For example, a stiffness of the plate 800, or the plates 170, 406, 454, 504, 604, 704, may be selected based on the particular muscle strength, tendon flexibility, or joint flexibility of a user. In further embodiments, the stiffness of the plate 800, or the plates 170, 406, 454, 504, 604, 704, may vary, such that a portion of the plate 800, or the plates 170, 406, 454, 504, 604, 704, is stiffer compared to another portion thereof, as previously discussed herein. In some embodiments, a portion of or the entire plate 800, or the plates 170, 406, 454, 504, 604, 704, are formed from densified wood with a Young's modulus of at least at least 10.0 GPa, at least 12.0 GPa, at least 15.0 GPa, at least 20.0 GPa, at least 25.0 GPa, at least 30.0 GPa, at least 40.0 GPa, at least 50.0 GPa, or at least 55.0 GPa.

The plate 800, or the plates 170, 406, 454, 504, 604, 704, may also include a uniform thickness or substantially uniform thickness between about 0.5 millimeters (mm) and about 3.0 mm, or between about 0.5 mm and about 2.0 mm, or between about 0.7 mm and about 1.0 mm. In other embodiments, the plate 800, or the plates 170, 406, 454, 504, 604, 704, may have a non-uniform thickness or a thickness that varies across the plate 800, or across the plates 170, 406, 454, 504, 604, 704, as previously discussed herein.

Looking to FIGS. 30-35, the plate 800 may be adjacent to and positioned between the upper midsole cushioning member 806 and the lower midsole cushioning member 810. The upper midsole cushioning member 806 may include a recessed portion into which the plate 800 may fit or be seated, such that the upper midsole cushioning member 806 at least partially encases the plate 800. Portions of the lower cushioning member 810 may also extend into the recessed portion of the upper cushioning member 806 (see FIG. 34, for example).

The upper midsole cushioning member 806 and/or the lower midsole cushioning member 810 may be constructed from EVA, TPU, TPE, combinations thereof, or a similar type of material. For example, in some embodiments, the upper cushioning member 806 and/or the lower cushioning member 810 may be an ESS material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. The upper midsole cushioning member 806 and/or the lower midsole cushioning member 810 may be a single polymeric material or may be a blend of materials, such as an EVA copolymer, a thermoplastic polyurethane, a polyester block amide (PEBA) copolymer, and/or an olefin block copolymer. Further, the upper cushioning member 806 and/or the lower midsole cushioning member 810 may also be formed from a supercritical foaming process that uses a supercritical gas, e.g., $CO_2$, $N_2$, or mixtures thereof, to foam a material, e.g., EVA, TPU, TPE, or mixtures thereof. In such embodiments, the upper midsole cushioning member 806 and/or the lower midsole cushioning member 810 may be manufactured using a process that is performed in an autoclave, an injection molding apparatus, or any sufficiently heated/pressurized container that can process the mixing of a supercritical fluid (e.g., $CO_2$, $N_2$, or mixtures thereof) with a material (e.g., TPU, EVA, polyolefin elastomer, or mixtures thereof) that is preferably molten. For example, in an exemplary process, a solution of supercritical fluid is mixed with a molten material. This mixture is pumped or injected into a pressurized container, after which the pressure within the container is released, such that the molecules of the supercritical fluid rapidly convert to gas to form small pockets within the material and cause the material to expand into a foam, which may be used as the upper midsole cushioning member 806 and/or the lower midsole cushioning member 810. In further embodiments, the upper midsole cushioning member 806 and/or the lower midsole cushioning member 810 may be formed using alternative methods known in the art, including the use of an expansion press, an injection machine, a pellet expansion process, a cold foaming process, a compression molding technique, die cutting, or any combination thereof. In particular embodiments, the upper midsole cushioning member 806 and/or the lower midsole cushioning member 810 may be formed using a process that involves an initial foaming step, during which supercritical gas is used to foam a material, and a second step, during which the foamed material is compression molded or die cut to a particular shape. For example, the upper midsole cushioning member 806 and/or the lower midsole cushioning member 810 may be formed using a process that involves an initial foaming process that uses a supercritical fluid to foam a material, and then a second step that compression molds the foamed material to form the recessed surfaces of the upper midsole cushioning member 806.

In even further embodiments, the upper midsole cushioning member 806 and/or the lower midsole cushioning member 810 may be a bladder encasing a plurality of beads or pellets formed from thermoplastic polyurethane, a thermoplastic elastomer, or a supercritical foam. For example, the upper midsole cushioning member 806 and/or the lower midsole cushioning member 810 may define an interior void (not shown) that receives a pressurized fluid or a plurality of beads or pellets, such as the hollow space filled with a number of plastic bodies described in PCT Publication No. WO 2017/097315, filed on Dec. 7, 2015, and as noted above.

Similar to the heel support collar 174 of the sole structure 104, the sole structure 804 may also include a heel support collar 808. The heel support collar 808 may be formed from a thermoplastic material, such as a thermoplastic polyurethane, a thermoplastic elastomer, a thermoplastic olefin, or the like. Further, in particular embodiments, the heel support collar 808 may have a hardness between about ten (10) Shore A to about ninety (90) Shore A. In some embodiments, the heel support collar 808 may have a hardness or stiffness value greater than a hardness or stiffness value of the upper midsole cushioning member 806 and/or the lower midsole cushioning member 810.

Figure 36:
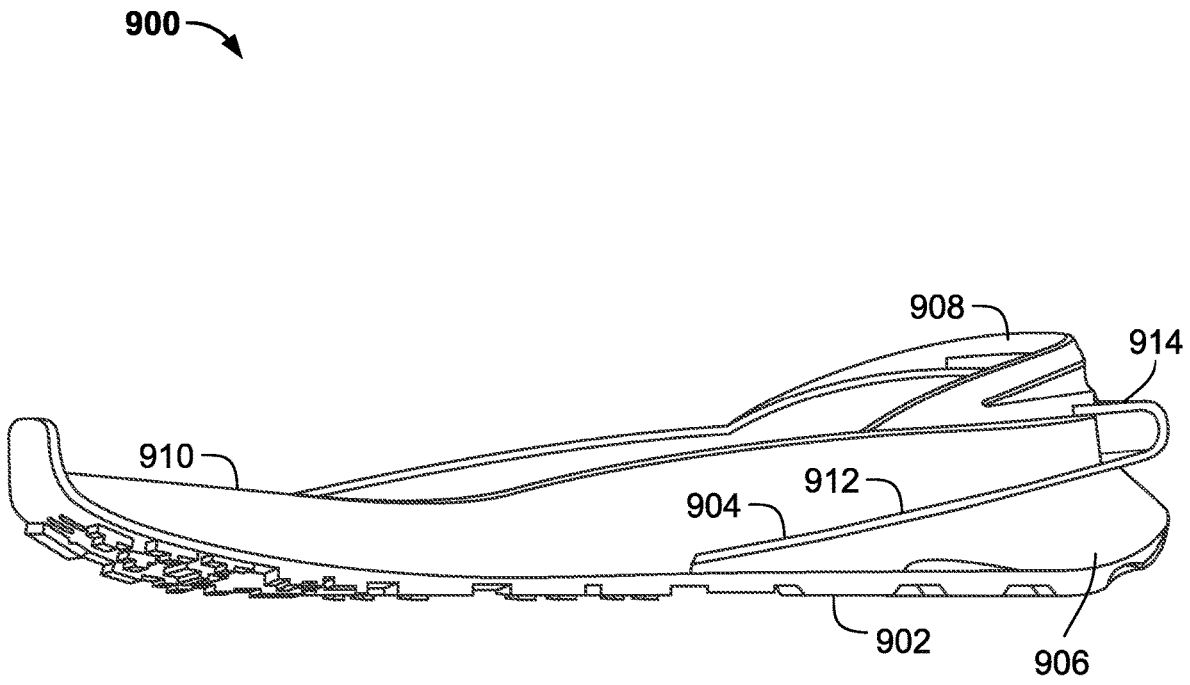
FIG. 36 is a perspective view of another sole structure for an article of footwear.
Figure 37:
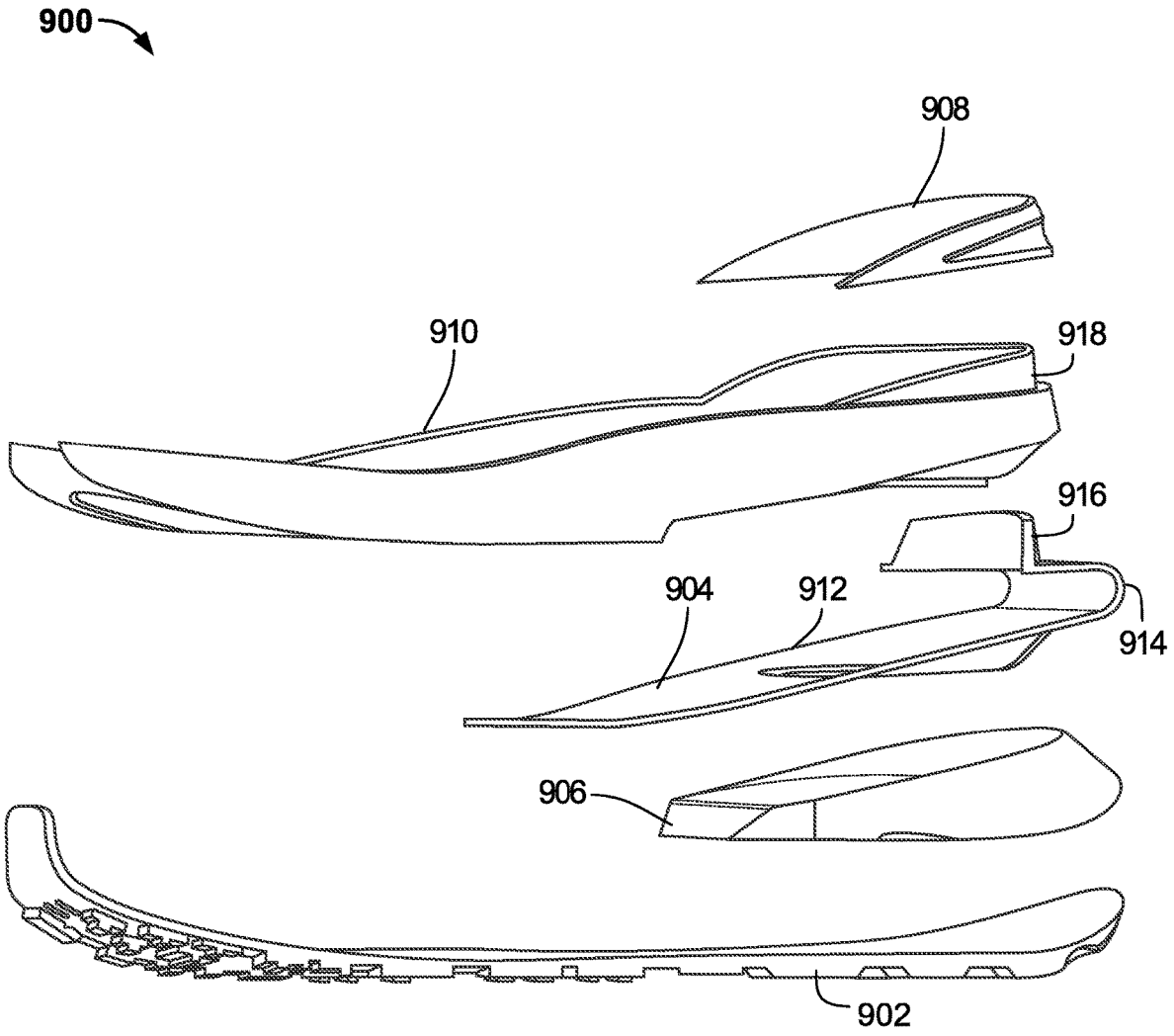
FIG. 37 is an exploded, perspective view of the sole structure of FIG. 36.
Figure 38:
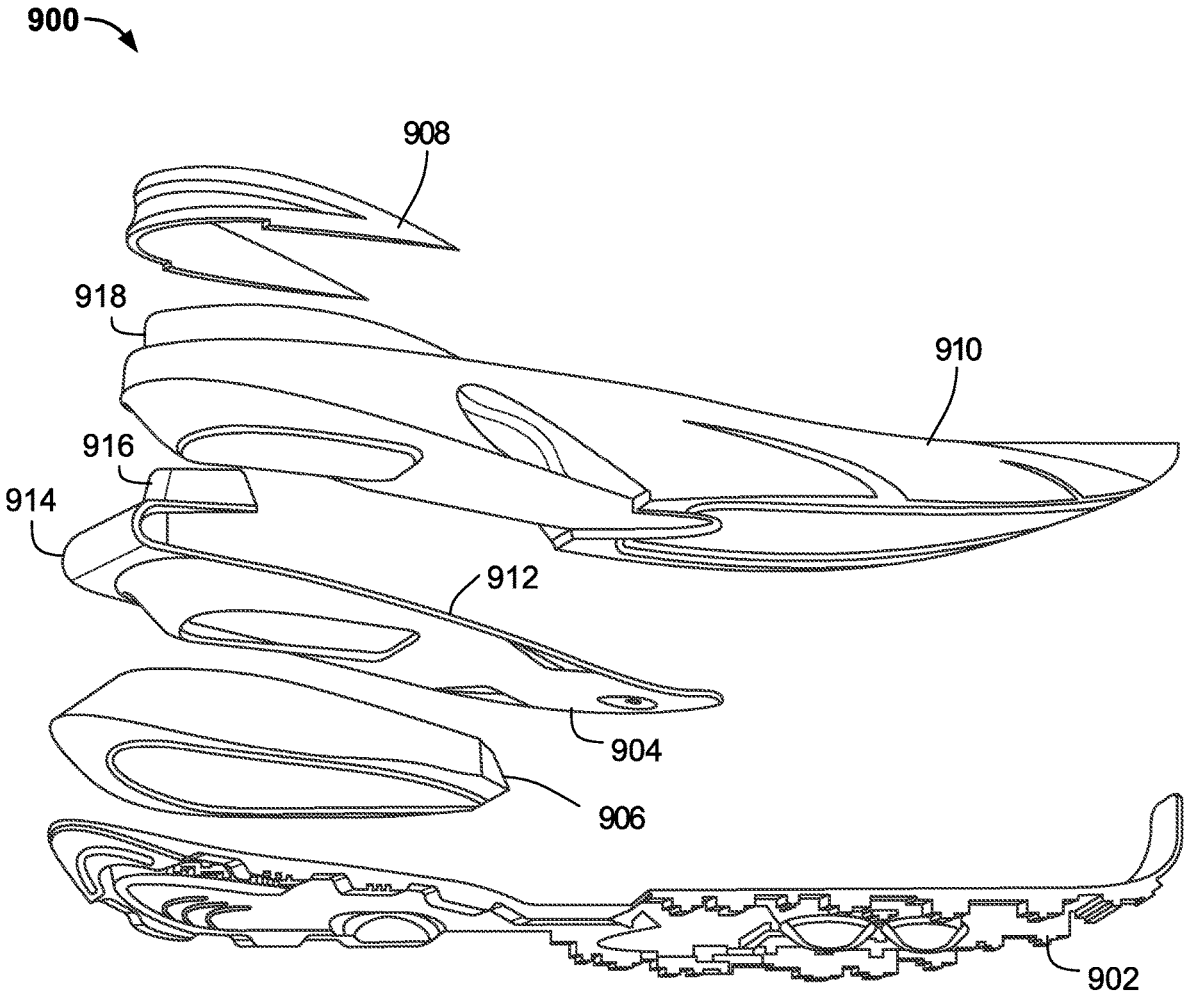
FIG. 38 is an exploded, bottom perspective view of the sole structure of FIG. 36.

FIGS. 36-38 depict another sole structure 900 for an article of footwear. In this embodiment, the sole structure 900 includes an outsole 902, a plate 904, a heel cushioning member 906, a heel support collar 908, and a midsole cushioning member 910.

In this embodiment, the plate 904 may include a lower base portion 912 with a slope having an angle between about 10 degrees and 45 degrees or between about 20 degrees and about 30 degrees. In other words, relative to a horizontal plane, the lower base portion 912 of the plate 904 slopes upwards as it extends toward a heel region of the sole structure 900. The plate may also include an arched, curved, or C-shaped rear portion 914 that connects the lower base portion 912 to an upwardly extending flange 916. The midsole cushioning member 910 may also include an upwardly extending sidewall 918 and the upwardly extending flange 916 may wrap around the sidewall 918 when the sole structure 900 is assembled, as shown in FIG. 36. Further, once the sole structure 900 is assembled, the heel support collar 908 may wrap around the flange 916 of the plate 904. Therefore, in these embodiments, a portion of the plate 904 may be positioned both above and below the midsole cushioning member 910 at a particular location along the sole structure 900. For example, near a heel region of the sole structure 900, the base portion 912 of the plate 904 is positioned below the midsole cushioning member 910 and the flange 916 of the plate 904 is positioned above the midsole cushioning member 910.

As previously discussed herein, a portion of or the entire plate 904 may be formed from densified wood. In some embodiments, the plate 904 may be formed from a composite of densified wood and a thermoplastic material, such as a thermoplastic polyurethane, a thermoplastic elastomer, a thermoplastic olefin, or the like. In essence, the plate 904 may be constructed from similar materials and have similar properties as the plates 170, 406, 454, 504, 604, 704, 800 previously discussed herein.

The midsole cushioning member 910 may be constructed from similar materials to the midsole cushioning member 176. For example, the midsole cushioning member may be constructed or composed of EVA, TPU, TPE, combinations thereof, or a similar type of material. Further, as previously described herein, the midsole cushioning member 910 may also be formed from a supercritical foaming process that uses a supercritical gas, e.g., $CO_2$, $N_2$, or mixtures thereof, to foam a material, e.g., EVA, TPU, TPE, or mixtures thereof. In even further embodiments, the midsole cushioning member 910 may be a bladder encasing a plurality of beads, such as a plurality of spherical or ellipsoidal beads or pellets formed from thermoplastic polyurethane, a thermoplastic elastomer, or a supercritical foam. For example, the midsole cushioning member 910 may define an interior void (not shown) that receives a pressurized fluid or a plurality of ellipsoidal or spherical beads, such as the hollow space filled with a number of plastic bodies, as previously described herein.

In this embodiment, the sole structure 900 may also include the heel cushioning member 906, which may be positioned adjacent to and on top of the outsole 902 in the heel region and partially in the midfoot region. Put differently, the heel cushioning member 906 may be adjacent to the outsole 902, and may extend from the heel end of the sole structure 900, through the heel region, and partially through the midfoot region. The heel cushioning member 906 may be constructed from Ethylene-vinyl acetate (EVA), copolymers thereof, or a similar type of material. For example, in some embodiments, the heel cushioning member 906 may be an EVA-Solid-Sponge ("ESS") material, an EVA foam (e.g., PUMA® ProFoam Lite™, IGNITE Foam), polyurethane, polyether, an olefin block copolymer, a thermoplastic material (e.g., a thermoplastic polyurethane, a thermoplastic elastomer, a thermoplastic polyolefin, etc.), or a supercritical foam. The heel cushioning member 906 may be a single polymeric material or may be a blend of materials, such as an EVA copolymer, a thermoplastic polyurethane, a polyether block amide (PEBA) copolymer, and/or an olefin block copolymer. In even further embodiments, the heel cushioning member 906 may be a bladder encasing a plurality of beads or pellets, such as a plurality of spherical, ellipsoidal, or other shaped beads or pellets formed from thermoplastic polyurethane, a thermoplastic elastomer, or a supercritical foam. For example, the heel cushioning member 906 may define an interior void (not shown) that receives a pressurized fluid or a plurality of ellipsoidal, spherical, or other shaped beads or pellets, as previously described herein.

Similar to the heel support collar 174, the sole structure 900 may also include a heel support collar 908 positioned above the midsole cushioning member 900. The heel support collar 908 may be formed from a thermoplastic material, such as a thermoplastic polyurethane, a thermoplastic elastomer, a thermoplastic olefin, or the like.

FIGS. 39-45 provide a sole structure 1000, according to another embodiment of the present disclosure. Although FIGS. 39-45 only depict a sole structure 1000, it should be appreciated by those skilled in the art that a top surface 1014 of the sole structure 1000 may be connected to an upper, such as the upper 102, to form an article of footwear. Therefore, aspects of the upper 102 in combination with the sole structure 1000 is anticipated and the upper 102 may be attached to the sole structure 1000 and together with the sole structure 1000 may define an interior cavity into which a foot may be inserted.

In the embodiment depicted in FIGS. 39-45, the sole structure 1000 includes a sole plate 1002 comprised of a top surface 1014, a bottom surface 1016, and including one or more protruding portions 1004, 1010 extending down from the bottom surface 1016. The protruding portions 1004, 1010 of the sole plate 1002 are configured for reversible or irreversible attachment of studs 1006, 1012 thereto. The studs 1006, 1012 attached to the sole plate are confirmed to engage, and partially insert into, a ground surface when worn by the user. The sole plate 1002 may include additional structural features, for example, ridges 1008 or flex grooves 1018, 1020 to support or modify the structure, flexibility, or rigidity of the sole plate 1002. While only a single sole structure 1000 is depicted, i.e., a sole structure for an article of footwear that is worn on a right foot of a user, it should be appreciated that the concepts disclosed herein are applicable to a pair of shoes (not shown), which includes a left shoe and a right shoe that may be sized and shaped to receive a left foot and a right foot of a user, respectively. For ease of disclosure, however, a single shoe will be referenced to describe aspects of the disclosure, but the disclosure herein with reference to the sole structure 1000 is applicable to both a left shoe and a right shoe.

Many shapes and configurations of the protruding portions 1004, 110 and the studs 1006, 1012 are known in the art and may be optimized to the wearer, to the ground surface, or to the type of activity for which the article of footwear will be used. In some embodiments, the sole plate 1002 includes at least 1, at least 2, at least 3, at least 4, at least 5, at least 6, at least 7, at least 8, at least 9, at least 10, at least 12, at least 15, at least 18, at least 20, at least 25, at least 30, or at least 40 protruding portions 1006, 1012 and studs attached thereto. In some embodiments, the stud 1006, 1012 may be a cylindrical, conical, prismatic, or bladed shape. Likewise, the studs may be formed from any suitable material, including but not limited to rubber, metal, or a thermoplastic material, such as a thermoplastic polyurethane, a thermoplastic elastomer, a thermoplastic olefin, or the like. The studs 1006, 1012 may be attached to the sole plate 1002 through the protruding portion 1004, 1010 by any means known in the art, including, but not limited to, adhesive or interlocking threads.

In some embodiments, the sole plate 1002 may be configured such that the protruding portion itself (not shown) acts as the stud and is configured to engage with, and partially insert into, a ground surface. The sole plate 1002 may include at least 1, at least 2, at least 3, at least 4, at least 5, at least 6, at least 7, at least 8, at least 9, at least 10, at least 12, at least 15, at least 18, at least 20, at least 25, at least 30, or at least 40 protruding portions that are configured to directly engage with the ground surface without a separate stud attached.

The sole plate 1002 may be formed from densified wood or densified wood panels formed from chemically treating natural wood to remove lignin or hemicellulose therefrom, or compressing natural wood, as described herein. In some embodiments, the sole plate 1002 may be formed from a composite of densified wood and a thermoplastic material, such as a thermoplastic polyurethane, a thermoplastic elastomer, a thermoplastic olefin, or the like. In some embodiments the sole plate 1002 may be formed from a composite of densified wood and one or more fibers, such as carbon fibers, aramid fibers, boron fibers, glass fibers, natural fibers, and polymer fibers, or a combination thereof. In these embodiments, the densified wood and/or fibers may be affixed or bonded to a substrate or a thermoplastic material, e.g., a thermoplastic polyurethane, a thermoplastic polyolefin, or a thermoplastic elastomer, by stitching or an adhesive. In other embodiments, the sole plate 1002 may be formed from a unidirectional tape that includes densified wood, carbon fibers, aramid fibers, boron fibers, glass fibers, polymer fibers, or the like. In other embodiments, the sole plate 1002 may be formed from a composite with at least one layer of densified wood.

In some embodiments, the one or more materials of the sole plate 1002 may have a stiffness (e.g., a tensile strength) defined by a Young's modulus. For example, in particular embodiments, the one or more materials forming the sole plate 1002 may have a Young's modulus of at least about 25 gigapascals (GPa), at least about 40 GPa, or at least about 70 GPa, or at least about 85 GPa, or at least about 200 GPa. In further embodiments, the one or more materials forming the plate 170 may have a Young's modulus between about 25 GPa and about 200 GPa, or between about 25 GPa and about 80 GPa, or between about 25 GPa and about 70 GPa, or between about 50 GPa and about 75 GPa.

In some embodiments, a portion of or the entire sole plate 1002 is formed from densified wood with a Young's modulus of between about 10 GPa and about 70 GPa, between about 12 GPa and about 60 GPa, between about 18 GPa and about 58 GPa, between about 25 GPa and about 55 GPa, or between about 35 GPa and about 50 GPa. In some embodiments, a portion of or the entire plate 170 is formed from densified wood with a Young's modulus of at least 10 GPa, at least 12 GPa, at least 15 GPa, at least 20 GPa, at least 25 GPa, at least 30 GPa, at least 40 GPa, at least 50 GPa, or at least 55 GPa.

In some embodiments, the sole plate 1002, and the stiffness thereof, may be selected and designed for a particular user. For example, a stiffness of the sole plate 1002 may be selected based on the particular muscle strength, tendon flexibility, or joint flexibility of a user. In further embodiments, the stiffness of the sole plate 1002 may vary, such that a portion of the sole plate 1002 is stiffer compared to another portion of the sole plate 1002. In alternative embodiments, the stiffness of the sole plate 1002 may be uniform and constant.

In some embodiments, the stiffness of the sole plate 1002 may be altered by increasing or decreasing the number of layers of densified wood therein. In some embodiments, certain regions of the sole plate 1002 may include more layers of densified wood to increase stiffness. In some embodiments, the stiffness of the sole plate 1002 may be altered by combining the densified wood with one or more additional materials to achieve the desired stiffness.

The sole plate 1002 may also include a uniform thickness or substantially uniform thickness between about 0.5 millimeters (mm) and about 3.0 mm, or between about 0.5 mm and about 2.0 mm, or between about 0.7 mm and about 1.0 mm. In other embodiments, the sole plate 1002 may have a non-uniform thickness or a thickness that varies across the sole plate 1002.

Densified wood may also be used in sporting-goods structures other than footwear. Some non-limiting examples of structures that may comprise densified wood include pads, guards, gloves, studs and spikes for cleats, clubs, rackets, bats, drinking bottles, skis and snowboards, ski rods/sticks, protective mobile device covers, watches, helmets, other headgear, skateboards, ice skates, goal posts, javelins, bicycle frames, bicycle pedals/seats, and watersport fins.

For example, shin guards, such as those worn by soccer players/hockey players, may comprise densified wood. As another example, gloves (especially reinforced gloves), may comprise densified wood. In an embodiment, reinforced gloves have finger supports or "finger safe" elements that comprise densified wood.

Figure 49:
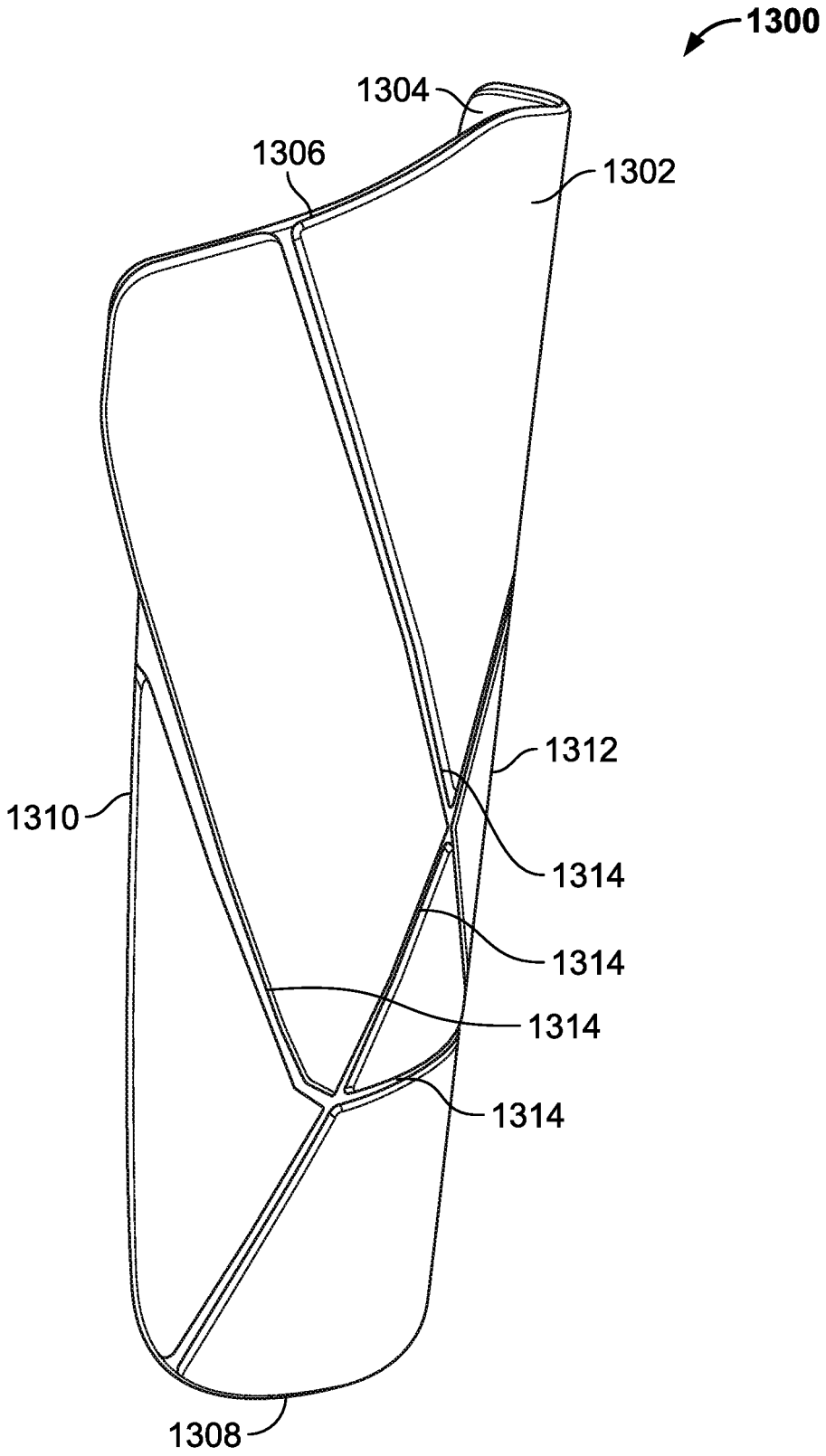
FIG. 49 is a front, perspective view of a sporting-goods structure configured as a shin guard that includes a front surface and a rear surface.

Referring now to FIG. 49, a front view of a shin guard 1300 is shown, The shin guard 1300 has a front surface 1302, a rear surface 1304, a top edge 1306, a bottom edge 1308, a first lateral edge 1310, and a second lateral edge 1312. The front surface 1302 and the rear surface 1304 define the thickness of the shin guard 1300. The top edge 1306 and the bottom edge 1308 define the height of the shin guard 1300. The first lateral edge 1310 and the second lateral edge 1312 define the width of the shin guard 1300.

The front surface 1302 and the rear surface 1304 may define a curve, such that the shin guard 1300 is substantially convex in shape. The slope of the curve defined by the front surface 1302 and the rear surface 1304 may change as the curve travels along the width of the shin guard 1300. Additionally or alternatively, the slope of the curve may change as the curve travels along the height of the shin guard 1300. In the embodiment shown in FIG. 49, the slope of the curve defined by the front surface 1302 and the rear surface 1304 is greater proximate to the lateral edges 1310 and 1312 than it is proximate to the center of the width of the shin guard 1300. In some embodiments, the curve may have a greater slope proximate to the center of the shin guard. In some embodiments, the curve may be consistent across the length or width of the shin guard.

Referring again to FIG. 49, the shin guard 1300 has a width that is greater proximate to the top edge 1306 than proximate the bottom edge 1308. Further, the width of the shin guard 1300 approximately half-way between the top edge 1306 and the bottom edge 1308 is less than the width of the shin guard 1300 proximate the top edge 1306, but is substantially the same as the width of the shin guard 1300 proximate the bottom edge 1308. In some embodiments, the change in width of the shin guard can be substantially consistent across the height of the shin guard. In some embodiments, the width of the shin guard may change across the height of the shin guard, even though the width proximate the top end is approximately the same as the width proximate the bottom end. In some embodiments, the width of the shin guard may be substantially consistent along the entire height of the shin guard.

The shin guard 1300 may have any height and width suitable for use with a human shin. In some embodiments, the height, width, and shape of the shin guard are selected to complement the human shin, such that the shin guard does not interfere with the natural operation of the human ankle and/or the human knee, when worn. In some embodiments, the convex curvature of the shin guard, defined by the front surface and the rear surface, may be substantially the same as that of a human shin.

Referring again to FIG. 49, the shin guard 1300 has flex grooves 1314 on its front surface 1302. The thickness of the shin guard 1300 is less in the space occupied by the flex grooves 1314 than it is throughout the portions of the shin guard not occupied by the flex grooves 1314. The flex grooves 1314 provide the shin guard 1300 with the ability to bend more easily. Beneficially, this may allow the shin guard 1300 to better fit the wearer's shin. Additionally, the flex grooves 1314 may allow the shin guard 1300 to elastically deform under tension or compression, which may beneficially allow the shin guard 1300 to better absorb impacts, dissipate energy, and/or change shape as necessary during use. The flex grooves 1314 may be made by any suitable process. For example, the flex grooves 1314 may be carved into the front surface 1302 after the front surface 1302 is produced. Alternatively, the flex grooves 1314 may be formed at the same time as the rest of the shin guard 1300, for example through a molding process. There may be aesthetic value in having the flex grooves 1314 disposed on the front surface 1302 of the shin guard 1300, as the flex grooves 1314 may be visible during use.

The shin guard 1300 may comprise densified wood or densified wood panels, formed from chemically treating natural wood to remove lignin or hemicellulose therefrom, or compressing natural wood, as described herein. In some embodiments, the shin guard 1300 may comprise a composite of densified wood and a thermoplastic material, such as a thermoplastic polyurethane, a thermoplastic elastomer, a thermoplastic olefin, or the like. In some embodiments the shin guard 1300 may comprise a composite of densified wood and one or more fibers, such as carbon fibers, aramid fibers, boron fibers, glass fibers, natural fibers, and polymer fibers, or a combination thereof. In these embodiments, the densified wood and/or fibers may be affixed or bonded to a substrate or a thermoplastic material, e.g., a thermoplastic polyurethane, a thermoplastic polyolefin, or a thermoplastic elastomer, by stitching or an adhesive. In other embodiments, the shin guard 1300 may comprise a unidirectional tape that includes carbon fibers, aramid fibers, boron fibers, glass fibers, polymer fibers, or the like. In other embodiments, the shin guard 1300 may comprise a composite with at least one layer of densified wood. In some embodiments, a shin guard may have two or more layers, wherein one or both layers comprise densified wood. In some embodiments, a shin guard may have three or more layers, wherein one or both layers comprise densified wood. In one embodiment, a shin guard may have two layers, wherein one layer comprises densified wood and the other layer comprises a material other than densified wood. In another embodiment, a shin guard may have three layers, wherein one layer comprises densified wood and the other two layers comprise materials other than densified wood. In some embodiments, at least the rear surface 1304 of the shin guard 1300 comprises material that incorporates aluminum and has anti-microbial or anti-odor properties. In an embodiment, the densified wood may incorporate aluminum.

In some embodiments, the one or more materials of the shin guard 1300 may have a stiffness (e.g., a tensile strength) defined by a Young's modulus. For example, in particular embodiments, the one or more materials forming the shin guard 1300 (such as densified wood) may have a Young's modulus of at least about 25 gigapascals (GPa), at least about 40 GPa, or at least about 70 GPa, or at least about 85 GPa, or at least about 200 GPa. In further embodiments, the one or more materials forming the shin guard 1300 may have a Young's modulus between about 25 GPa and about 200 GPa, or between about 25 GPa and about 80 GPa, or between about 25 GPa and about 70 GPa, or between about 50 GPa and about 75 GPa. In some embodiments, a portion of or the entire shin guard 1300 is formed from densified wood with a Young's modulus of between about 10 GPa and about 70 GPa, between about 12 GPa and about 60 GPa, between about 18 GPa and about 58 GPa, between about 25 GPa and about 55 GPa, or between about 35 GPa and about 50 GPa. In some embodiments, a portion of or the entire shin guard 1300 is formed from densified wood with a Young's modulus of at least 10.0 GPa, at least 12.0 GPa, at least 15.0 GPa, at least 20.0 GPa, at least 25.0 GPa, at least 30.0 GPa, at least 40.0 GPa, at least 50.0 GPa, or at least 55.0 GPa.

In some embodiments, the stiffness of the shin guard 1300 may be altered by increasing or decreasing the number of layers of densified wood therein. In some embodiments, certain regions of the shin guard 1300 may include more layers of densified wood to increase stiffness. In some embodiments, the stiffness of the shin guard 1300 may be altered by combining the densified wood with one or more additional materials to achieve the desired stiffness.

The shin guard 1300 may also include a uniform thickness or substantially uniform thickness between about 0.5 millimeters (mm) and about 3.0 mm, or between about 0.5 mm and about 2.0 mm, or between about 0.7 mm and about 1.0 mm. In other embodiments, the shin guard 1300 may have a non-uniform thickness or a thickness that varies across the shin guard 1300. For example, the thickness of the portion(s) of the shin guard 1300 proximate the first lateral edge 1310, the second lateral edge 1312, and the area between these portions (proximate the center of the width of the shin guard 1300) may be individually selected when the shin guard 1300 is formed. In particular embodiments, the thickness of the shin guard 1300 may be greater near the middle of the width of the shin guard 1300 than it is proximate the first lateral edge 1310 or the second lateral 1312.

Figure 50:
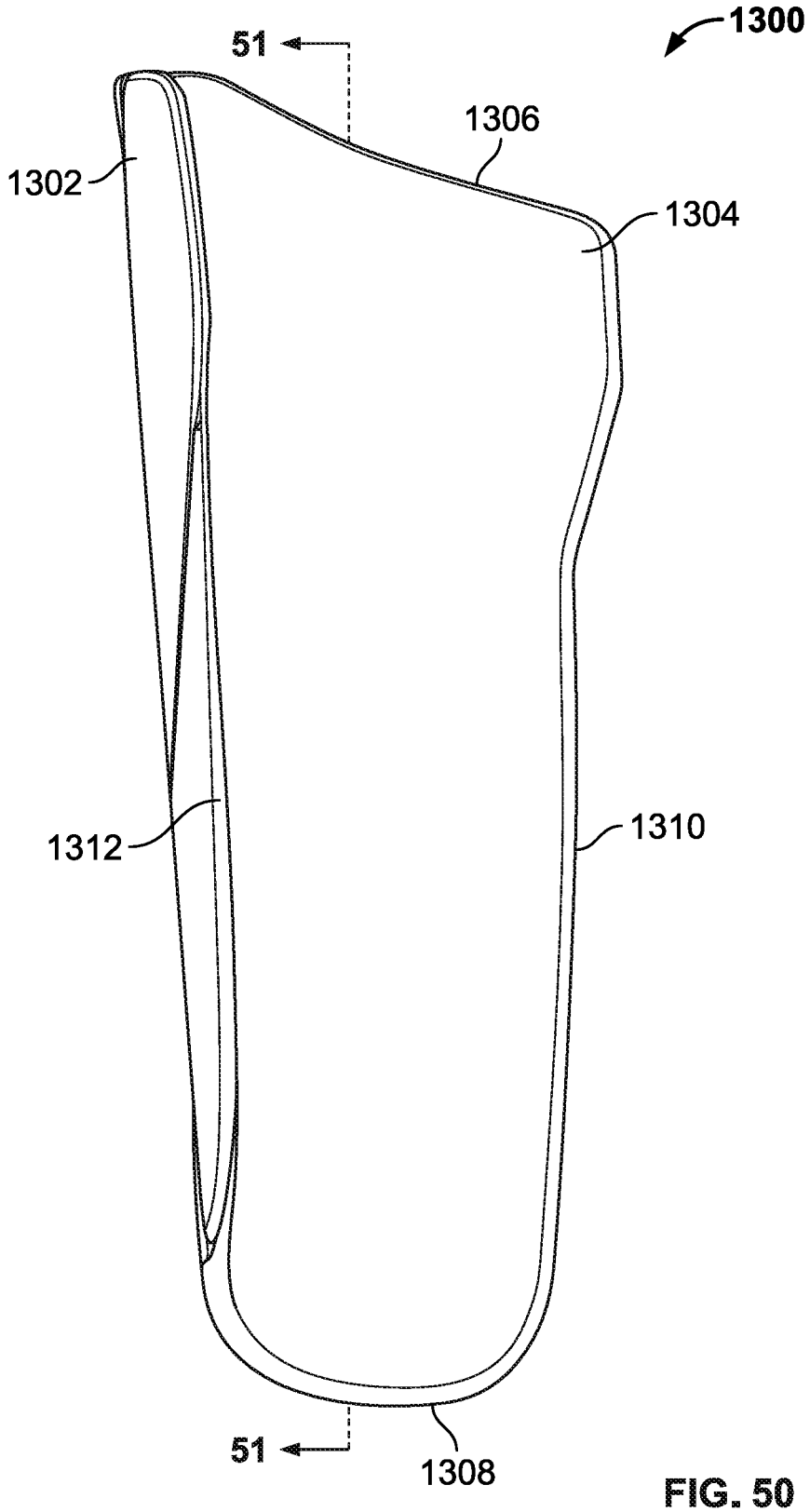
FIG. 50 is a rear, perspective view of the shin guard of FIG. 49.

Turning now to FIG. 50, a rear-view of the shin guard 1300, previously shown in FIG. 49, is shown. The rear surface 1304 of the shin guard 1300 has substantially the same convex shape, height, and width as the front surface 1302, shown in FIG. 49. In an embodiment, the rear surface 1304 may comprise the same material as the front surface 1302. In an embodiment, both the rear surface 1304 and the front surface 1302 may comprise densified wood. In an alternative embodiment, the rear surface 1304 may comprise a different material from the material(s) used to make the front surface 1302. In an embodiment, at least the rear surface 1304 comprises densified wood that incorporates aluminum and has anti-microbial or anti-odor properties. In an embodiment, the rear surface 1304 may comprise a cushioning material, such as a foam, a woven fabric, a nonwoven fabric, and/or a polymeric material. In an embodiment, the rear surface 1304 maybe comprise a cushioning material that incorporates aluminum and has anti-microbial or anti-odor properties. In the embodiment illustrated in FIG. 50, there are no flex grooves on the rear surface 1304.

Figure 51:
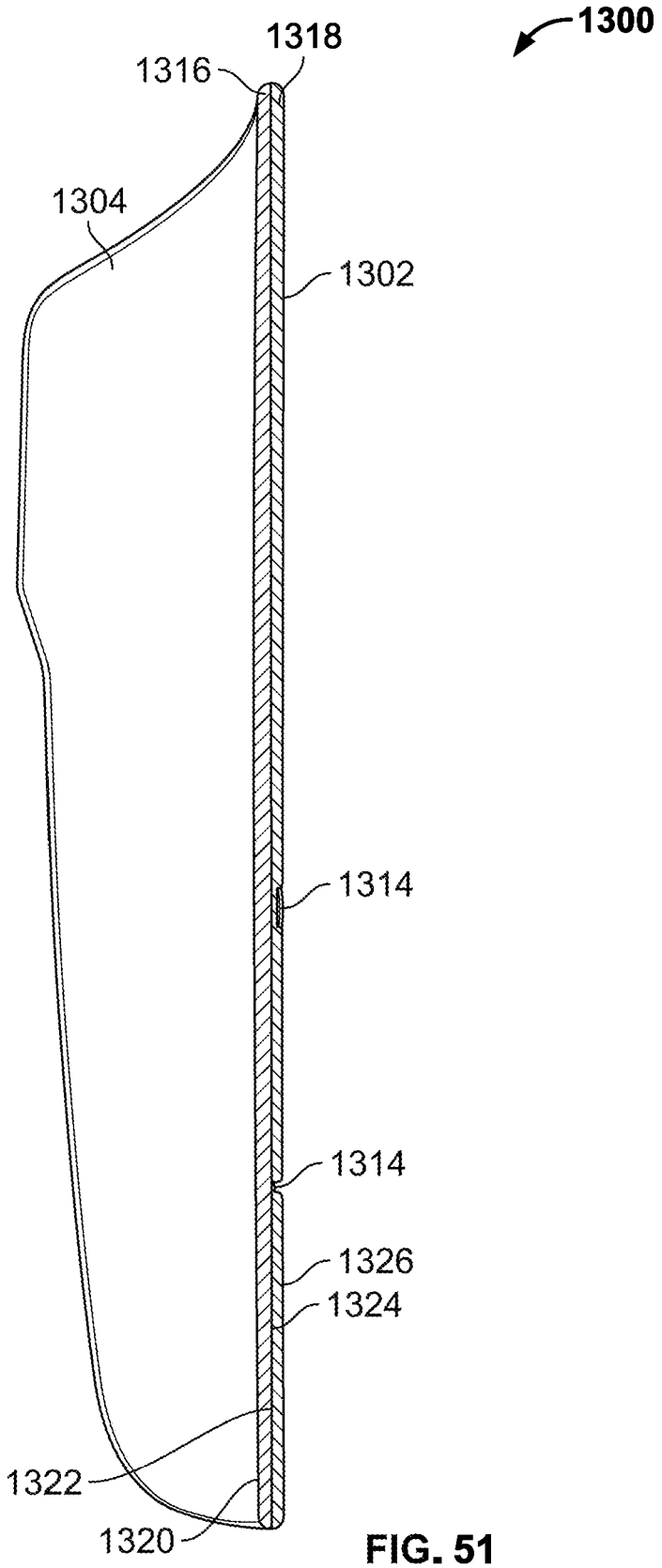
FIG. 51 is a cross-sectional side-view of the shin guard of FIG. 49 taken along line 51-51 of FIG. 50.

Turning to FIG. 51, a cross-sectional side-view of the shin guard 1300, previously shown in FIGS. 49 and 50 is shown. FIG. 51 illustrates that the shin guard 1300 has two layers, i.e., an inner layer 1316 and an outer layer 1318. The inner layer 1316 has an inner surface 1320 and an outer surface 1322. The outer layer 1318 has an inner surface 1324 and an outer surface 1326. The inner surface 1320 of the inner layer 1316 may be the same surface as rear surface 1304. Alternatively, additional layers or coatings may be disposed on inner surface 1320 of inner layer 1316, such that inner surface 1320 and rear surface 1304 are different surfaces. Similarly, the outer surface 1326 of the outer layer 1318 may be the same as the front surface 1302.

The outer layer 1318 directly contacts the inner layer 1316. In the embodiment illustrated in FIG. 51, inner layer 1316 and outer layer 1318 directly contact each other along substantially the entire length and the entire width of the shin guard 1300. In an alternative embodiment, the inner layer and outer layer directly contact each other along a portion of the length of the shin guard but not along the entire length of the shin guard. In another embodiment, the inner layer and outer layer directly contact each other along a portion of the width of the shin guard but not along the entire width of the shin guard.

The inner layer 1316 and the outer layer 1318 may comprise the same material(s). Alternatively, the inner layer 1316 and the outer layer 1318 may comprise different material(s). In an embodiment, one or both of the inner layer 1316 and the outer layer 1318 comprises densified wood. In some embodiments, the inner layer 1316 and/or the outer layer 1318 comprise material(s) that have a grain or an orientation. In some embodiments, the inner layer 1316 and/or the outer layer 1318 comprise densified wood that has a grain or an orientation. In FIG. 51, the grain of inner layer 1316 and the outer layer 1318 are indicated by slash markings. In an embodiment, the inner layer 1316 and/or the outer layer 1318 comprise densified wood having a grain or an orientation, the inner layer 1316 and outer layer 1318 positioned such that their grains/orientations are not aligned in parallel. In an embodiment, the inner layer 1316 and/or the outer layer 1318 comprise densified wood having a grain or an orientation, the inner layer 1316 and outer layer 1318 positioned such that their grains/orientations are aligned perpendicularly to one another. In an embodiment, the inner layer 1316 and/or the outer layer 1318 comprise densified wood having a grain or an orientation, the inner layer 1316 and outer layer 1318 positioned such that their grains/orientations are aligned at an angle that is neither parallel nor perpendicular to one another. In an embodiment, the inner layer 1316 and/or the outer layer 1318 comprise densified wood having a grain or an orientation, the inner layer 1316 and outer layer 1318 positioned such that their grains/orientations are aligned parallel to one another.

In an embodiment the shin guard 1300 comprises two layers, the inner layer 1316 and the outer layer 1318, wherein the inner layer 1316 comprises a cushioning material, such as a foam, a fabric, or a polymeric material, and the outer layer 1318 comprises densified wood. In an embodiment, a shin guard has an inner layer that comprises a cushioning material, an outer layer that comprises densified wood, and one or more additional layers disposed between the inner layer and the outer layer. In an embodiment, a shin guard has an inner layer that comprises a cushioning material, an outer layer that comprises densified wood, and one or more additional layers disposed on either side of the inner layer and the outer layer. It is further contemplated that some embodiments may comprise a combination of two or more of the embodiments described herein. In an embodiment, the inner layer 1316 may comprise a cushioning material that incorporates aluminum and/or other materials having anti-microbial or anti-odor properties.

In an embodiment, a shin guard may comprise only a single layer, wherein the single layer comprises densified wood. The layer of densified wood may have any dimensions suitable for use as a shin guard. The densified wood may further be mixed and/or coated with one or more additives. For example, in an embodiment the densified wood may have a polymeric coating that helps repel fluids or reduces damage to the densified wood. In an embodiment, the densified wood may be augmented with one or more fillers, in order to tailor its properties to the desired application. It is further contemplated that some embodiments may comprise a combination of two or more of the embodiments described herein.

Figure 52:
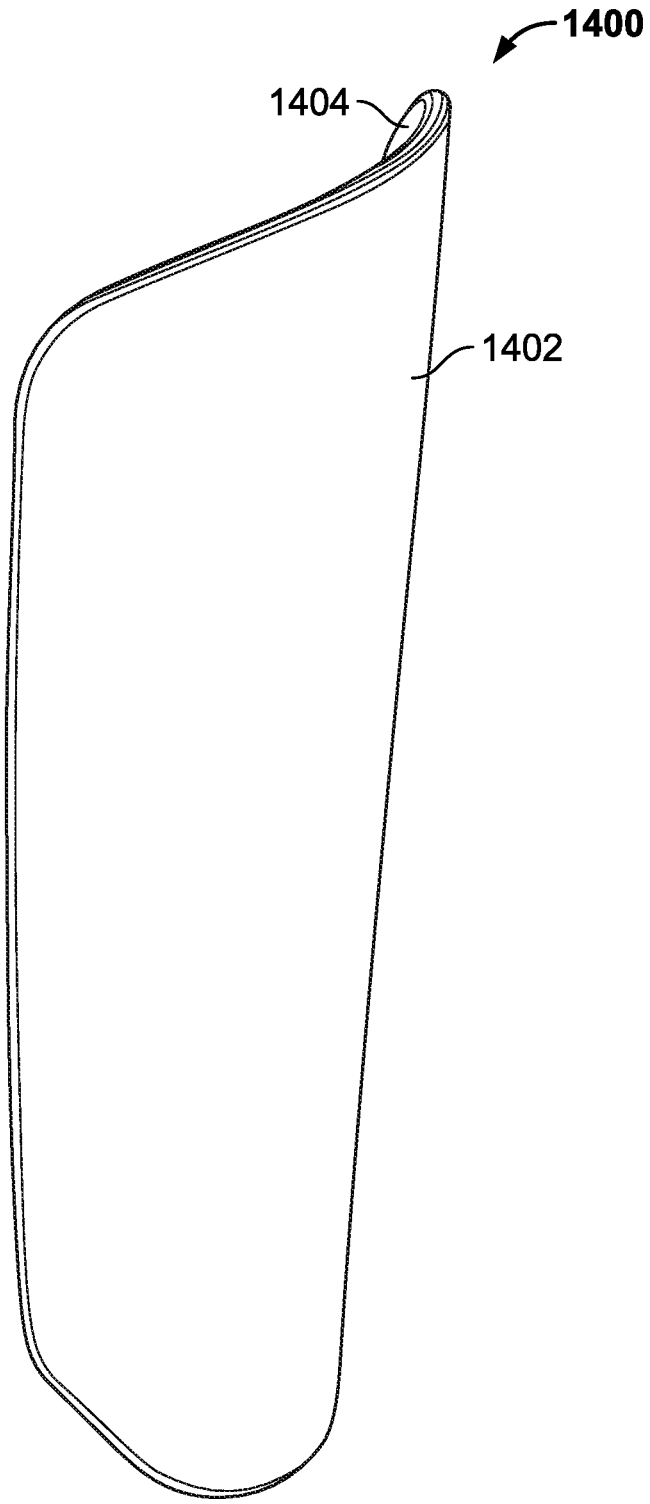
FIG. 52 is a front, perspective view of another shin guard.
Figure 53:
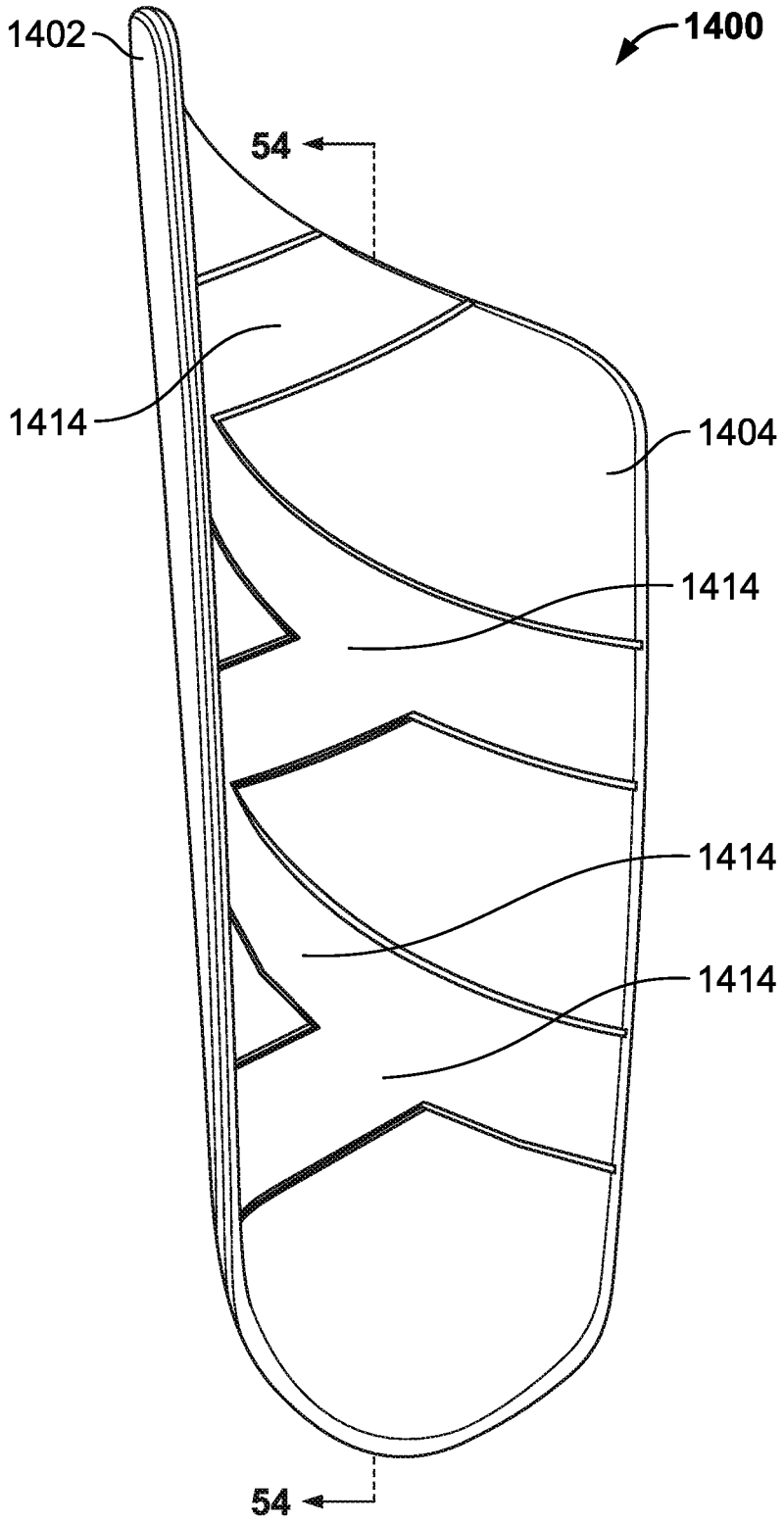
FIG. 53 is a rear, perspective view of the shin guard of FIG. 52.

FIGS. 52 and 53 show an embodiment of a shin guard 1400 that is similar to the shin guard 1300, shown in FIGS. 49-51, except that the shin guard 1400 has flex grooves 1414 disposed on its rear surface 1404, and does not have any flex grooves disposed on its front surface 1402. Beneficially, disposing flex grooves 1414 on the rear surface 1404 rather than front surface 1402 may allow front surface 1402 to be smooth across its entire surface area. This may make front surface 1402 easier to decorate. This may also make front surface 1402 more capable of accepting certain types of additives, which may be more difficult to combine with a textured surface. This may also make front surface 1402 easier to clean. At the same time, disposing flex grooves 1414 on the rear surface 1404 may provide shin guard 1400 with substantially the same flexibility and elastic deformation abilities as shin guard 1300, discussed above in reference to FIG. 49. Additionally, in the illustrated embodiment of FIG. 53, flex grooves 1414 have substantially different dimensions and a substantially different layout than flex grooves 1314. In other embodiments, flex grooves may have any dimensions and any layout suitable for use with a particular embodiment or a particular function.

In an embodiment, a shin guard of the present disclosure may have flex grooves disposed on its front surface as well as on its rear surface. In an alternative embodiment, a shin guard may not have any flex grooves disposed on either its front surface nor its rear surface. In an embodiment, at least a portion of a flex groove may comprise an opening that is transverse through the depth of the shin guard. Put another way, a portion of the flex groove may form a continuous hole through each of the front surface, the outer layer, the inner layer, and the rear surface.

The skilled artisan will recognize that embodiments of the disclosure may form part or all of other types of pads/guards. For example, some embodiments may form part or all of an elbow pad, a knee pad, a wrist pad, an ankle pad, a helmet, a chest pad, and/or a thigh pad. Additionally, some embodiments may form a glove or pair of gloves. A particular embodiment may form a glove or pair of gloves having finger support or "finger safe" elements.

Figure 54:
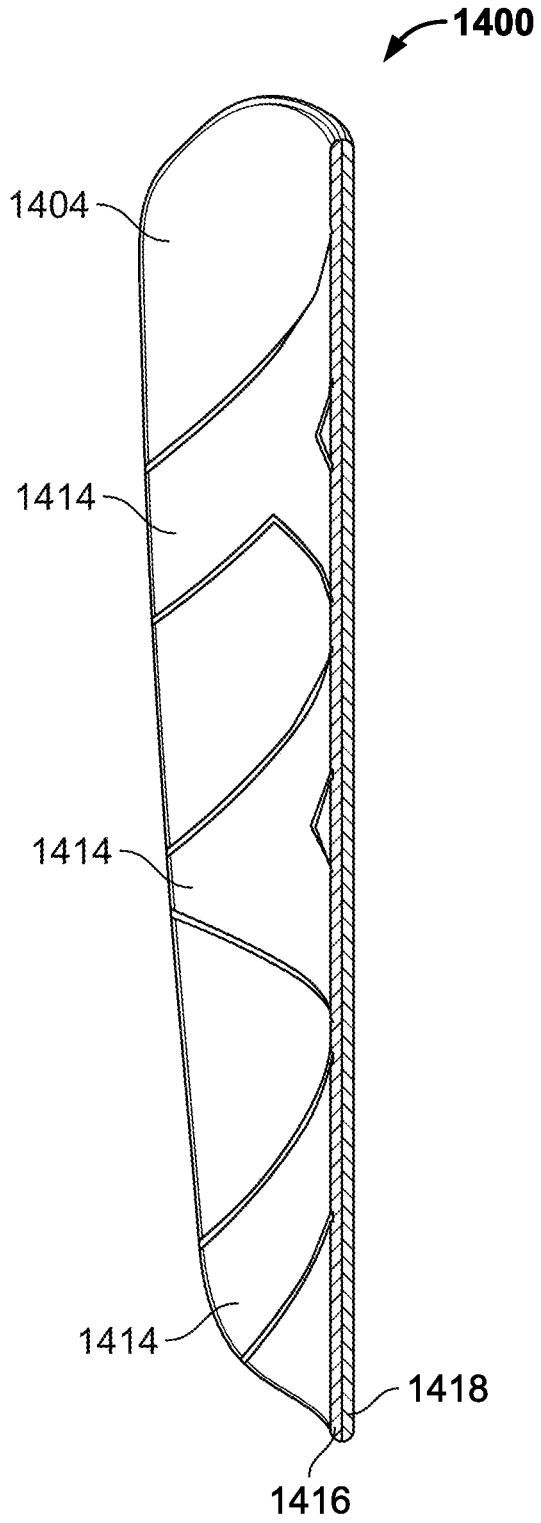
FIG. 54 is a cross-sectional side-view of the shin guard of FIG. 52 taken along line 54-54 of FIG. 53.

Referring to FIG. 54, a cross-sectional side-view of the shin guard 1400 is shown. FIG. 54 shows that shin guard 1400 has two layers, an inner layer 1416 and outer layer 1418. Rear surface 1404 defines the inner limit of inner layer 1416. Front surface 1402 defines the outer limit of outer layer 1418. The outer layer 1418 directly contacts the inner layer 1416. Layers 1416 and 1418 are similar to layers 1316 and 1318. The inner layer 1416 and the outer layer 1418 may comprise the same material(s). Alternatively, the inner layer 1416 and the outer layer 1418 may comprise different material(s). In an embodiment, one or both of the inner layer 1416 and the outer layer 1418 comprises densified wood. In some embodiments, the inner layer 1416 and/or the outer layer 1418 may comprise material(s) that have a grain or an orientation. In some embodiments, the inner layer 1416 and/or the outer layer 1418 may comprise densified wood that has a grain or an orientation.

Any of the embodiments described herein may be modified to include any of the structures or methodologies disclosed in connection with different embodiments. Similarly, materials or construction techniques other than those disclosed above may be substituted or added in some embodiments according to known approaches. Further, the present disclosure is not limited to articles of footwear of the type specifically shown. Still further, aspects of the articles of footwear of any of the embodiments disclosed herein may be modified to work with any type of footwear, apparel, or other athletic equipment.

As noted previously, it will be appreciated by those skilled in the art that while the disclosure has been described above in connection with particular embodiments and examples, the disclosure is not necessarily so limited, and that numerous other embodiments, examples, uses, modifications and departures from the embodiments, examples and uses are intended to be encompassed by the claims attached hereto.

We claim:

1. An article of footwear, comprising:

an upper; and a sole structure coupled with the upper, the sole structure defining a forefoot region, a midfoot region, and a heel region, the sole structure comprising a midsole cushioning member having a top surface and a bottom surface;

an aperture in the midsole cushioning member extending from the top surface to the bottom surface;

at least one plate comprised of densified wood, wherein the plate comprises an arched segment, a rear segment, and a toe segment, wherein the toe segment bifurcates into a first toe segment portion and a second toe segment portion; and wherein the arched segment proximate to the rear segment extends through the aperture in the midsole cushioning member.

2. The article of footwear of claim 1, wherein the sole structure comprises:

an upper midsole cushioning member;

a lower midsole cushioning member;

an outsole coupled with a bottom surface of the lower midsole cushioning member; and the plate comprising densified wood positioned between the upper midsole cushioning member and the lower midsole cushioning member.

3. The article of footwear of claim 2, wherein the plate includes a flat portion and a curved portion including an anterior curved portion that extends through at least the forefoot region of the article of footwear and a posterior curved portion that extends through the midfoot region of the article of footwear and at least a portion of the heel region of the article of footwear.

4. The article of footwear of claim 2, wherein the sole structure further includes a heel support structure in the heel region of the article of footwear.

5. The article of footwear of claim 2, wherein the upper midsole cushioning member and the lower midsole cushioning member are a foam material.

6. The article of footwear of claim 3, wherein a minimum width of the anterior curved portion is larger than a minimum width of the posterior curved portion, and wherein a minimum width of the flat portion is larger than a minimum width of the posterior curved portion.

7. The article of footwear of claim 1, wherein the plate is comprised of a densified wood panel having a density between about 1.4 g/cc and about 1.6 g/cc.

8. The article of footwear of claim 1, wherein the plate is comprised of a delignified densified wood panel and at least 30% of the lignin has been removed relative to the lignin content of natural wood prior to delignification.

9. The article of footwear of claim 1, wherein the densified wood is made by a process comprising:

contacting natural wood comprising lignin and cellulose with a sodium based chemical solution for a time and under conditions sufficient to form delignified wood; and compressing the delignified wood until the thickness is reduced by at least 40%.

10. The article of footwear of claim 9, wherein the sodium based chemical solution comprises NaOH, NaOH/$Na_2S$, $NaHSO_3$+$SO_2$+$H_2O$, NaHSCb, $NaHSO_3$+$Na_2SO3$, NaOH+$Na_2SO_3$, $Na_2SO_3$, NaOH+AQ, NaOH/$Na_2S$+AQ, $NaHSO_3$±$SO_2$+$H_2O$+AQ, NaOH+$Na_2SO_3$+AQ, $NaHSO_3$+AQ, $NaHSO_3$+$Na_2SO_3$+AQ, $Na_2SO_3$+AQ, NaOH+$Na_2S$+$Na_2S_n$, $Na_2SO_3$+NaOH+$CH_3OH$+AQ, $C_2H_5OH$+NaOH, NaClO, $NaClO_2$+acetic acid, or combinations thereof where n is an integer and AQ is Anthraquinone.

11. The article of footwear of claim 9, wherein the delignified wood is compressed at a pressure between 0.5 MPa and 10 MPa.

12. The article of footwear of claim 9, wherein the delignified wood is compressed at a temperature between about 100° F. and about 250° F.

13. The article of footwear of claim 1, wherein the densified wood is made by viscoelastic thermal compression of natural wood.

14. The article of footwear of claim 1, wherein the plate is comprised of a densified wood panel which has been treated with a chemical to increase hydrophobicity, weatherability, corrosion resistance, or flame resistance.

15. The article of footwear of claim 1, wherein the sole structure comprises:

the plate including one or more protruding portions.

16. The article of footwear of claim 15, wherein a stud is attached to each of the one or more protruding portions.

17. The article of footwear of claim 16, wherein the stud is formed from metal, rubber, or a thermoplastic material.

18. An article of footwear, comprising:

an upper; and a sole structure coupled with the upper, the sole structure defining a forefoot region, a midfoot region, and a heel region, and the sole structure comprising:

a midsole cushioning member having a top surface and a bottom surface;

an aperture in the midsole cushioning member extending from the top surface to the bottom surface;

an outsole coupled with a bottom surface of the midsole cushioning member; and a plate, wherein the plate is formed from densified wood and includes a toe portion, an arched portion, and a rear segment;

wherein the toe portion bifurcates into a first toe segment portion and a second toe segment portion;

wherein the toe portion and the arched portion are positioned between the midsole cushioning member and the outsole, and the rear segment is positioned above the midsole cushioning member; and wherein the arched portion proximate to the rear segment extends through the aperture in the midsole cushioning member.

19. The article of footwear of claim 18, wherein the upper comprises densified wood.

* * * * *